US010747129B2

(12) United States Patent
Zhu et al.

(10) Patent No.: US 10,747,129 B2
(45) Date of Patent: Aug. 18, 2020

(54) ELECTROPHOTOGRAPHIC PHOTOCONDUCTOR, METHOD OF MANUFACTURING THE SAME, AND ELECTROPHOTOGRAPHIC APPARATUS

(71) Applicant: FUJI ELECTRIC CO., LTD., Kawasaki-shi, Kanagawa (JP)

(72) Inventors: Fengqiang Zhu, Matsumoto (JP); Shinjiro Suzuki, Matsumoto (JP); Seizo Kitagawa, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/523,540

(22) Filed: Jul. 26, 2019

(65) Prior Publication Data

US 2019/0346780 A1 Nov. 14, 2019

Related U.S. Application Data

(63) Continuation of application No. PCT/JP2018/005599, filed on Feb. 16, 2018.

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/04* (2013.01); *G03G 5/0525* (2013.01);
(Continued)

(58) Field of Classification Search
USPC ..... 430/59.6, 58.75, 58.85, 58.25, 58.5, 430/58.55, 59.2
See application file for complete search history.

(56) References Cited

U.S. PATENT DOCUMENTS 5,736,282 A 4/1998 Tamura et al.
5,874,570 A 2/1999 Tamura et al.
(Continued)

FOREIGN PATENT DOCUMENTS

JP S6162040 A 3/1986
JP H01205171 A 8/1989
(Continued)

*Primary Examiner* — Mark A Chapman
(74) *Attorney, Agent, or Firm* — Rabin & Berdo, P.C.

(57) ABSTRACT

Provided is a photoconductor for electrophotography having high sensitivity, low residual potential, and good wear resistance and contamination resistance, and that is less likely to cause light-induced fatigue and filming, and also exhibits good potential stability before and after repeated printing, even without a surface protective layer formed on a photosensitive layer. Provided also are a process of producing the photoconductor and an electrophotographic apparatus. The photoconductor for electrophotography may be a single-layer-type photoconductor or a multi-layer-type photoconductor and includes a conductive substrate and a photosensitive layer formed on the conductive substrate and including a hole transport material having a structure represented by general formula (1) below; a binder resin having a repeating structure represented by general formula (2) below; and at least one electron transport material having a
(Continued)

structure represented by general formulae (ET1) to (ET3) below:

(1)

(2)

(ET1)

(ET2)

(ET3)

12 Claims, 2 Drawing Sheets

(51) Int. Cl.

| | |
|---|---|
| ***G03G 5/05*** | (2006.01) |
| ***G03G 5/06*** | (2006.01) |
| ***G03G 5/04*** | (2006.01) |

(52) U.S. Cl.

CPC ..... *G03G 5/0564* (2013.01); *G03G 5/0609* (2013.01); *G03G 5/0614* (2013.01); *G03G 5/0618* (2013.01); *G03G 5/0631* (2013.01)

(56) References Cited

U.S. PATENT DOCUMENTS

| | | | | |
|---|---|---|---|---|
| 9,158,264 | B2 * | 10/2015 | Iwashita | G03G 15/75 |
| 9,213,229 | B2 * | 12/2015 | Iwashita | G03C 1/52 |
| 2008/0159791 | A1 | 7/2008 | Urano et al. | |
| 2014/0199619 | A1 | 7/2014 | Kitagawa et al. | |
| 2015/0346619 | A1 | 12/2015 | Kitagawa et al. | |
| 2016/0116854 | A1 | 4/2016 | Hirata et al. | |
| 2017/0146916 | A1 | 5/2017 | Takeuchi et al. | |
| 2018/0307147 | A1 | 10/2018 | Suzuki et al. | |

FOREIGN PATENT DOCUMENTS

| | | | |
|---|---|---|---|
| JP | H03149560 | A | 6/1991 |
| JP | H04368953 | A | 12/1992 |
| JP | H07333881 | A | 12/1995 |
| JP | H08209023 | A | 8/1996 |
| JP | H11160958 | A | 6/1999 |
| JP | 2000047405 | A | 2/2000 |
| JP | 2000066419 | A | 3/2000 |
| JP | 2002162759 | A | 6/2002 |
| JP | 2005263737 | A | 9/2005 |
| JP | 2006065083 | A | 3/2006 |
| JP | 2006091855 | A | 4/2006 |
| JP | 2007121733 | A | 5/2007 |
| JP | 2007271962 | A | 10/2007 |
| JP | 2008164757 | A | 7/2008 |
| JP | 2013025189 | A | 2/2013 |
| JP | 2014092594 | A | 5/2014 |
| JP | 2016142927 | A | 8/2016 |
| JP | 2016224108 | A | 12/2016 |
| JP | 2017097065 | A | 6/2017 |
| WO | 2013021430 | A1 | 2/2013 |
| WO | 2014192633 | A1 | 12/2014 |
| WO | 2015008710 | A1 | 1/2015 |
| WO | 2018016156 | A1 | 1/2018 |

* cited by examiner

ELECTROPHOTOGRAPHIC PHOTOCONDUCTOR, METHOD OF MANUFACTURING THE SAME, AND ELECTROPHOTOGRAPHIC APPARATUS

CROSS-REFERENCE TO RELATED APPLICATIONS

This non-provisional application is a continuation of International Application No. PCT/JP2018/005599 filed on Feb. 16, 2018, the entire contents of which are incorporated herein by reference.

BACKGROUND OF THE INVENTION

1. Field of the Invention

The present invention relates to a photoconductor for electrophotography (hereinafter also referred to as "photoconductor"), a process of producing the same, and an electrophotographic apparatus. More particularly, the present invention relates to a photoconductor for electrophotography mainly including a conductive substrate and a photosensitive layer containing an organic material and used in an electrophotographic printer, copier, fax machine and the like, a process of producing the same, and an electrophotographic apparatus.

2. Background of the Related Art

A photoconductor for electrophotography has a basic structure containing a photosensitive layer with a photoconductive function formed on a conductive substrate. Recently, organic photoconductors for electrophotography using organic compounds as components serving to generate and transport electric charges have been actively researched and developed in view of their advantages such as diversity of materials, high productivity, and safety. They are also increasingly applied to copiers, printers and the like.

Recently, organic photoconductors have been required to be more long-lived due to intensive printing associated with intra-office networking, which leads to increasing number of copies printed per electrophotographic apparatus, and from the viewpoint of reducing running costs. Particularly in the development of new color printers, cost reduction requires downsizing of machines, which involves requirements for smaller organic photoconductors, and investigations are underway considering a diameter of 20 mm as a base. A surface layer of photoconductors is typically formed mainly of a charge transport material and a binder resin. In order to ensure printing durability on the photoconductor surface, the molecular structure and the content of the binder resin play important roles.

Photoconductors are commonly required to have a function of retaining surface charges in the dark, a function of receiving light and generating charges, and a function of transporting the generated charges. Photoconductors are classified into so-called single-layer photoconductors including a single-layer photosensitive layer having all of the functions and so-called multi-layer (functionally separated) photoconductors including a photosensitive layer having functionally separated and laminated layers, a charge generation layer mainly functioning to generate charges during photoreception and a charge transport layer functioning to retain surface charges in the dark and to transport the charges generated in the charge generation layer during photoreception.

The photosensitive layer is typically formed by applying on a conductive substrate a coating liquid prepared by dissolving or dispersing a charge generation material, a charge transport material and a binder resin in an organic solvent. In these organic photoconductors for electrophotography, particularly in the outermost surface layer, polycarbonates that is resistant to the friction that occurs between the layer and paper or a blade for toner removal, has excellent flexibility, and has good transmission properties for exposure light, is often used as the binder resin. Among them, bisphenol Z polycarbonate is widely used as the binder resin. Technologies using such polycarbonates as a binder resin are described, for example, in Patent Document 1 (JPS61-62040A).

On the other hand, among recent electrophotographic apparatuses, so-called digital instruments have become dominant. The digital instruments digitize information such as images and characters to convert the information into light signals using monochromatic light, such as argon laser, helium-neon laser, semiconductor laser or light emitting diode, as an exposure light source. The light signals are then irradiated on a charged photoconductor to form an electrostatic latent image on the surface of the photoconductor. Finally, the electrostatic latent image is visualized by toner.

Methods for charging a photoconductor include non-contact charging systems in which a charging member such as a scorotron and a photoconductor are not in contact with each other; and contact charging systems in which a charging member, such as a roller or a brush, and a photoconductor are in contact with each other. Among these, the contact charging systems are characterized in that ozone is less generated due to occurrence of corona discharge in close proximity to the photoconductor as compared with the non-contact charging systems, so that voltage to be applied may be lower. Thus, the contact charging systems, which can provide more compact, low-cost and low-pollution electrophotographic apparatuses, are now the mainstream particularly in medium- to small-size apparatuses.

Means for cleaning the surface of a photoconductor mainly used include scraping off with a blade and a process simultaneously performing development and cleaning. Cleaning with a blade includes scraping off untransferred toner left on the surface of an organic photoconductor using a blade, and collecting the toner into a waste toner box or returning the toner into the development device. Cleaners in such a scraping off system with a blade require a toner collection box for collecting scraped toner or a space for recycling scraped toner, as well as monitoring whether the toner collection box is full. Furthermore, when paper dust or external additives remain on the blade, it may cause scratches on the surface of the organic photoconductor, shortening the lifetime of the photoconductor. Thus, there may be a process provided for collecting toner during a development process, or for magnetically or electrically absorbing residual toner adhering to the surface of the photoconductor immediately before the development roller. Furthermore, the cleaning with a blade requires increased rubber hardness of the blade or increased contact pressure of the blade on the photoconductor in order to increase the cleaning properties. This may accelerate wearing of the photoconductor, which leads to changes in the potential and the sensitivity, causing image deficiencies. This may cause deficiencies in the color balance and reproducibility in color electrophotographic apparatuses.

On the other hand, when using a cleaningless mechanism using the contact charging system to perform both development and cleaning in a development device, toner with varying amounts of charge may be generated in the contact charging system. The presence of reverse polarity toner contained in a very small amount may lead to a problem that the toner cannot be sufficiently removed from the surface of the photoconductor and contaminates the charging device. Furthermore, the surface of the photoconductor may be contaminated by ozone, nitrogen oxides and the like generated during charging of the photoconductor. There are problems such as image deletion due to the contaminants themselves, as well as easy adhesion of paper dust and toner, blade squeaking and blade turn-over, and the susceptibility of the surface to scratches due to decreased lubricity of the surface of the photoconductor caused by adhered materials.

Furthermore, attempts have been made to regulate the transfer current to be optimal according to the temperature and humidity environment or the characteristics of the paper in order to increase the transfer efficiency of toner in the transfer process, thereby reducing residual toner. As an organic photoconductor suitable for such processes or contact charging systems, an organic photoconductor having improved toner releasability or an organic photoconductor that is less affected by transfer, is required.

In order to solve these problems, methods for modifying the outermost layer of a photoconductor have been suggested. For example, in Patent Document 2 (JPH01-205171A) and Patent Document 3 (JPH07-333881A), a method in which a filler is added to a surface layer of a photosensitive layer in order to enhance the durability of the surface of the photoconductor is suggested. Unfortunately, in such a method including dispersing a filler in a film, it is difficult to uniformly disperse the filler. Furthermore, the presence of filler aggregates, a reduction of transmission properties of the film, or scattering of the exposed light by the filler may cause problems that charge transport or charge generation ununiformly occurs, and that image characteristics are deteriorated. Against the problems, methods in which a dispersing material is added in order to enhance the dispersibility of the filler may be used. However, since the dispersing material itself affects the characteristics of the photoconductor, it is difficult to obtain both good photoconductor characteristics and filler dispersibility.

Further, Patent Document 4 (JPH04-368953A) discloses a method in which a fluorine resin such as polytetrafluoroethylene (PTFE) is added to the photosensitive layer, while Patent Document 5 (JP2002-162759A) discloses a method in which a silicone resin such as alkyl-modified polysiloxane is added. However, the method described in Patent Document 4 has a problem that fluorine resins such as PTFE are poorly soluble in solvents or poorly compatible with other resins, which causes phase separation and light scattering at the interface between the resins. For that reason, sensitivity characteristics required as a photoconductor cannot be achieved. On the other hand, the method described in Patent Document 5 has a problem that the silicone resin bleeds into the coating surface, so that the effects cannot be obtained continuously.

In order to solve such problems, Patent Document 6 (JP2000-66419A), Patent Document 7 (JP2000-47405A), and Patent Document 8 (JP2013-25189A) disclose photoconductors having improved durability by containing a high-mobility hole transport agent as a charge transport agent in the charge transport layer. Even such photoconductors have a problem with insufficient wear resistance depending on resins to be combined.

Meanwhile, in order to protect, to improve the mechanical strength of, and to improve the surface lubricity of the photosensitive layer, methods of forming a surface protective layer on the photosensitive layer are suggested. However, the methods of forming a surface protective layer have problems with difficulties of film formation on the charge transport layer and of sufficient achievement of both charge transport performance and charge retention function.

With regard to contamination resistance, there is a problem that, in the electrophotographic apparatus, the photoconductor is always in contact with a charging roller and a transfer roller, of which components exude to contaminate the surface of the photoconductor, leading to generation of black streaks in a halftone image. As countermeasures for the contamination resistance, a method in which a resin containing ethylene-butylene copolymer is used in a resistance layer constituting the surface of the charging roller, as shown in Patent Document 9 (JPH11-160958A), and a method in which a rubber composition containing epichlorohydrin-based rubber as a main component of the rubber and a filler is used in a rubber layer of the transfer roller, as shown in Patent Document 10 (JP2008-164757A), are disclosed. However, these methods were not able to sufficiently meet the requirements for the contamination resistance.

Though having many advantages as photoconductor materials over inorganic materials as described above, organic materials obtained at present has not yet sufficiently achieved all of the characteristics required for photoconductors for electrophotography. Thus, deterioration of the image quality is caused by the decrease of the charging potential, the increase of the residual potential, the change of the sensitivity and the like due to repeated use. Although the cause of this deterioration is not completely understood, one of the possible factors is, for example, photodegradation of resin or degradation of charge transport material due to repeated exposure to image exposure light and neutralizing lamp light and exposure to external light during maintenance.

An object of the present invention is to solve the above problems and to provide a photoconductor for electrophotography which has high sensitivity, low residual potential, and good wear resistance and contamination resistance, and is less likely to fall into light-induced fatigue and filming, and also has good potential stability before and after repeated printing even without a surface protective layer formed on a photosensitive layer, and a process of producing the photoconductor, and an electrophotographic apparatus.

SUMMARY OF THE INVENTION

In order to solve the above problems, the present inventors have intensively studied to find the following facts and thereby completed the present invention. When a photoconductor includes, on its outermost surface, a photosensitive layer having a specific hole transport material with high mobility, polycarbonate resin and an electron transport material, the photosensitive layer can suppress the intrusion of components exuding from apparatus-constituting members, such as charging roller, into the photoconductor, leading to improvement of the contamination resistance and the wear resistance, prevention of light-induced fatigue and filming, and also retention of the potential stability throughout repeated printings.

Thus, a photoconductor for electrophotography according to a first aspect of the present invention includes: a conductive substrate; and a photosensitive layer formed on the conductive substrate and including a hole transport material having a structure represented by general formula (1) below; a binder resin having a repeating structure represented by general formula (2) below; and at least one electron transport material having a structure represented by general formulae (ET1) to (ET3) below:

General Formula (1)

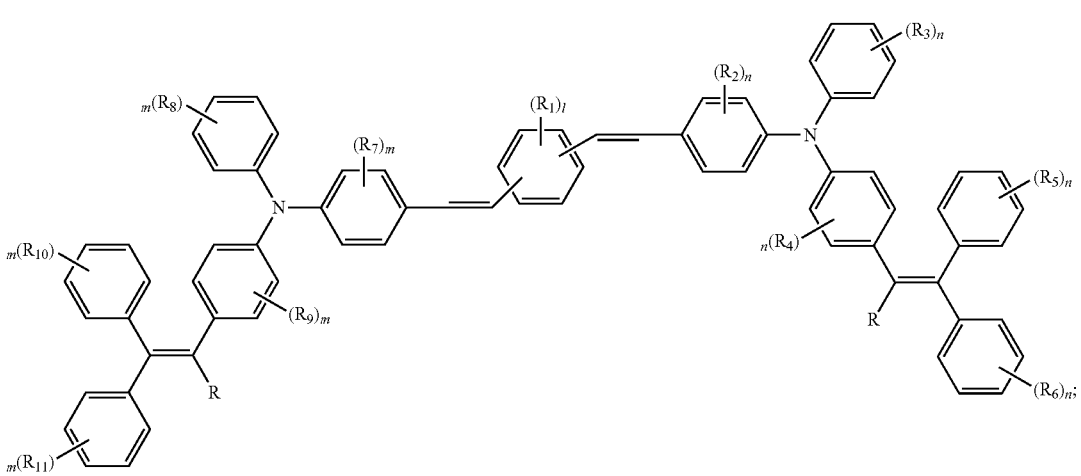

(1)

where $R_1$ represents a hydrogen atom or an optionally substituted $C_{1-3}$ alkyl group; $R_2$ to $R_{11}$ each independently represent a hydrogen atom, a halogen atom, an optionally substituted $C_{1-6}$ alkyl group or an optionally substituted $C_{1-6}$ alkoxy group; 1, m, and n each represent an integer of 0 to 4; and R represents a hydrogen atom or an optionally substituted $C_{1-3}$ alkyl group;

General Formula (2)

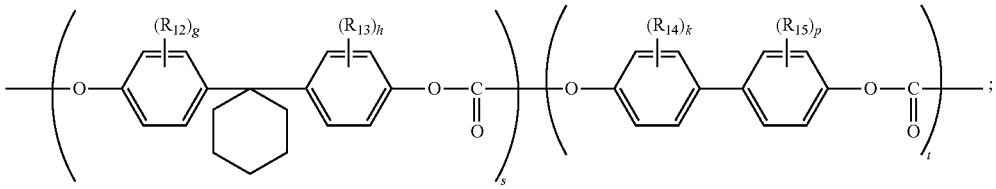

(2)

where $R_{12}$ to $R_{15}$ are the same or different and each represent a hydrogen atom, a $C_{1-10}$ alkyl group or a $C_{1-10}$ fluoroalkyl group; g, h, k, and p each represent an integer of 0 to 4; s and t satisfy $0.3 \leq t/(s+t) \leq 0.7$; and the chain end group is a monovalent aromatic group or a monovalent fluorine-containing aliphatic group;

General Formula (ET1)

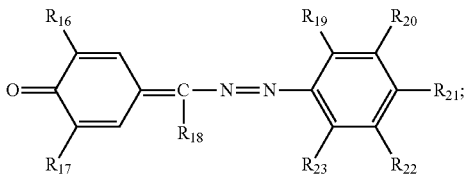

(ET1)

where $R_{16}$ and $R_{17}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group or a halogenated alkyl group; $R_{18}$ represents a hydrogen atom, a $C_{1-6}$ alkyl group, a $C_{1-6}$ alkoxy group, an optionally substituted aryl group, a cycloalkyl group, an optionally substituted aralkyl group or a halogenated alkyl group; and $R_{19}$ to $R_{23}$ are the same or different and each represent a hydrogen atom, a halogen atom, a $C_{1-12}$ alkyl group, a $C_{1-12}$ alkoxy group, an optionally substituted aryl group, an optionally substituted aralkyl group, an optionally substituted phenoxy group, a halogenated alkyl group, a cyano group or a nitro group; or two or more of the groups optionally combine together to form a ring; and wherein the substituent represents a halogen atom, a $C_{1-6}$ alkyl group, a $C_{1-6}$ alkoxy group, a hydroxy group, a cyano group, an amino group, a nitro group or a halogenated alkyl group;

General Formula (ET2)

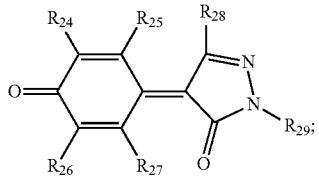

(ET2)

where $R_{24}$ to $R_{29}$ are the same or different and each represent a hydrogen atom, a halogen atom, a cyano group, a nitro group, a hydroxy group, a $C_{1-12}$ alkyl group, a $C_{1-12}$ alkoxy group, an optionally substituted aryl group, an optionally substituted heterocyclic group, an ester group, a cycloalkyl group, an optionally substituted aralkyl group, an allyl group, an amide group, an amino group, an acyl group, an alkenyl group, an alkynyl group, a carboxyl group, a carbonyl group, a carboxy group or a halogenated alkyl group; and wherein the substituent represents a halogen atom, a $C_{1-6}$ alkyl group, a $C_{1-6}$ alkoxy group, a hydroxy group, a cyano group, an amino group, a nitro group or a halogenated alkyl group; and General Formula (ET3)

(ET3)

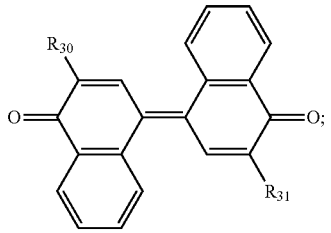

where $R_{30}$ and $R_{31}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group, or a halogenated alkyl group; and wherein the substituent represents a halogen atom, a $C_{1-6}$ alkyl group, a $C_{1-6}$ alkoxy group, a hydroxy group, a cyano group, an amino group, a nitro group or a halogenated alkyl group.

Uses of a copolymerized polycarbonate resin having the repeating unit represented by the above general formula (2) as a binder resin, which can lead to achievement of good wear resistance, and of a compound having the structure represented by the above general formula (1) as a hole transport material with high mobility, which can lead to maintenance of high sensitivity even when the mass ratio of the binder resin contributing to wear resistance is increased, enable both high wear resistance and high sensitivity to be achieved. However, the polycarbonate resin represented by the above general formula (2) is poor in light resistance to ultraviolet light, and the gas resistance to active gases, such as ozone. Thus, in order to absorb the ultraviolet light, at least one electron transport material having the structure represented by the above general formulae (ET1) to (ET3) and having an absorption range in the ultraviolet range can be used to achieve high light resistance and potential stability in repetition.

In one embodiment of the first aspect, the photosensitive layer may include a charge generation layer and a charge transport layer laminated in the order on the conductive substrate, and the charge transport layer may include the hole transport material, the binder resin and the at least one electron transport material. In this embodiment, the hole transport material preferably has a hole mobility of $60\times10^{-6}$ $cm^2/V\cdot s$ or more. In this embodiment, the charge transport layer preferably contains the binder resin in an amount of 55% by mass or more and 85% by mass or less relative to the solid content of the charge transport layer. In another embodiment, the photosensitive layer may include the hole transport material, the binder resin and the at least one electron transport material in a single layer. In this embodiment, the hole transport material preferably has a hole mobility of $60\times10^{-6}$ $cm^2/V\cdot s$ or more. In this embodiment, the photosensitive layer preferably contains the binder resin in an amount of 55% by mass or more and 85% by mass or less relative to the solid content of the photosensitive layer. In still another embodiment, the photosensitive layer may include a charge transport layer and a charge generation layer laminated in the order on the conductive substrate, and the charge generation layer may include the hole transport material, the binder resin and the at least one electron transport material. In this embodiment, the hole transport material preferably has a hole mobility of $60\times10^{-6}$ $cm^2/V\cdot s$ or more. In this embodiment, the charge generation layer preferably contains the binder resin in an amount of 55% by mass or more and 85% by mass or less relative to the solid content of the charge generation layer.

A process of producing the photoconductor for electrophotography according to a second aspect of the present invention includes the steps of: preparing a coating liquid containing a hole transport material having a structure represented by the general formula (1), a binder resin having a repeating structure represented by the general formula (2), and at least one electron transport material having a structure represented by the general formulae (ET1) to (ET3); and applying the coating liquid on the conductive substrate to form the photosensitive layer.

An electrophotographic apparatus according to a third aspect of the present invention is equipped with the photoconductor for electrophotography.

Effects of the Invention

According to the aspects described above, a photoconductor for electrophotography which has high sensitivity, low residual potential, and good wear resistance and contamination resistance, and is less likely to fall into light-induced fatigue and filming, and also has good potential stability throughout repeated printing even without a surface protective layer formed on a photosensitive layer, and a process of producing the photoconductor, and an electrophotographic apparatus can be provided.

DETAILED DESCRIPTION OF THE INVENTION

Embodiments of the present invention will be described in detail with reference to drawings. However, the present invention is not limited to those descriptions.

Figure 1:
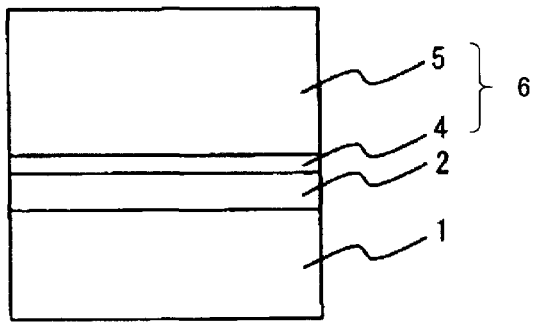
FIG. 1 is a schematic cross-sectional view showing an example of the photoconductor for electrophotography of the present invention.

Photoconductors for electrophotography are broadly classified into so-called negatively-charged multi-layer photoconductor and positively-charged multi-layer photoconductor as multi-layer (functionally separated) photoconductor, and single-layer photoconductor mainly used in the form of positively-charged photoconductor. FIG. 1 is a schematic cross-sectional view showing an example of the photoconductor for electrophotography of the present invention, and shows a negatively-charged multi-layer photoconductor for electrophotography. As shown in FIG. 1, in the negatively-charged multi-layer photoconductor, a negatively-charged multi-layer photosensitive layer 6 including a charge generation layer 4 having charge generation function and a charge transport layer 5 having charge transport function laminated in the order is formed on a conductive substrate 1 via an undercoat layer 2.

Figure 2:
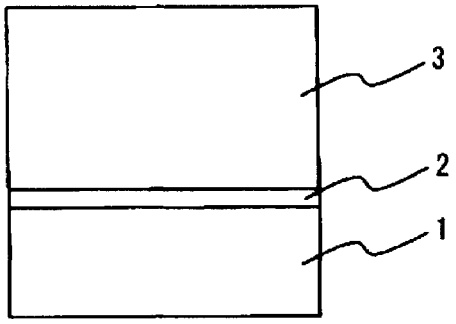
FIG. 2 is a schematic cross-sectional view showing another example of the photoconductor for electrophotography of the present invention.

FIG. 2 is another schematic cross-sectional view showing an example of the photoconductor for electrophotography of the present invention, and shows a positively-charged single-layer photoconductor for electrophotography. As shown in FIG. 2, in the positively-charged single-layer photoconductor, a positively-charged single-layer photosensitive layer 3 having both charge generation function and charge transport function is laminated on a conductive substrate 1 via an undercoat layer 2.

Figure 3:
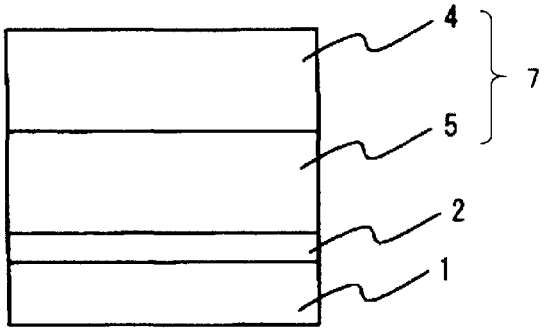
FIG. 3 is a schematic cross-sectional view showing still another example of the photoconductor for electrophotography of the present invention.

FIG. 3 is still another schematic cross-sectional view showing an example of the photoconductor for electrophotography of the present invention, and shows a positively-charged multi-layer photoconductor for electrophotography. As shown in FIG. 3, in the positively-charged multi-layer photoconductor, a positively-charged multi-layer photosensitive layer 7 having a charge transport layer 5 having charge transport function and a charge generation layer 4 having both charge generation function and charge transport function laminated in the order is formed on a conductive substrate 1 via an undercoat layer 2.

Any photoconductor may include the undercoat layer 2 as necessary. The term "photosensitive layer" as used herein includes both a multi-layer photosensitive layer in which a charge generation layer and a charge transport layer are laminated, and a single-layer photosensitive layer.

In some embodiments of the present invention, the photoconductor includes a conductive substrate, and a photosensitive layer formed on the conductive substrate, wherein the photosensitive layer includes a hole transport material having a structure represented by the above general formula (1); a binder resin having a repeating structure represented by the above general formula (2); and at least one electron transport material having a structure represented by the above general formulae (ET1) to (ET3). In such embodiments, a photoconductor which has high sensitivity, low residual potential, and good wear resistance and contamination resistance, and is less likely to fall into light-induced fatigue and filming, and also has good potential stability throughout repeated printings even without a surface protective layer formed on a photosensitive layer can be provided.

Specific examples of the compound having the structure represented by the above general formula (1) as a hole transport material include, but are not limited to, the following:

(1-1)

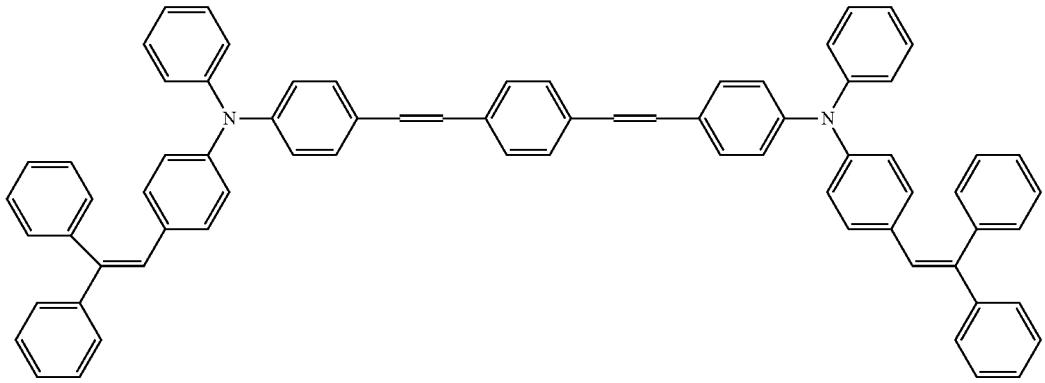

(1-2)

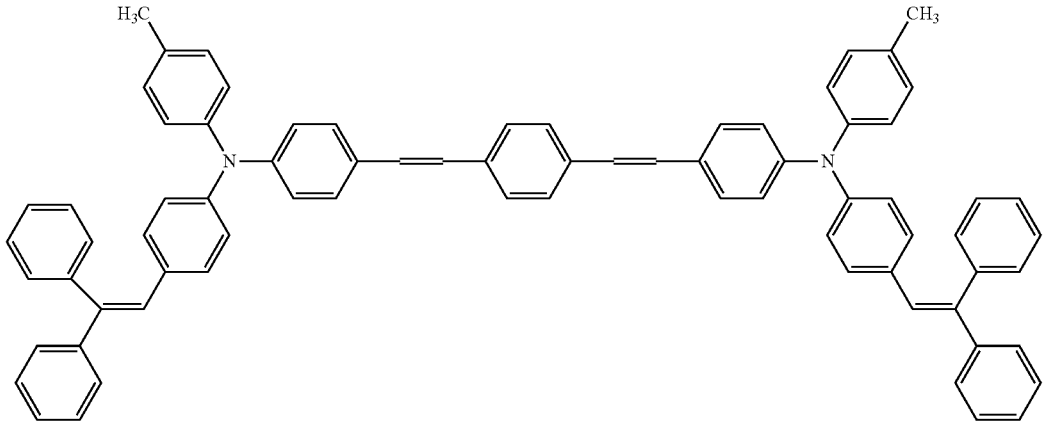

-continued
(1-3)
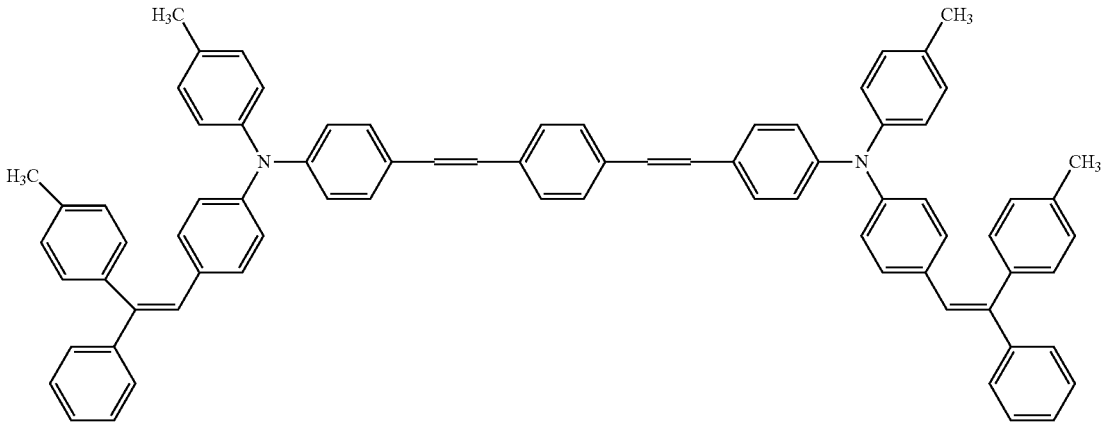
(1-4)
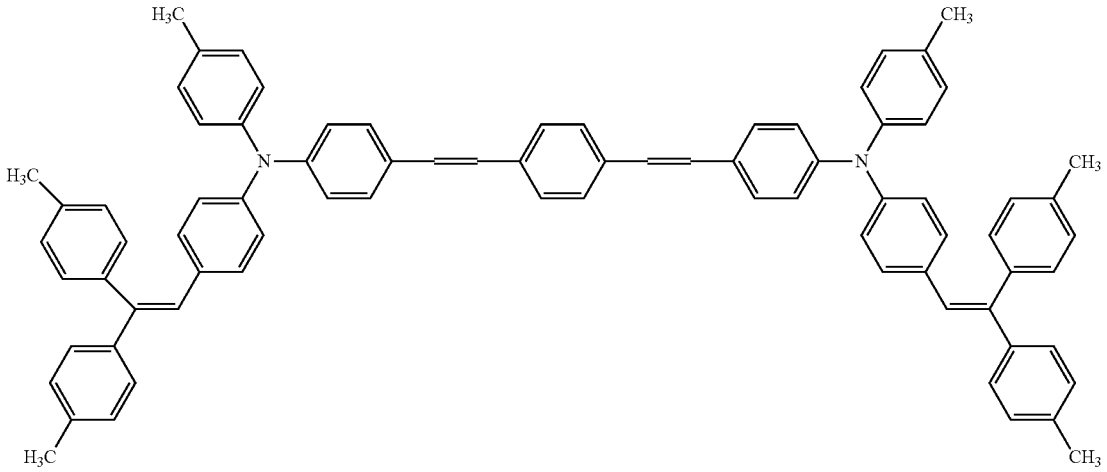
(1-5)
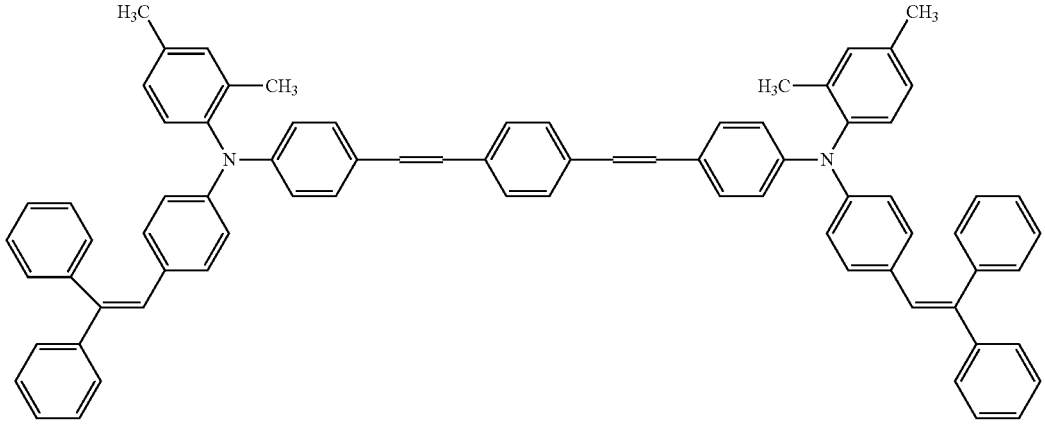

-continued
(1-6)
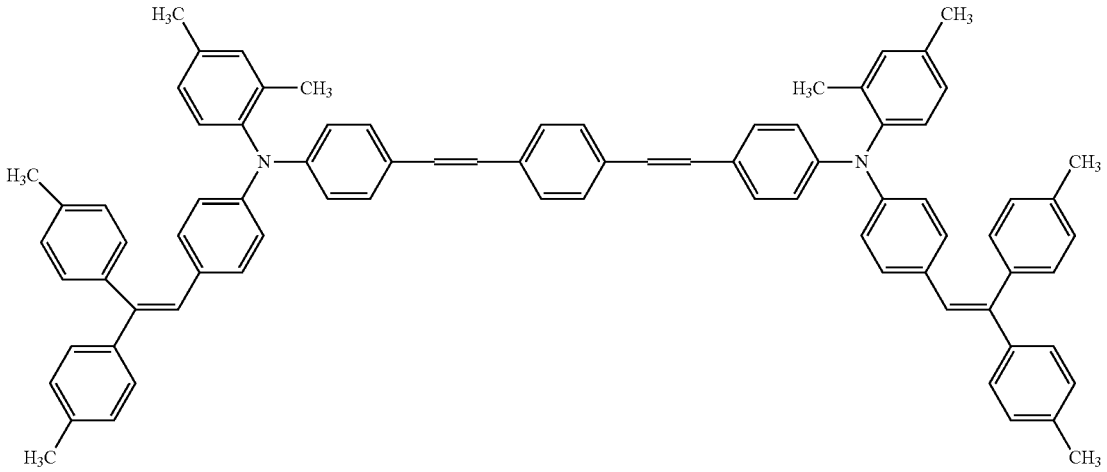
(1-7)
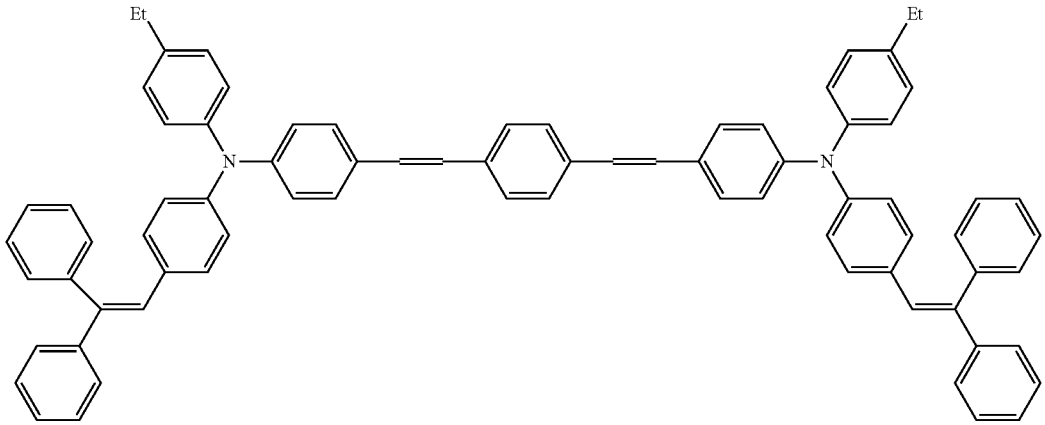
(1-8)
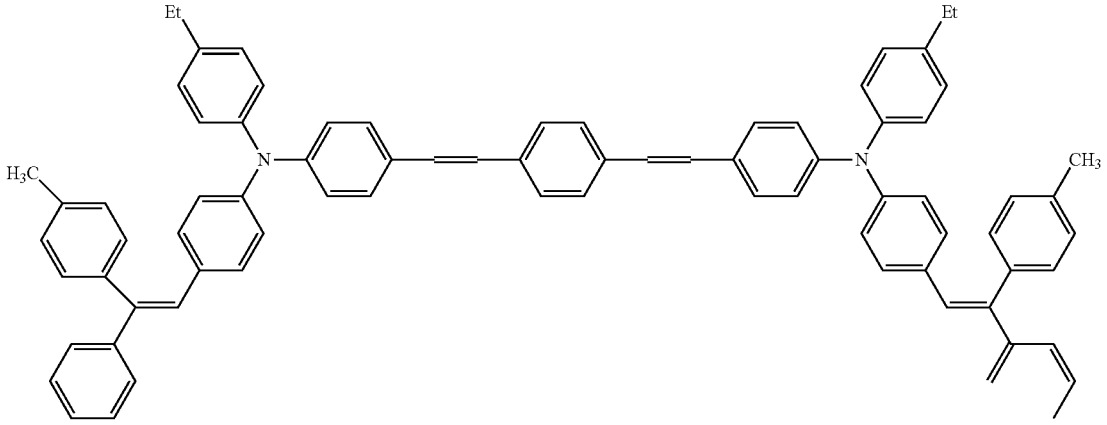

-continued
(1-9)
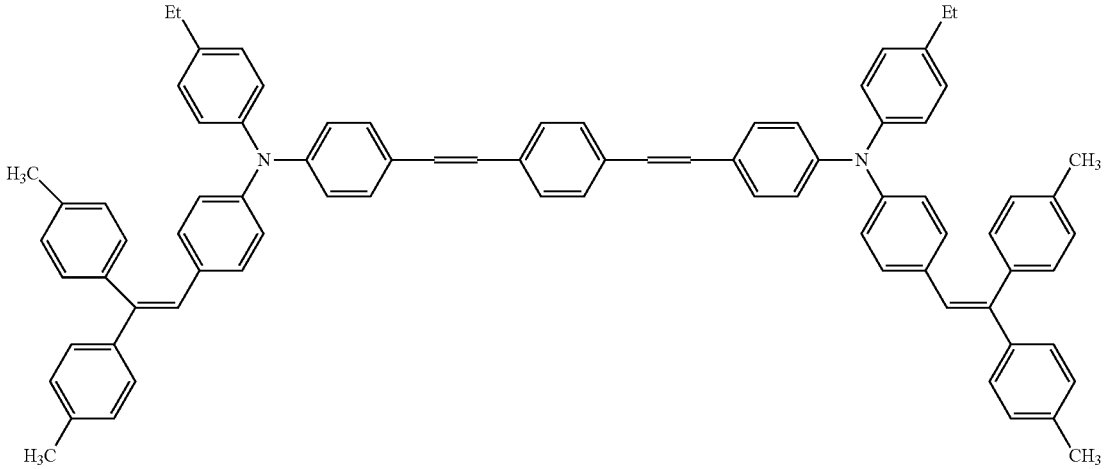
(1-10)
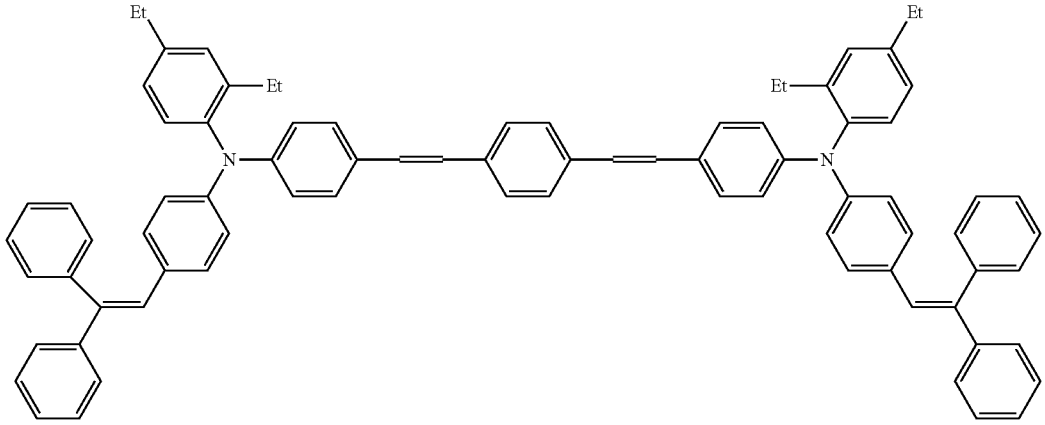
(1-11)
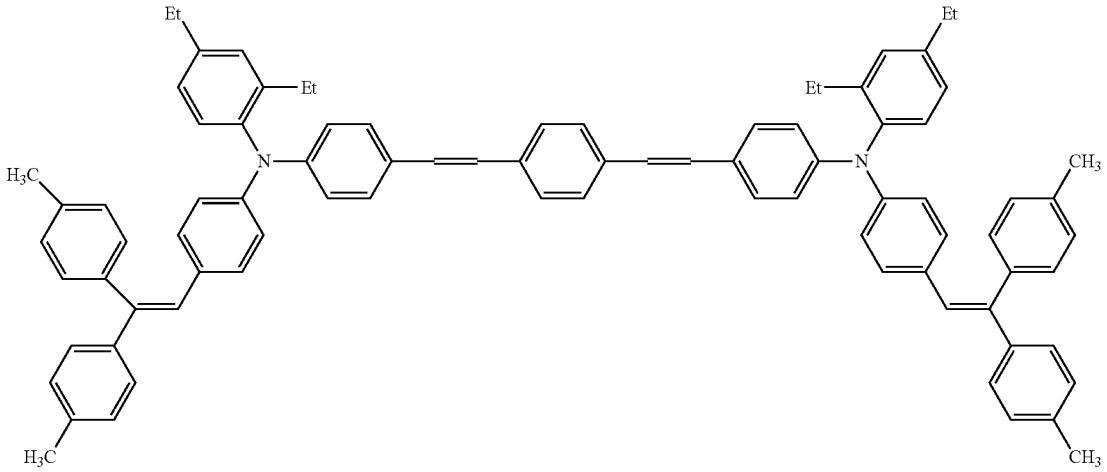

-continued
(1-12)
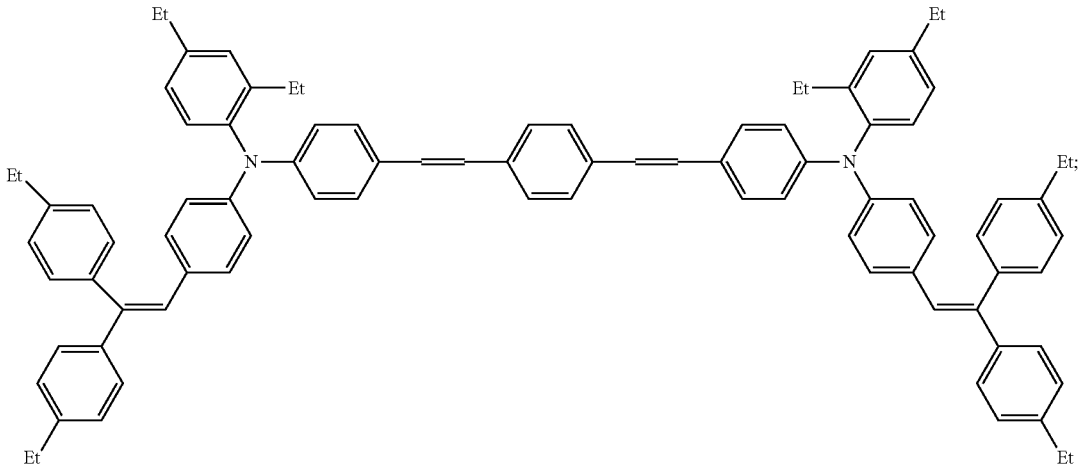
(1-13)
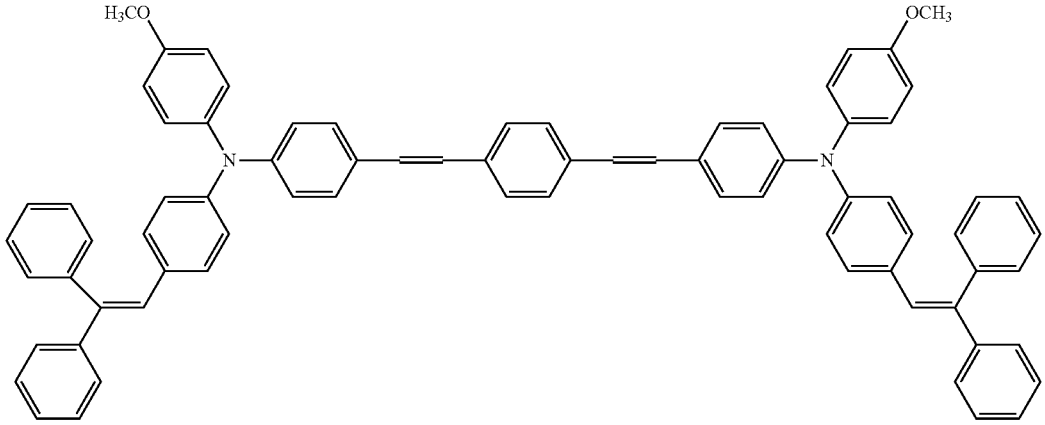
(1-14)
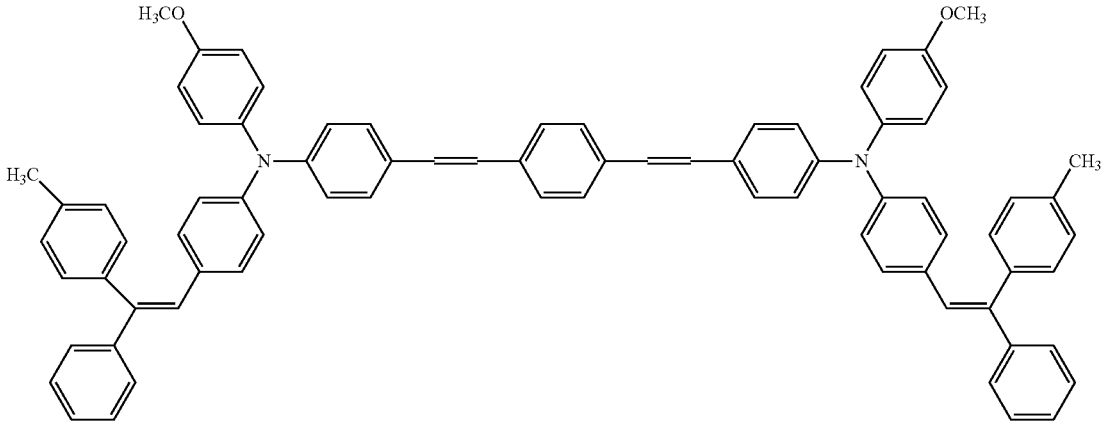

-continued
(1-15)
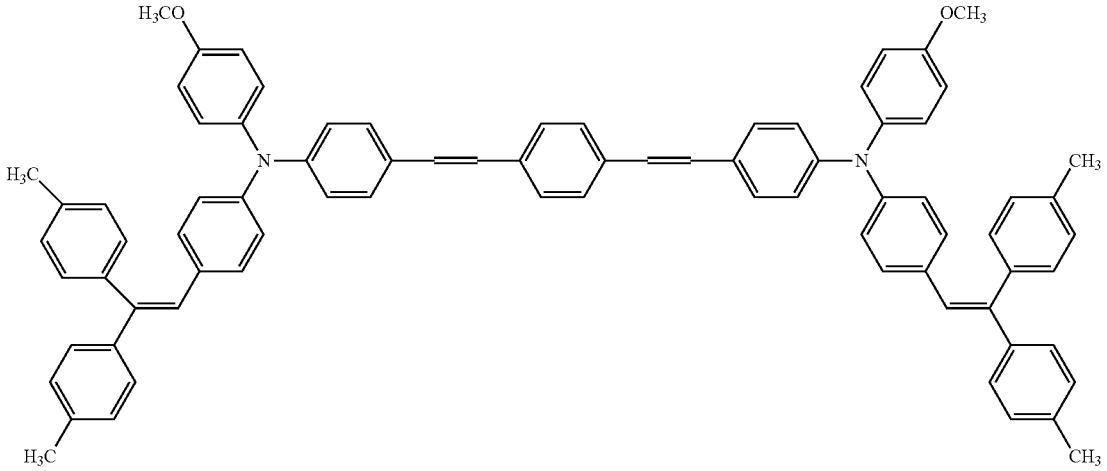
(1-16)
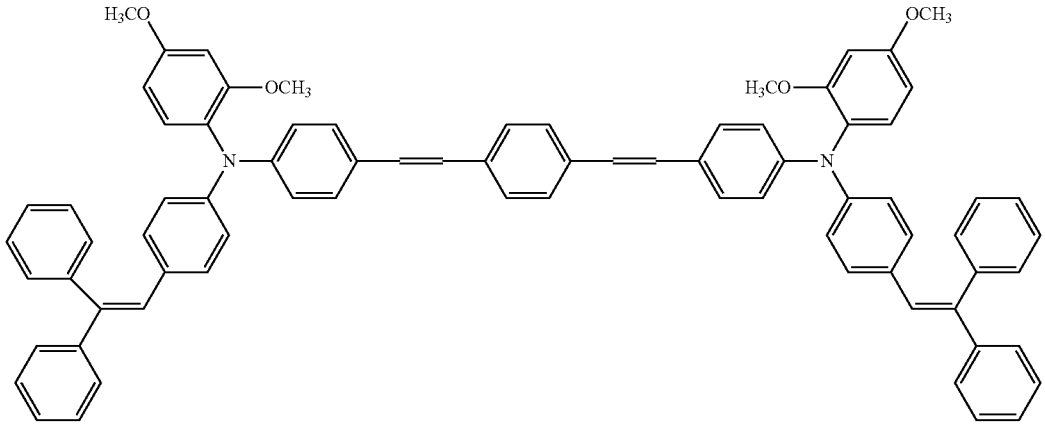
(1-17)
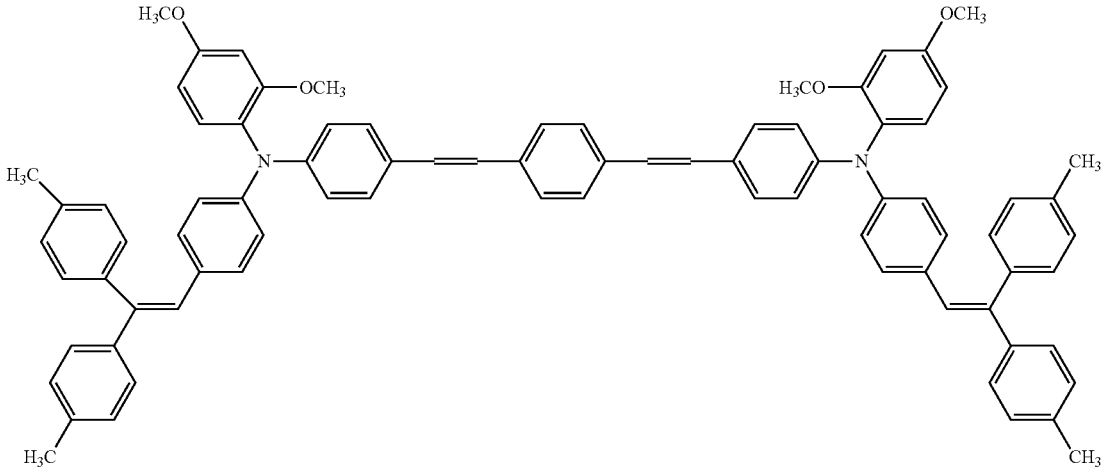

-continued
(1-18)
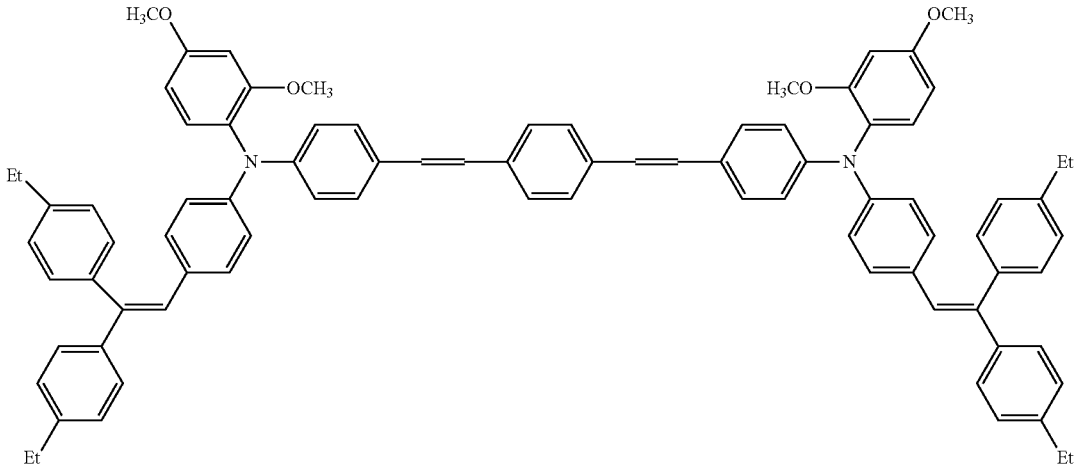
(1-19)
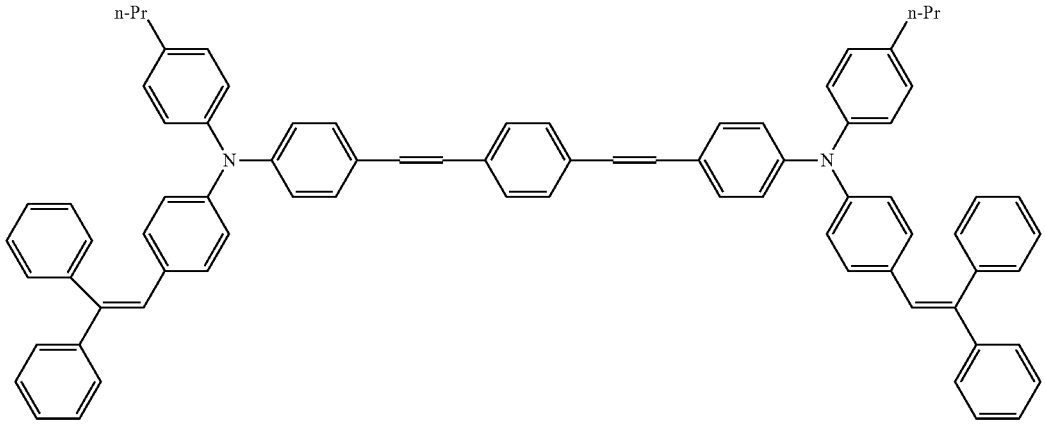
(1-20)
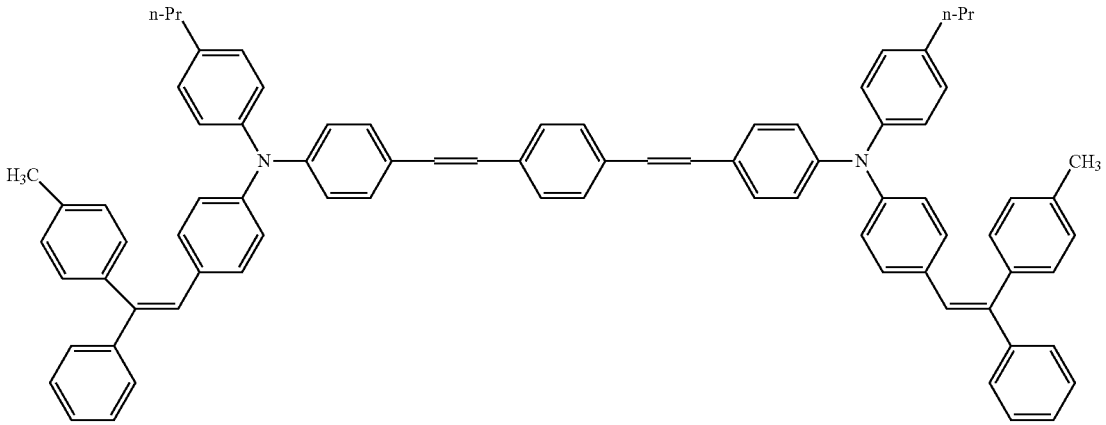

-continued
(1-21)
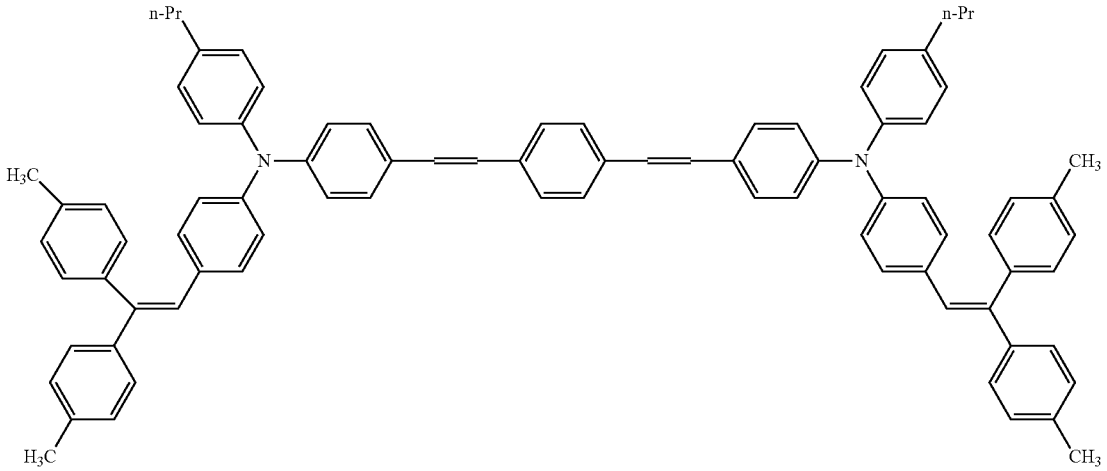
(1-22)
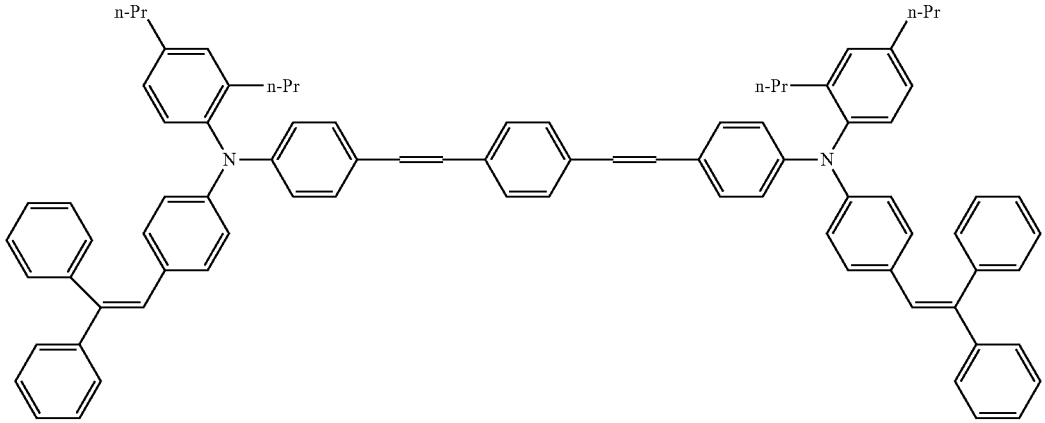
(1-23)
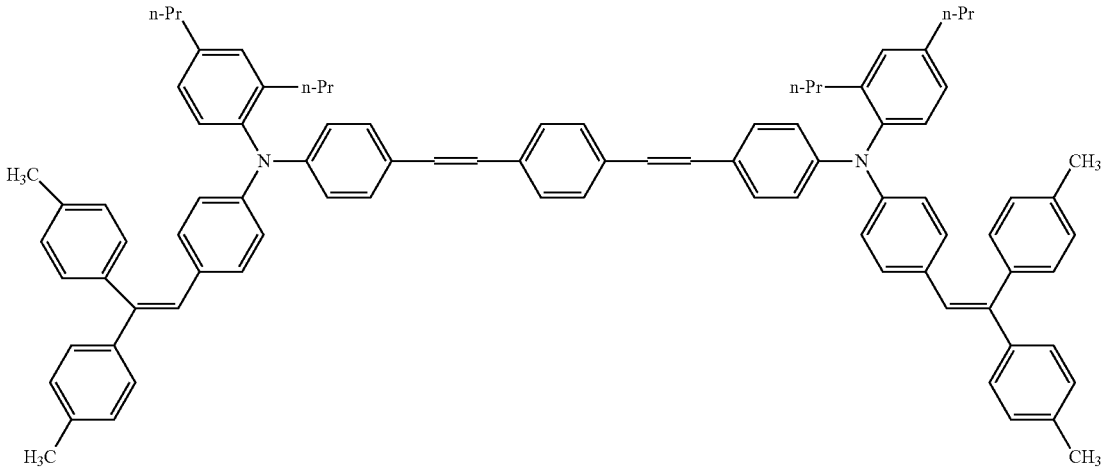

-continued
(1-24)
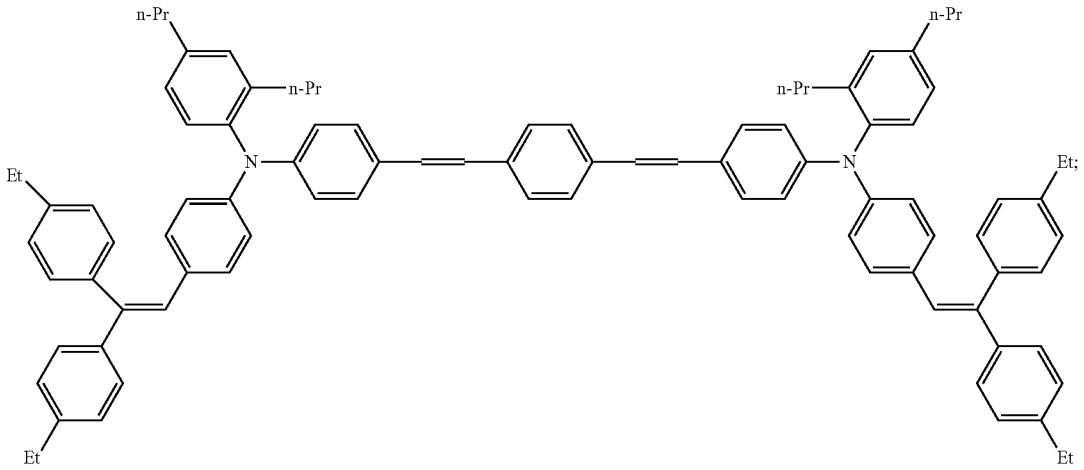
(1-25)
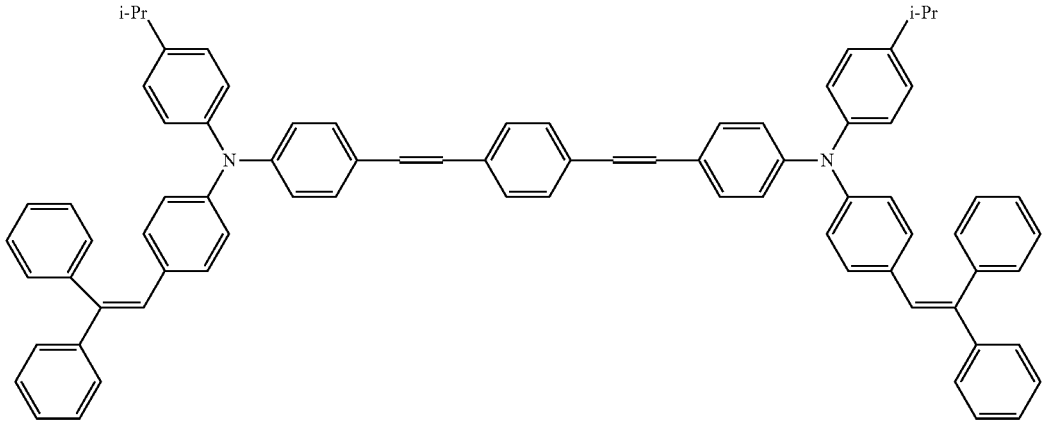
(1-26)
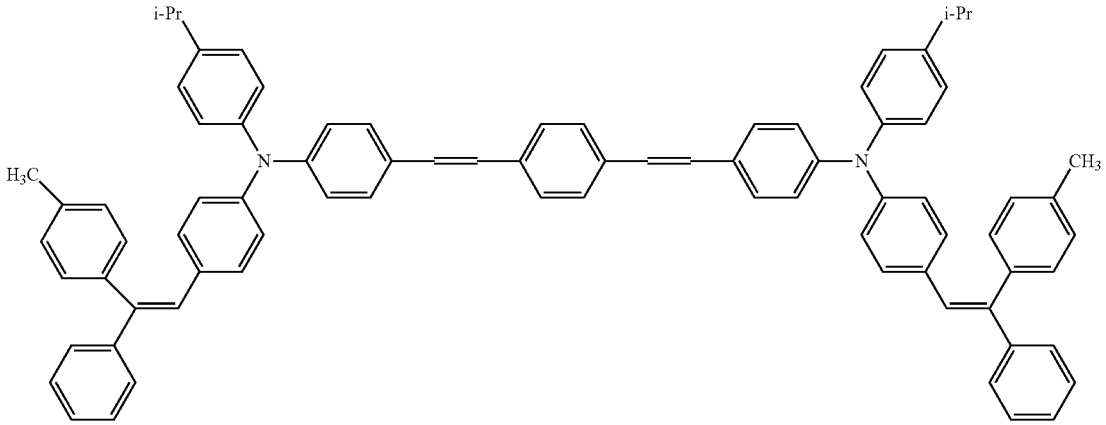

-continued
(1-27)
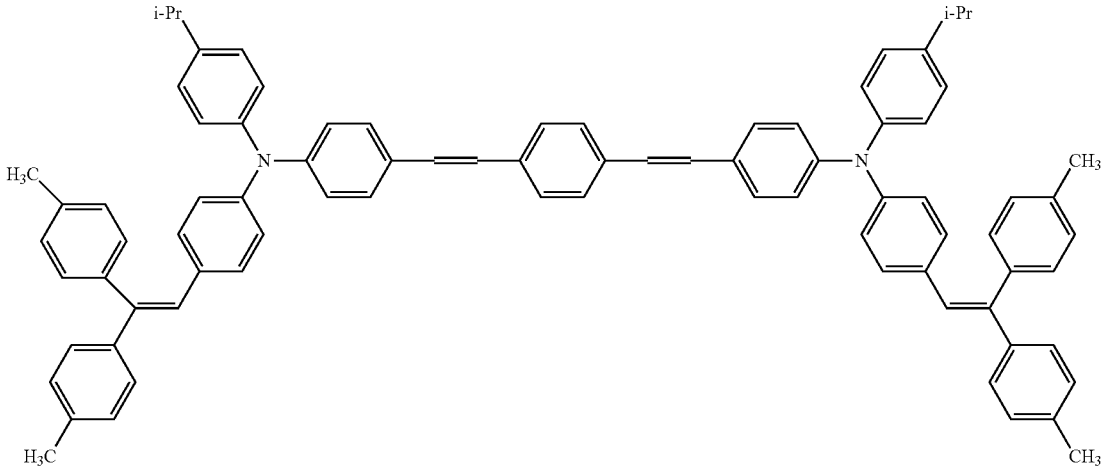
(1-28)
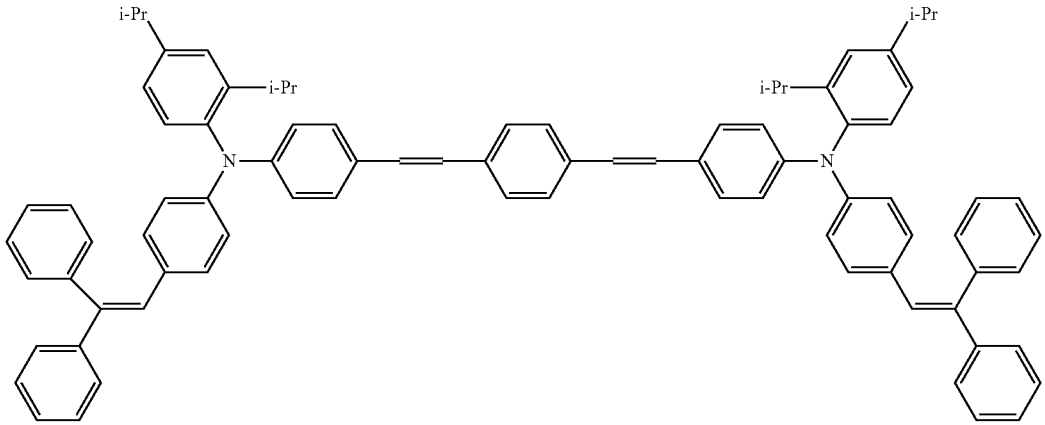
(1-29)
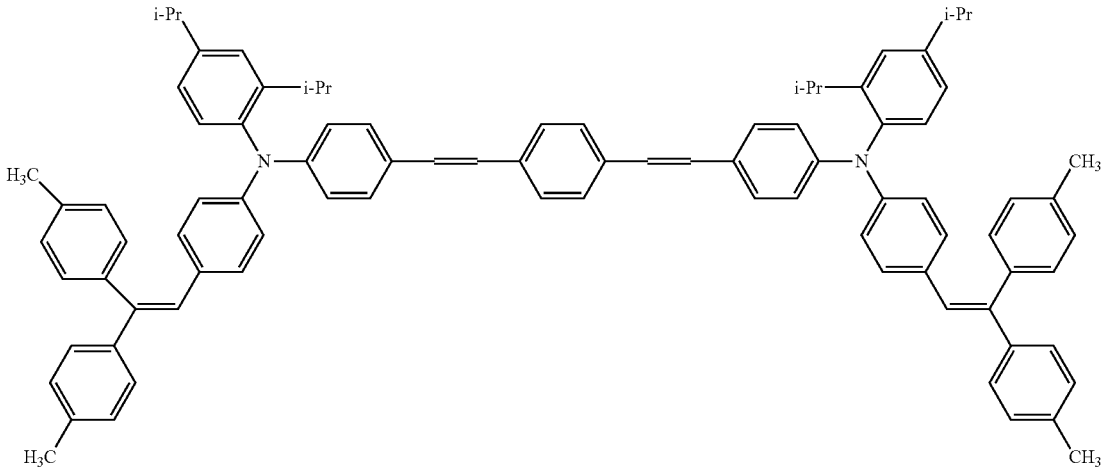

-continued
(1-30)
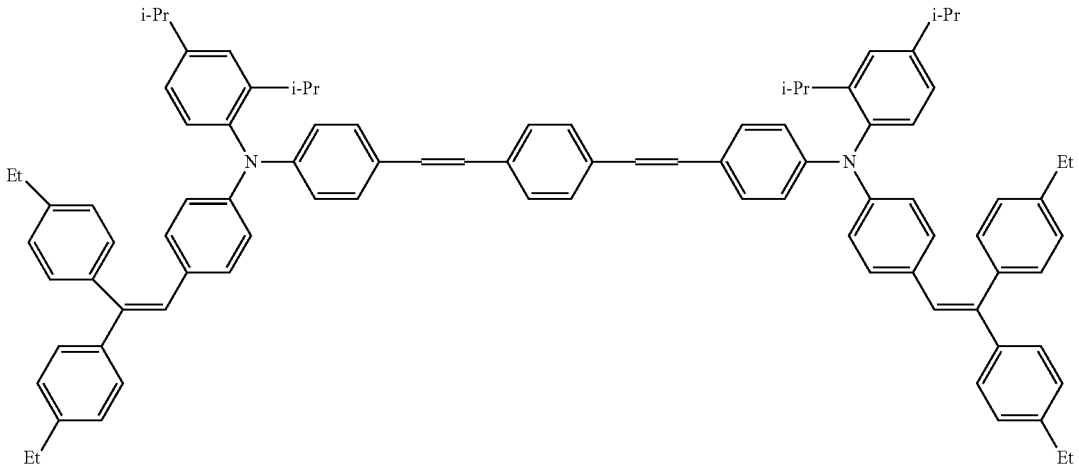
(1-31)
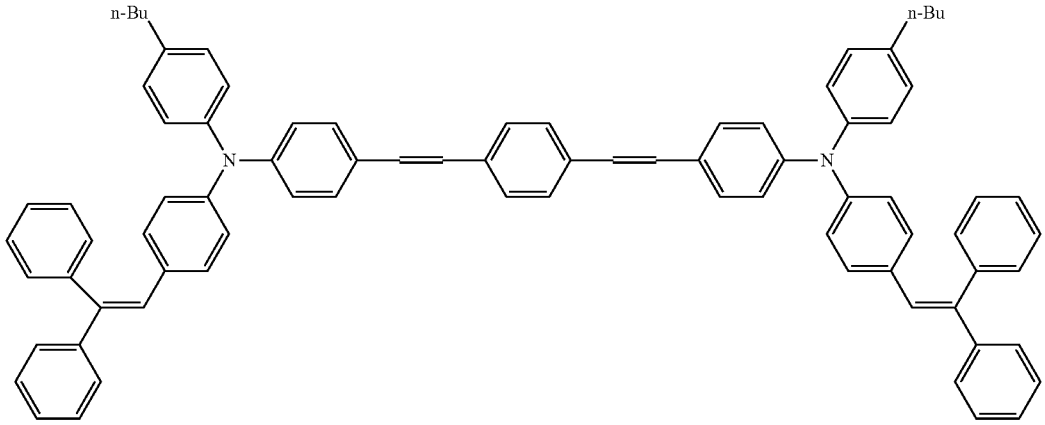
(1-32)
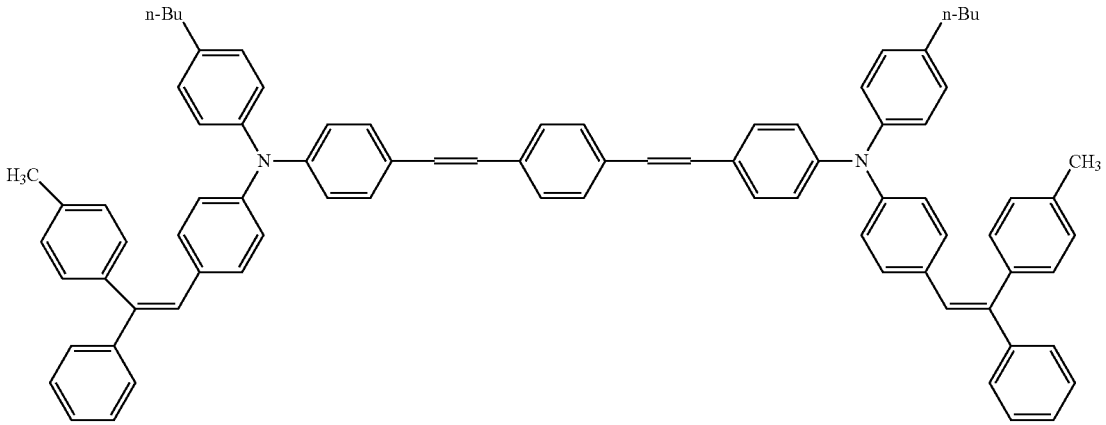

-continued
(1-33)
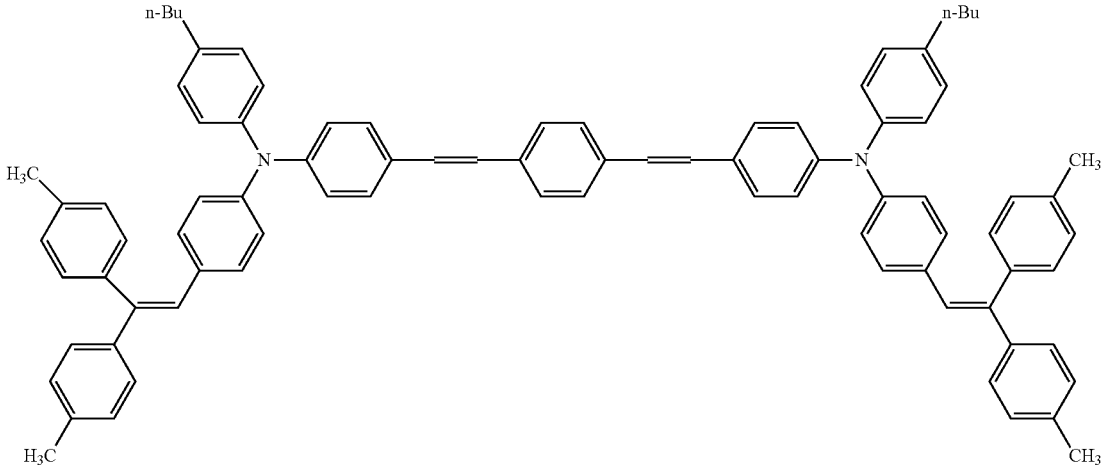
(1-34)
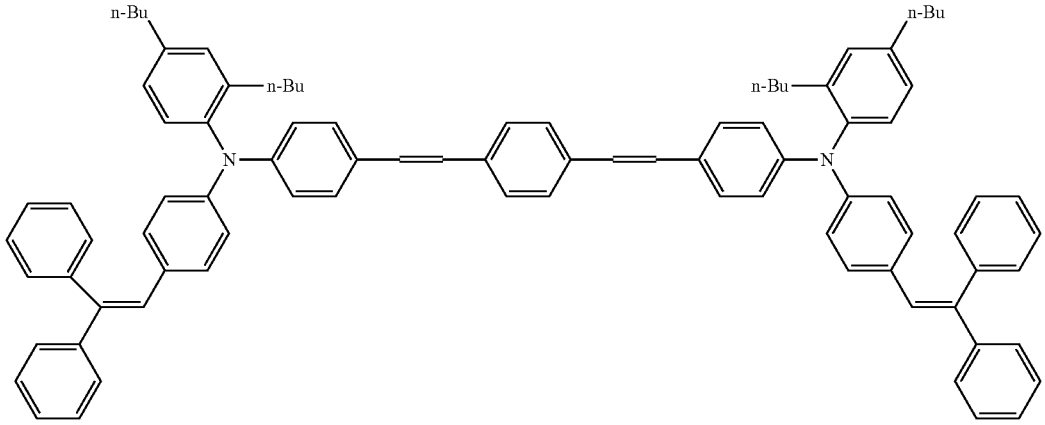
(1-35)
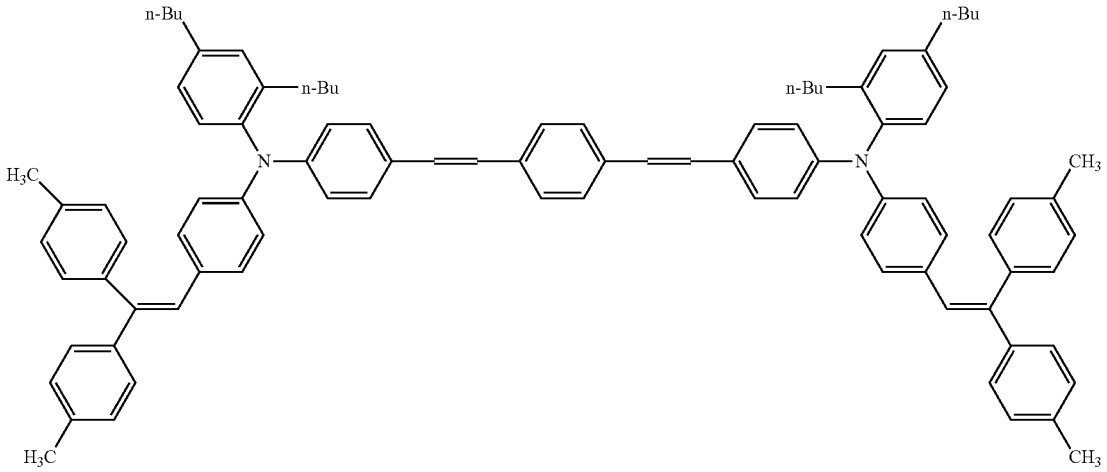

-continued
(1-36)
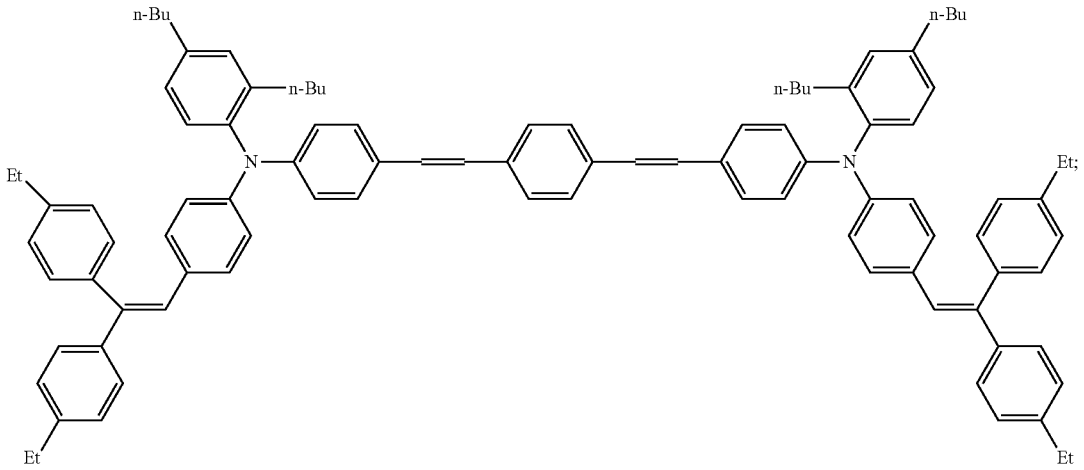
(1-37)
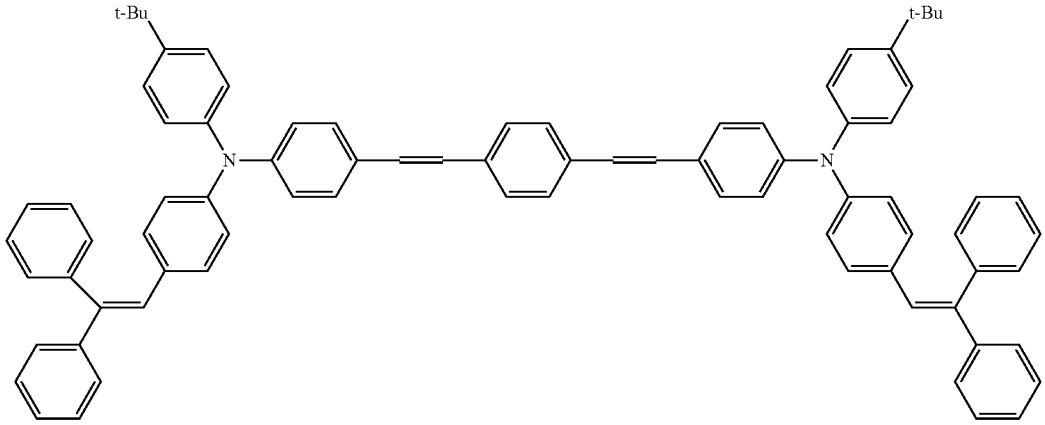
(1-38)
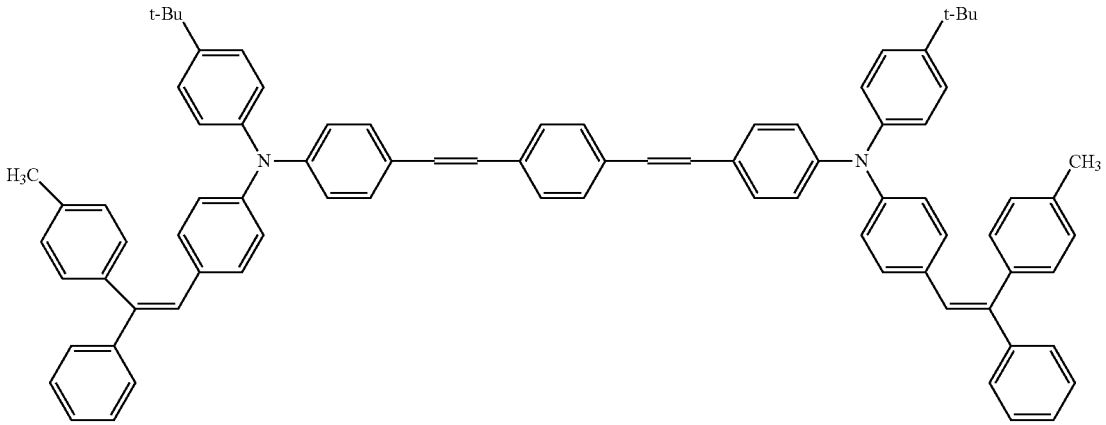

-continued
(1-39)
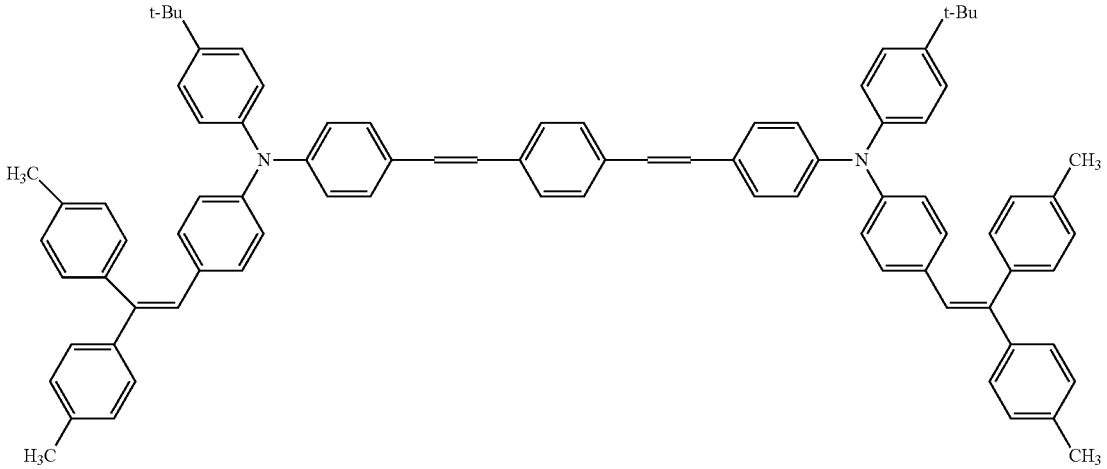
(1-40)
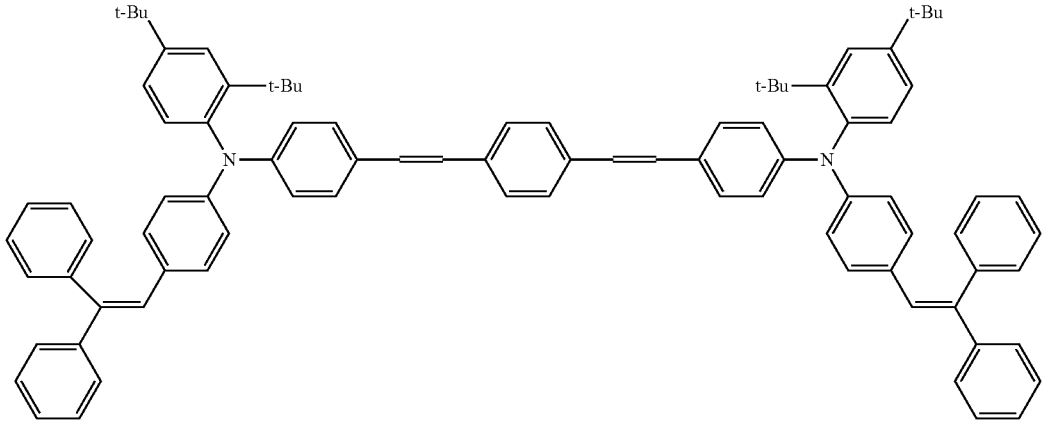
(1-41)
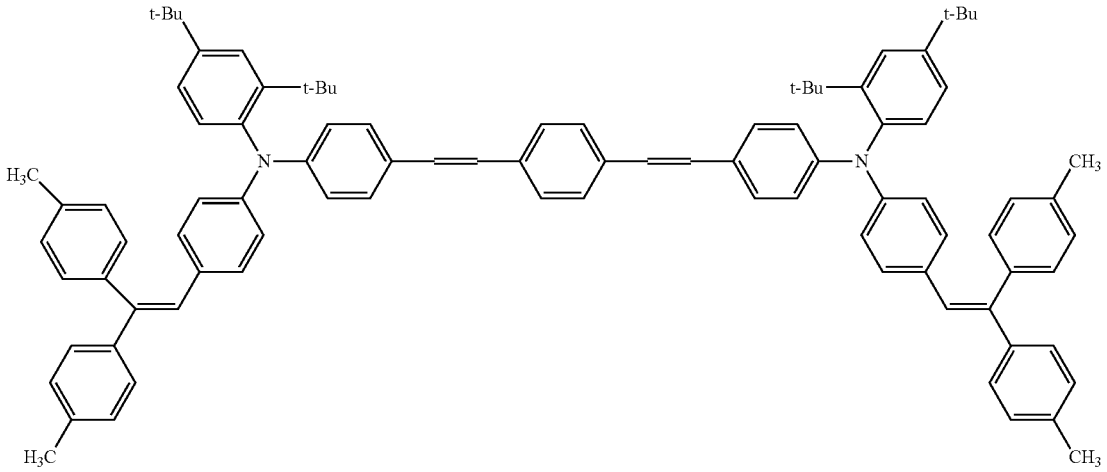

-continued
(1-42)
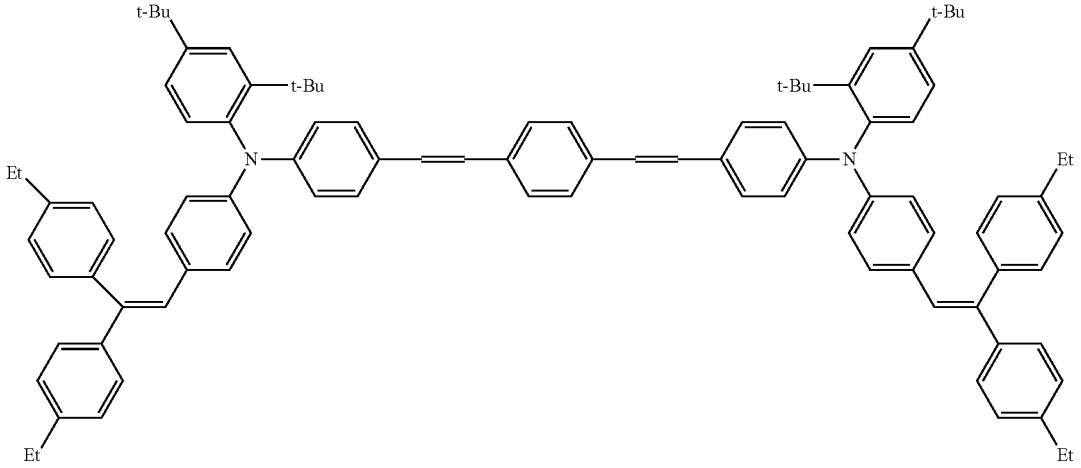
(1-43)
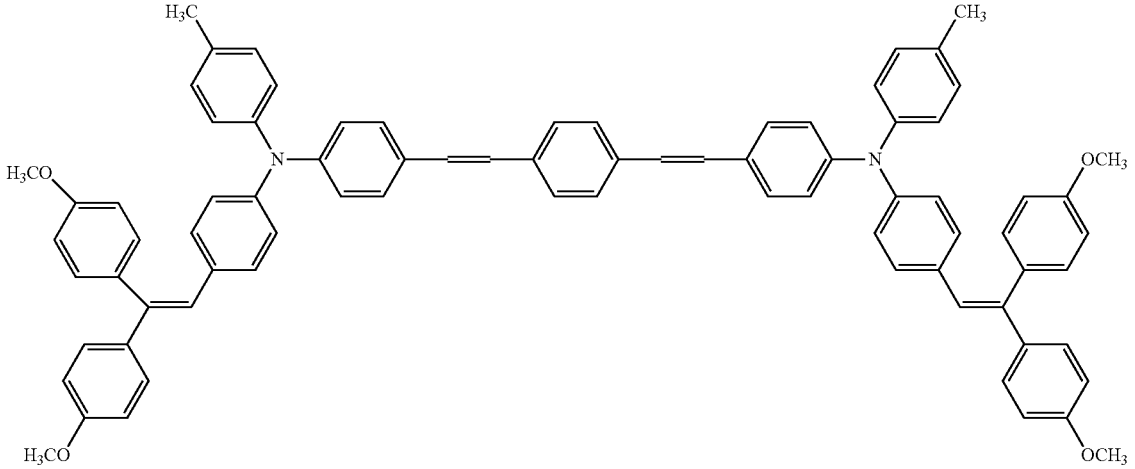
(1-44)
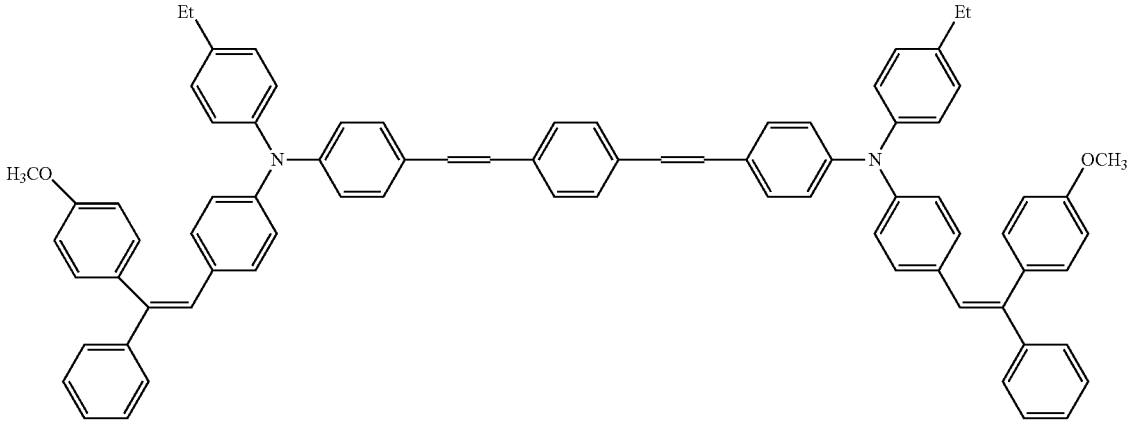

-continued
(1-45)
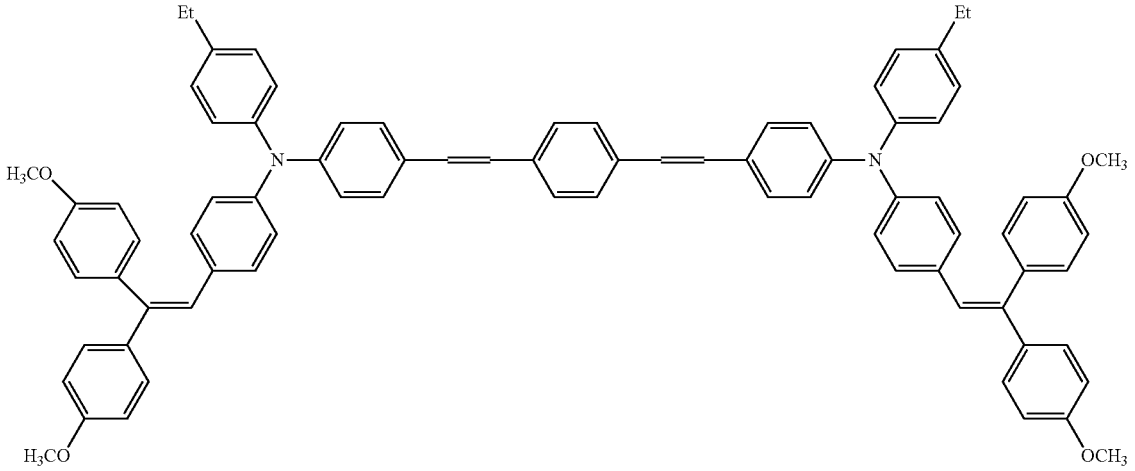
(1-46)
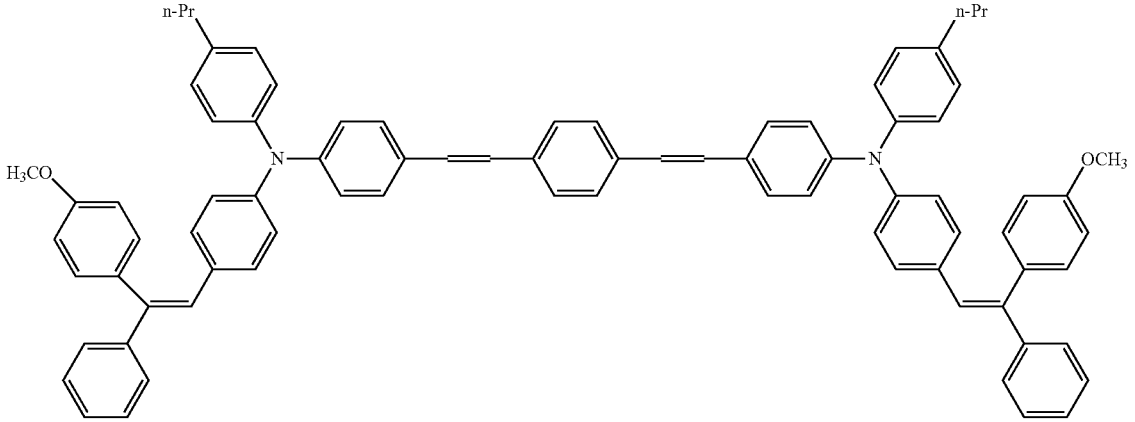
(1-47)
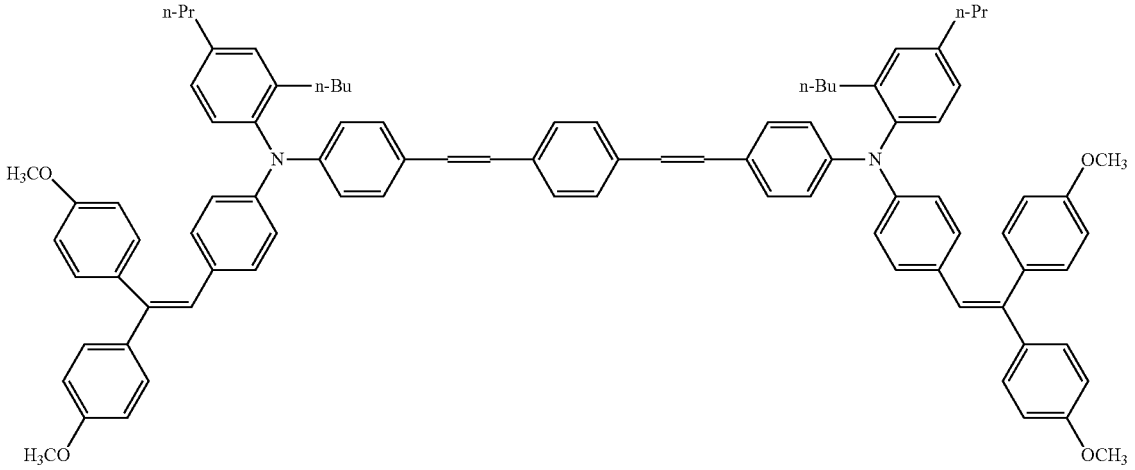

-continued
(1-48)
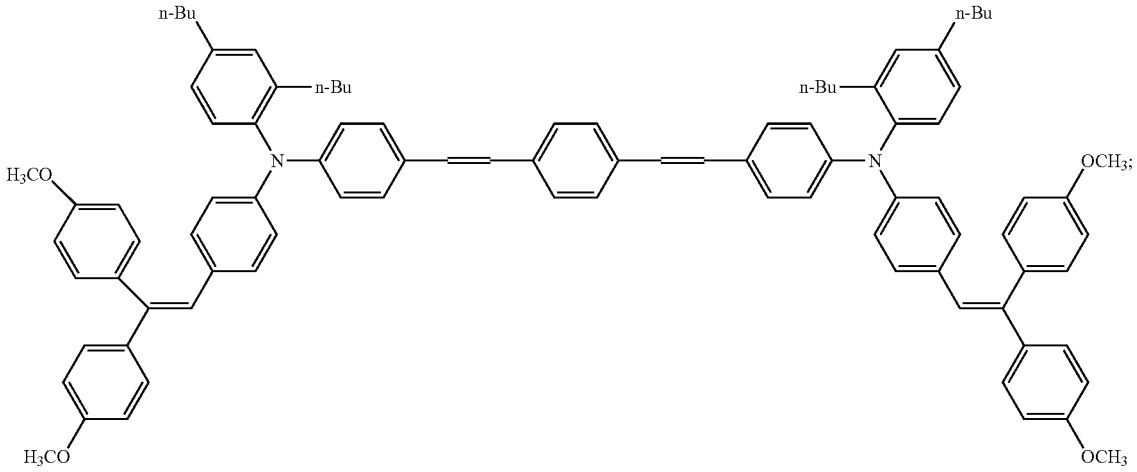
(1-49)
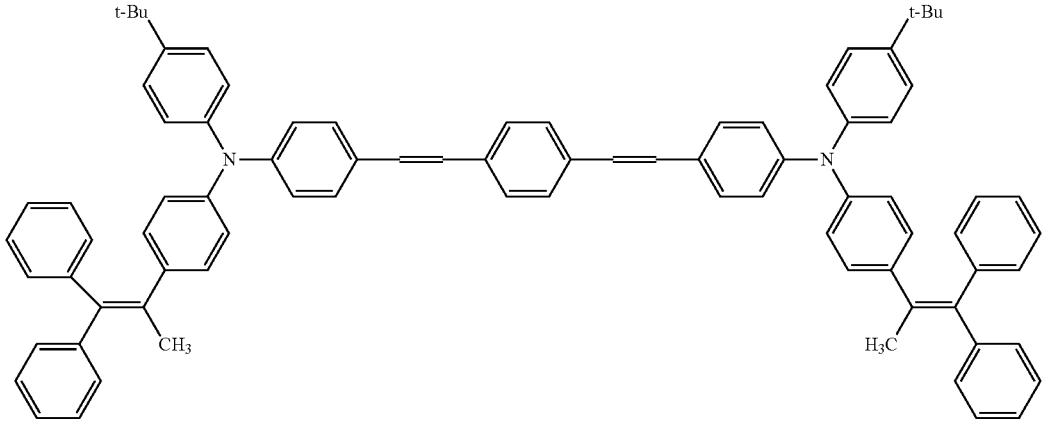
(1-50)
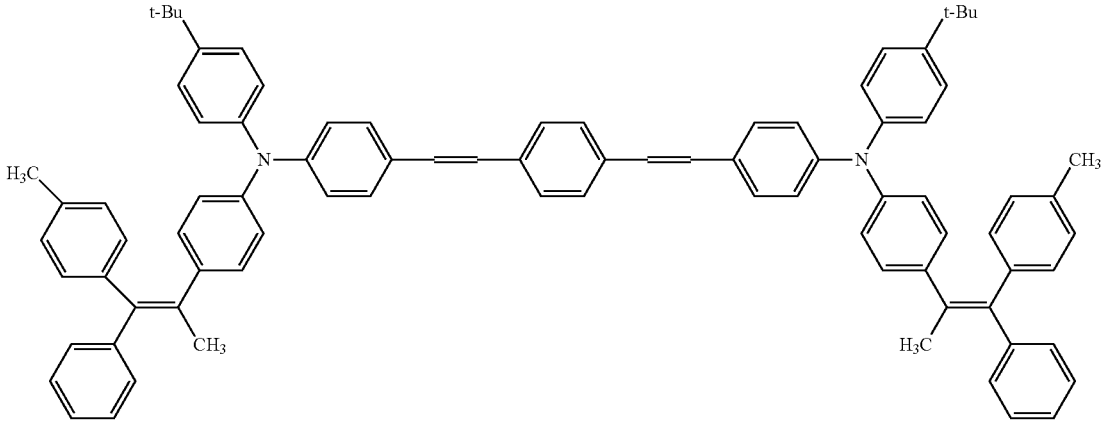

-continued
(1-51)
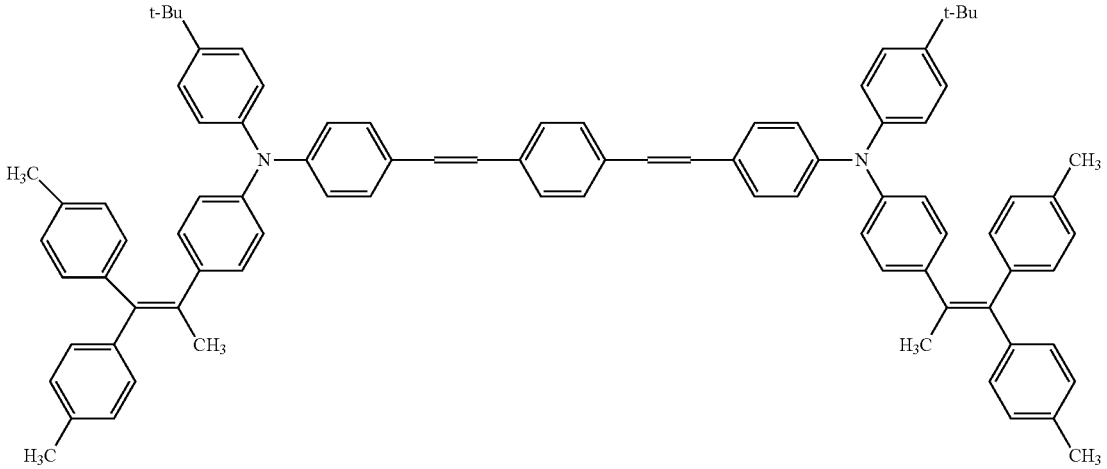
(1-52)
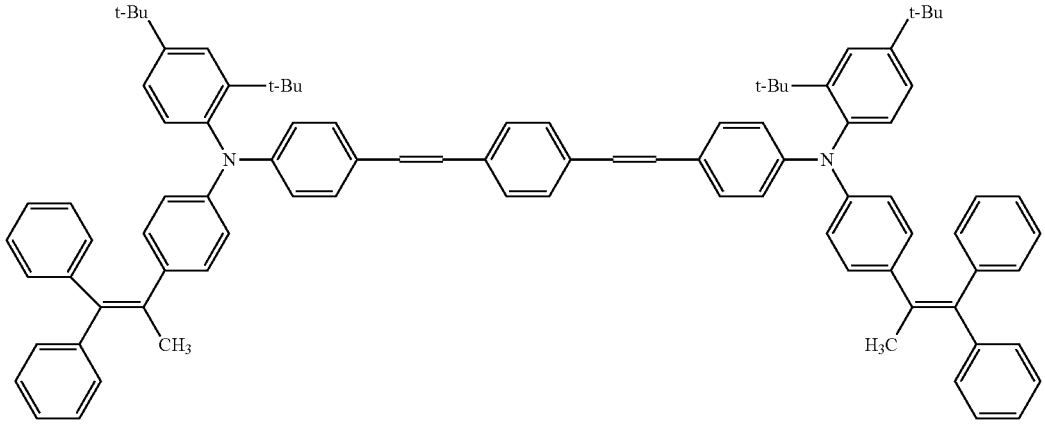
(1-53)
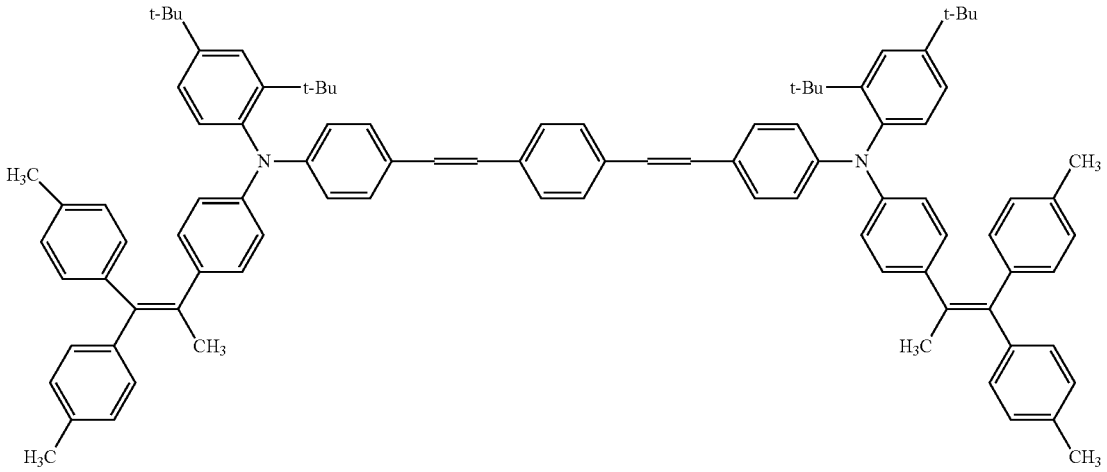

-continued
(1-54)
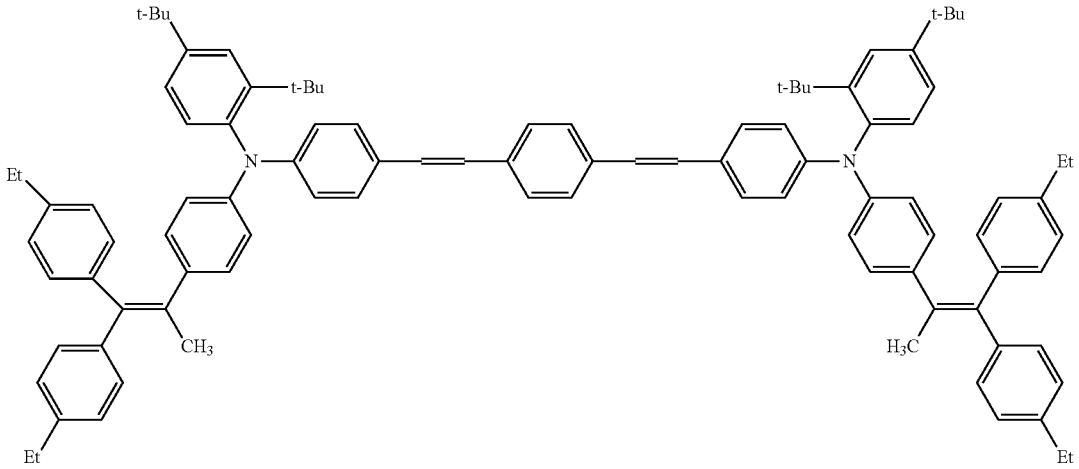
(1-55)
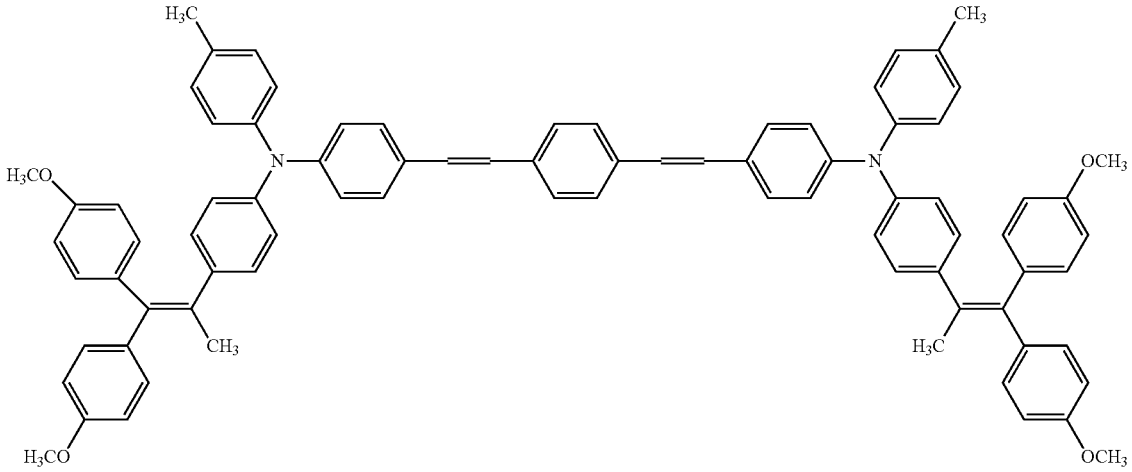
(1-56)
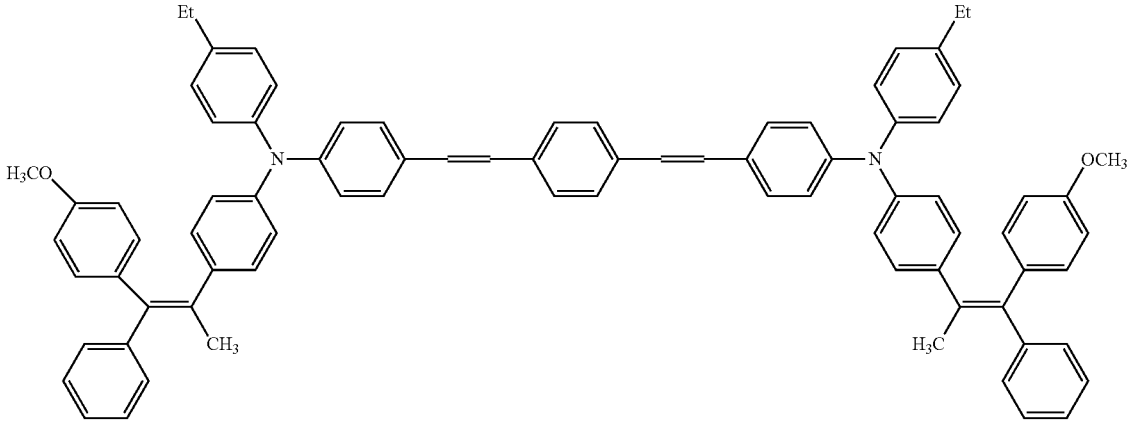

-continued
(1-57)
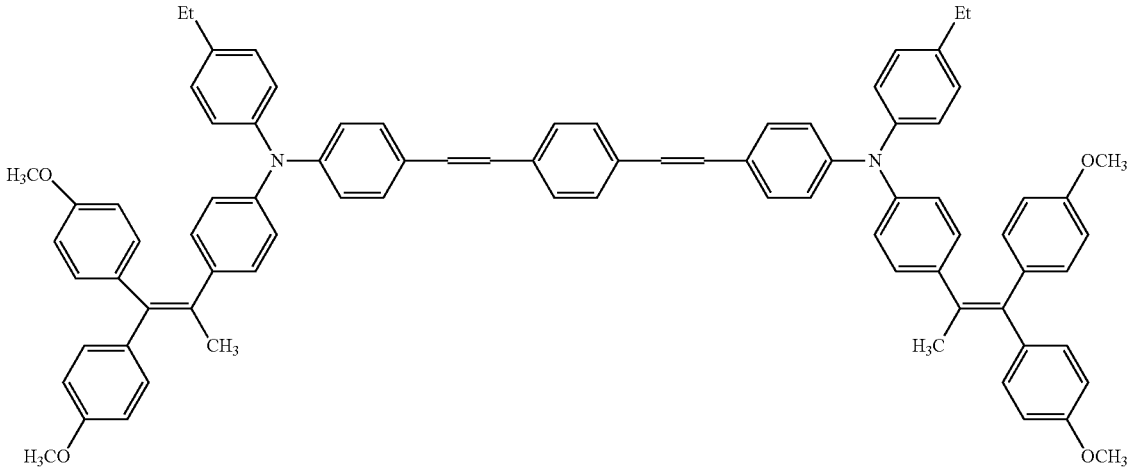
(1-58)
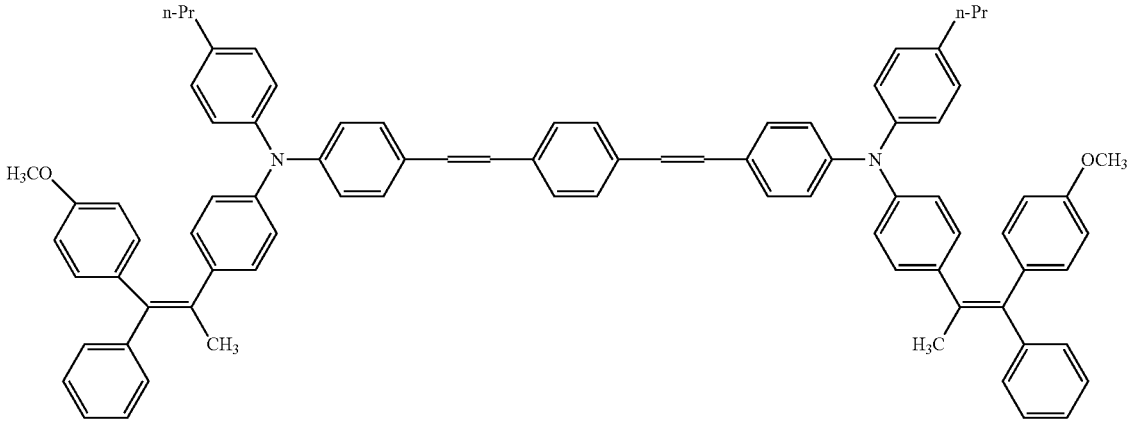
(1-59)
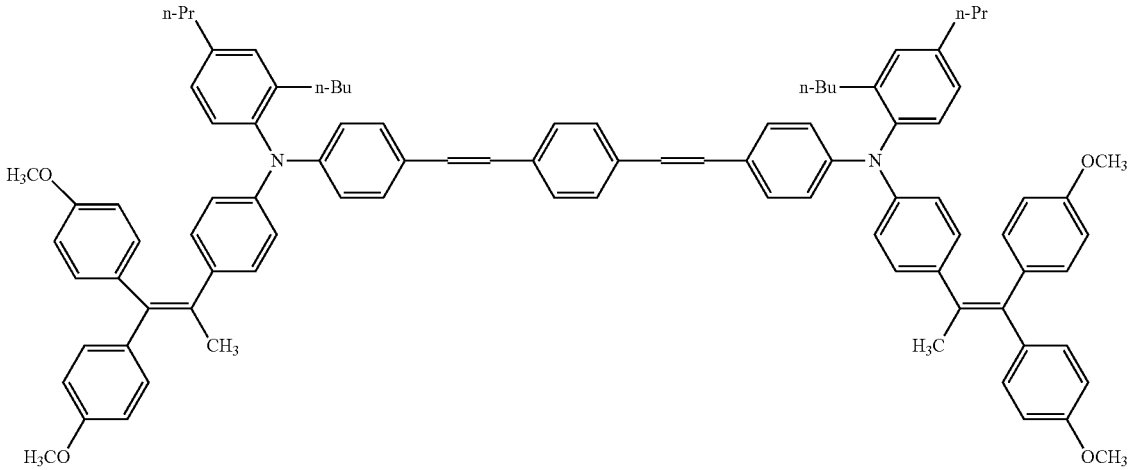

-continued
(1-60)
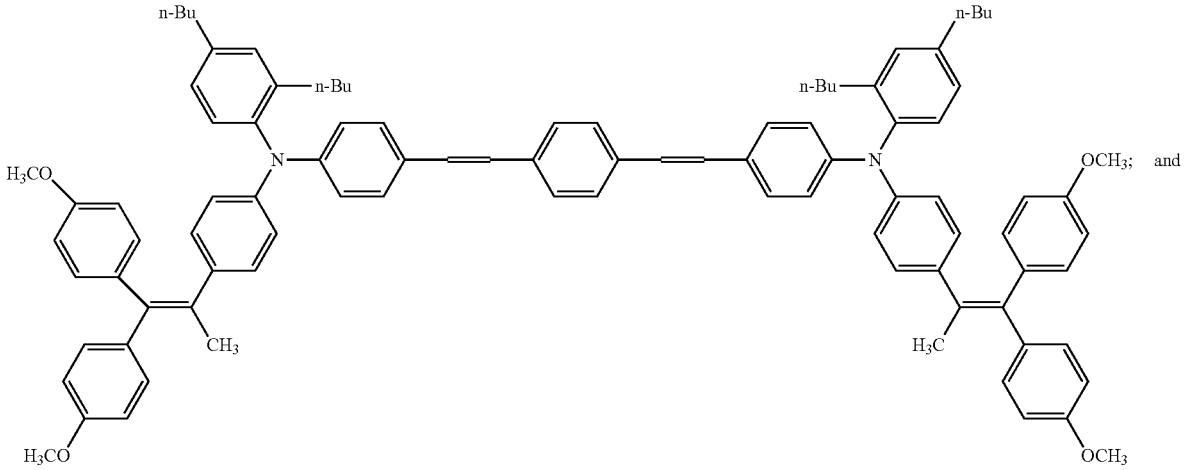
(1-61)
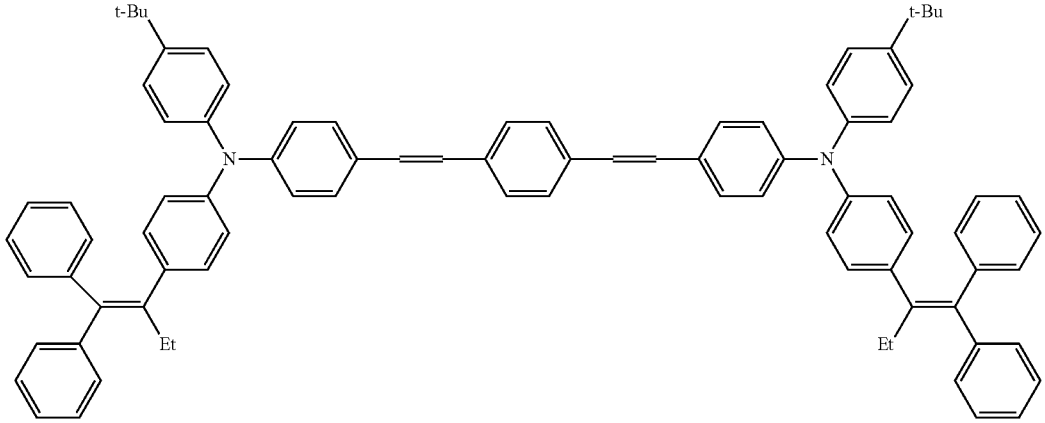
(1-62)
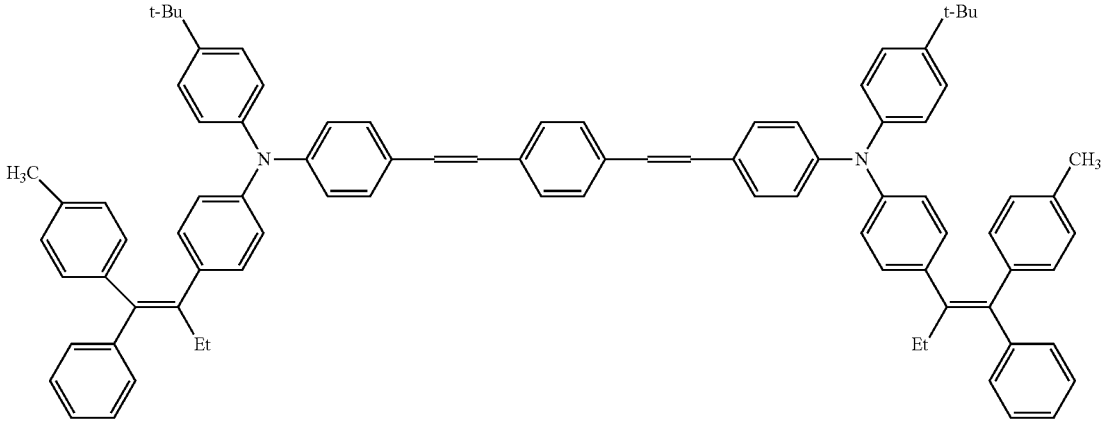

-continued
(1-63)
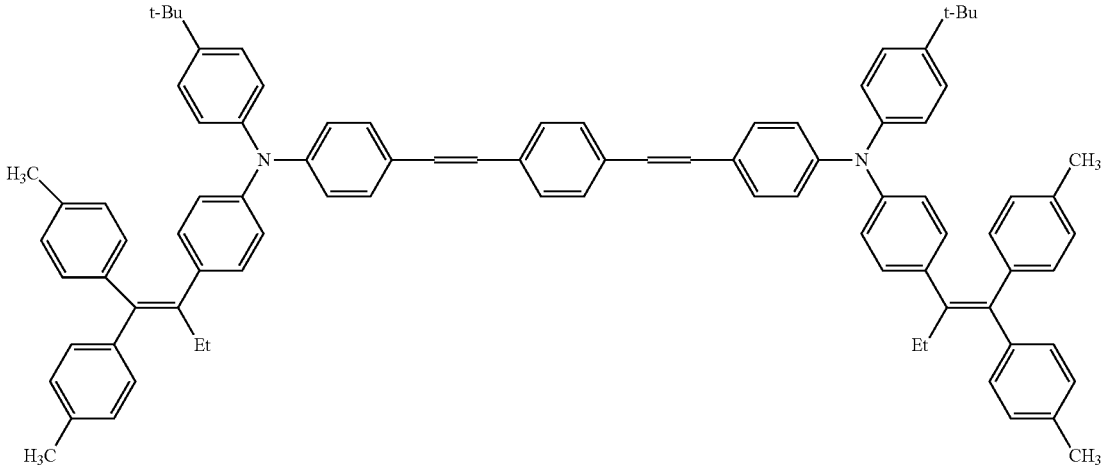
(1-64)
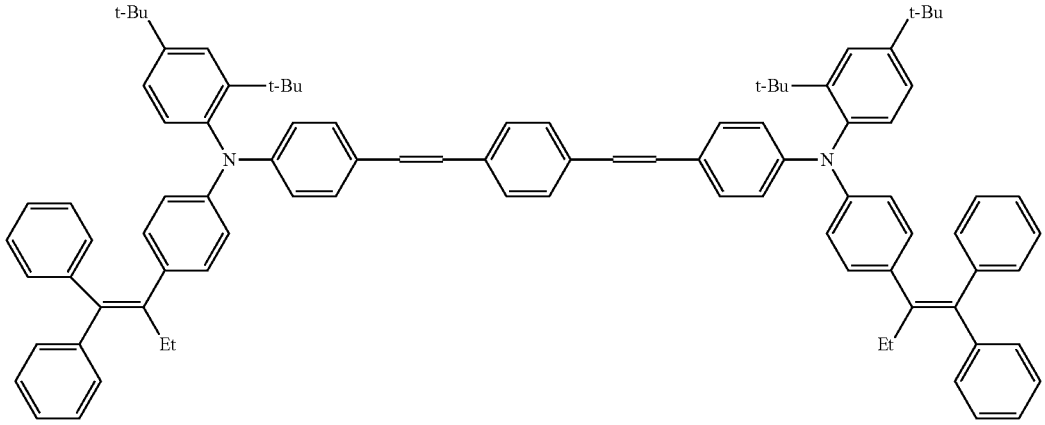
(1-65)
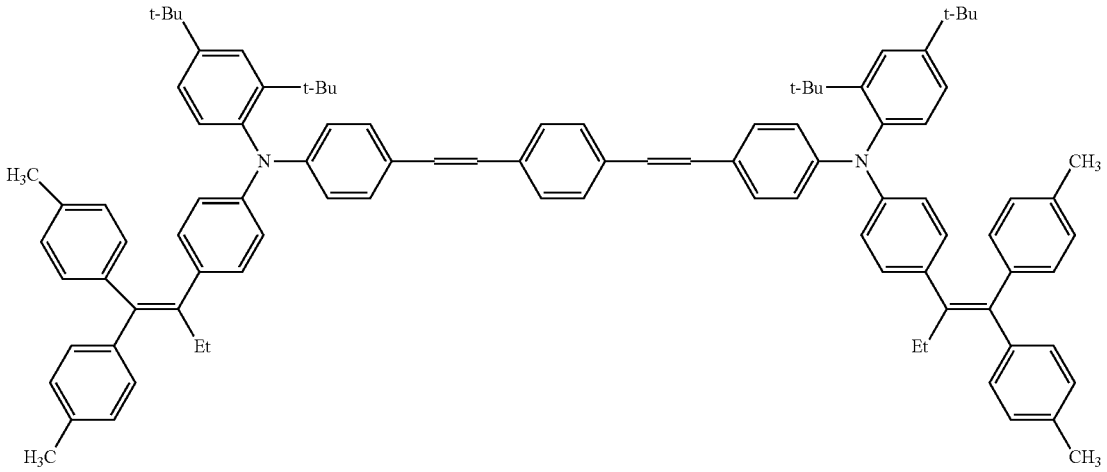

-continued
(1-66)
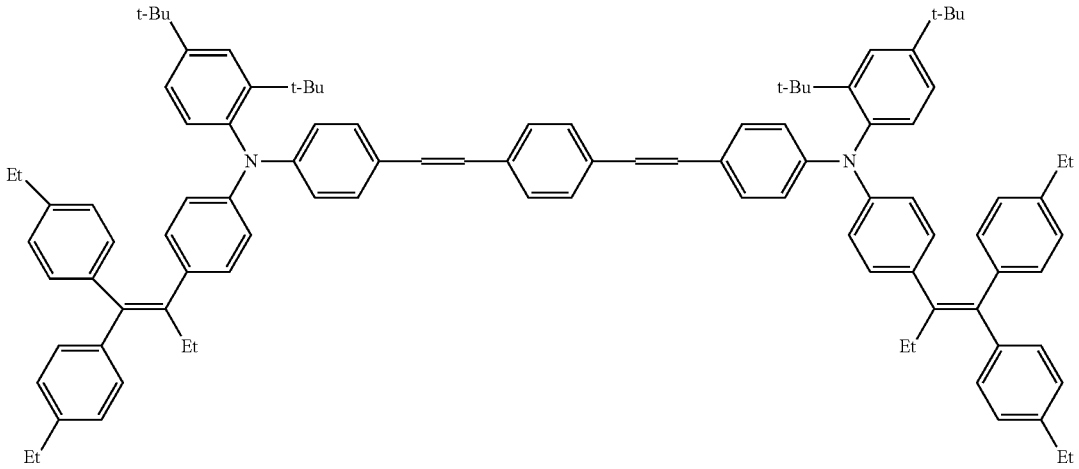
(1-67)
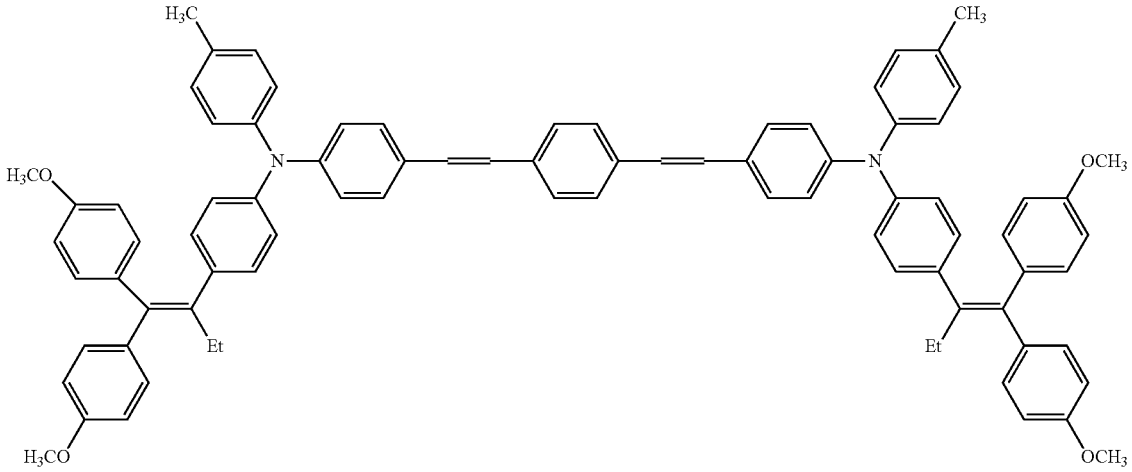
(1-68)
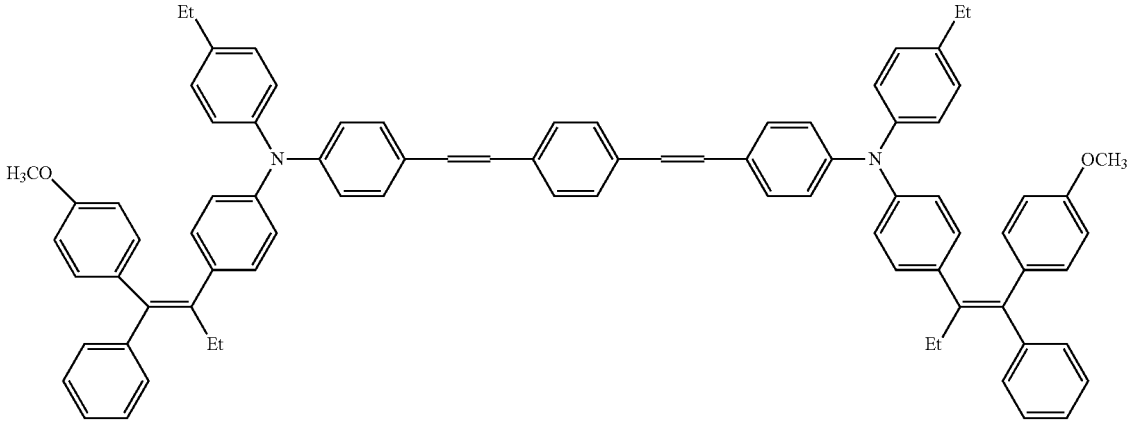

-continued
(1-69)
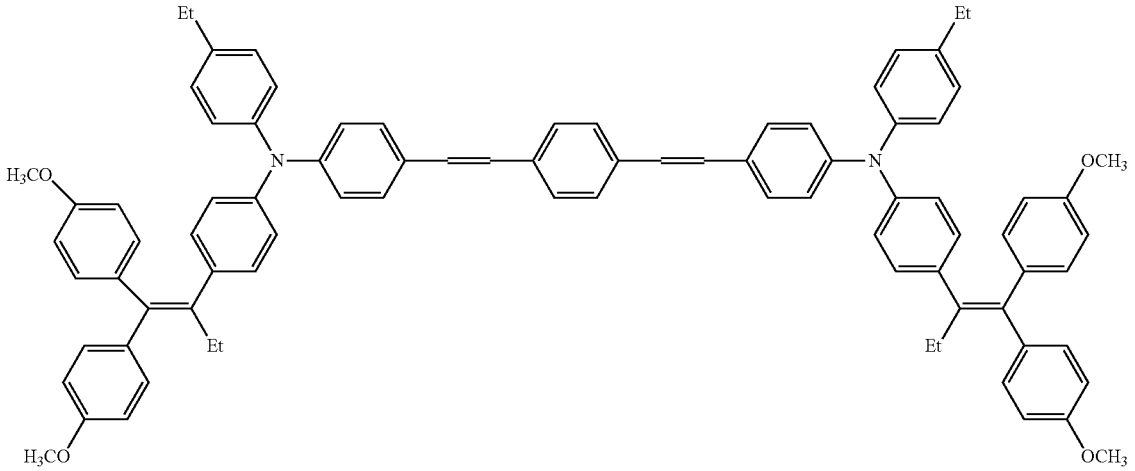
(1-70)
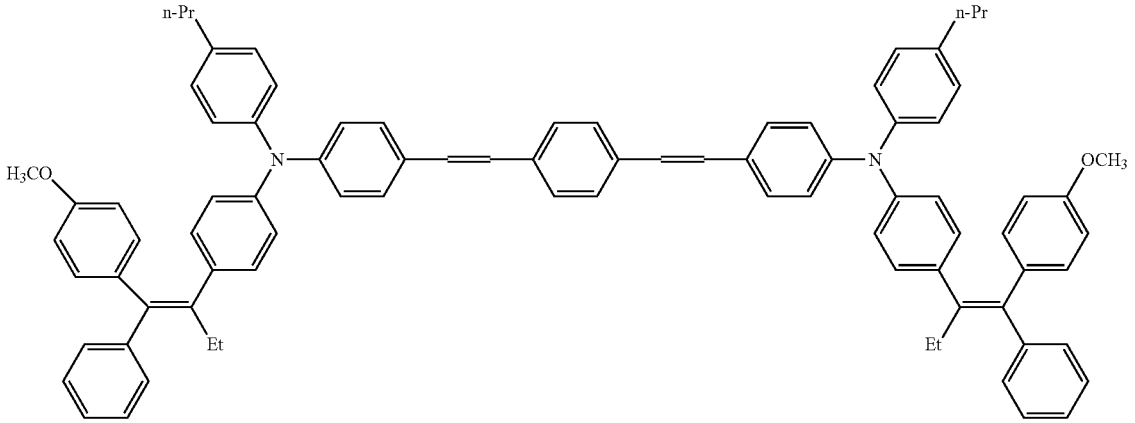
(1-71)
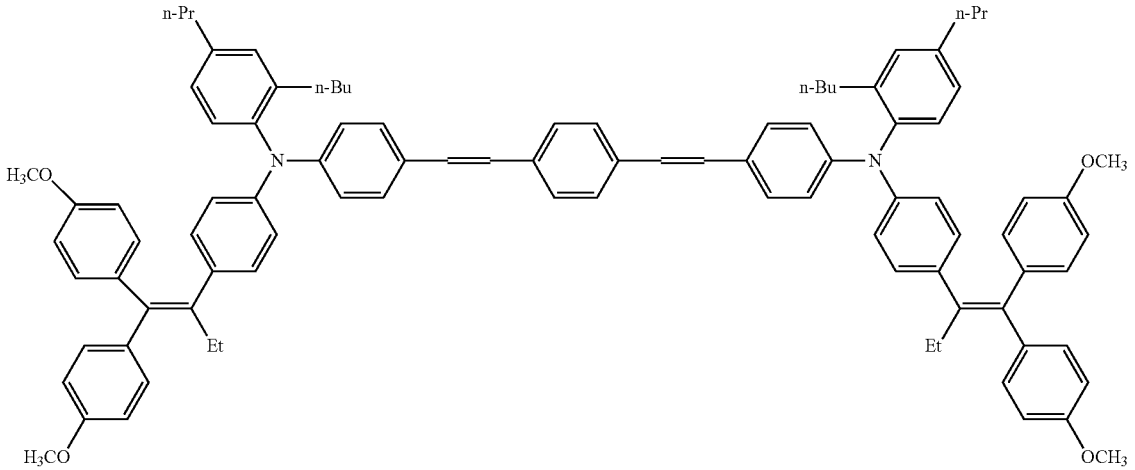

-continued (1-72)

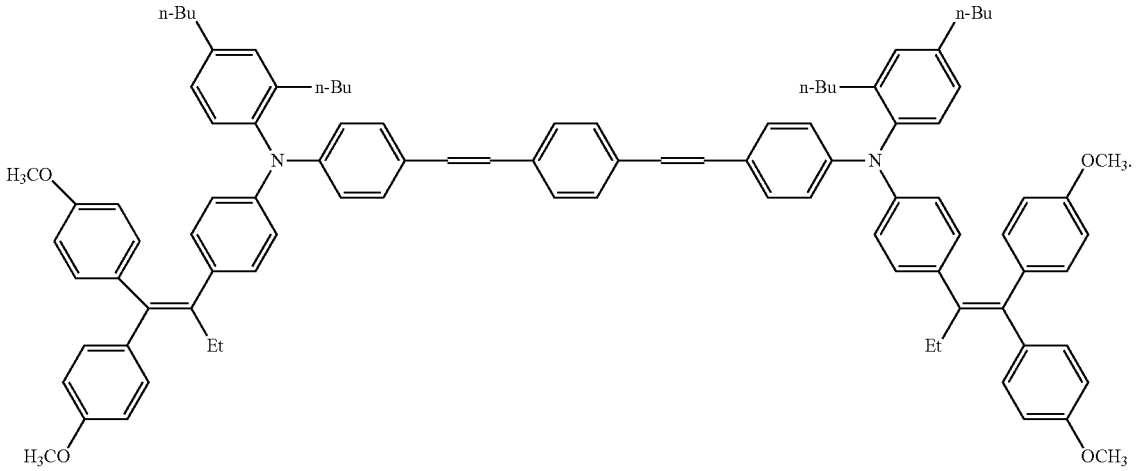

The hole transport material to be used preferably has high mobility, specifically a hole mobility (when the electric field strength is 20 V/μm) of $40\times10^{-6}$ to $120\times10^{-6}$ $cm^2/V\cdot s$, particularly $60\times10^{-6}$ to $120\times10^{-6}$ $cm^2/V\cdot s$, more particularly $70\times10^{-6}$ to $120\times10^{-6}$ $cm^2/V\cdot s$. In the structure represented by the general formula (1), a hole transport material in which a substituent is bonded in a meta position or para position to a benzene ring having $R_1$ is preferable.

The hole mobility can be measured using a coating liquid obtained by adding the hole transport material to the binder resin so that the content of the hole transport material becomes 50% by mass. The ratio of the hole transport material to the binder resin is 50:50. The binder resin may be a bisphenol Z-polycarbonate resin. For example, Iupizeta PCZ-500 (product name, Mitsubishi Gas Chemical) may be used. Specifically, this coating liquid is applied on a substrate and dried at 120° C. for 30 minutes to prepare a coated film having a thickness of 7 μm. Then, using a TOF (Time of Flight) method, the hole mobility can be measured at a constant electric field strength of 20 V/μm. The measurement temperature is 300 K.

Specific examples of the resin having the repeating structure represented by the above general formula (2) as a binder resin are as below, but not limited thereto, and among them, those in which $R_{12}$ and $R_{13}$ are a hydrogen atom and $R_{14}$ and $R_{15}$ are a methyl group (where k=1, p=1) are preferably used because they improve the wear resistance:

(2-1)

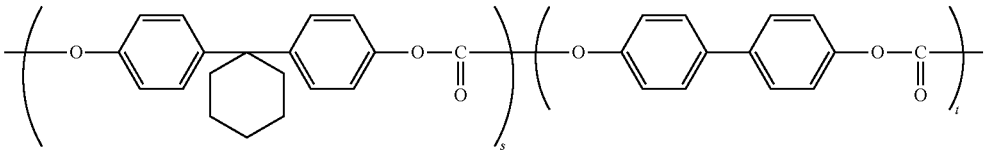

(2-2)

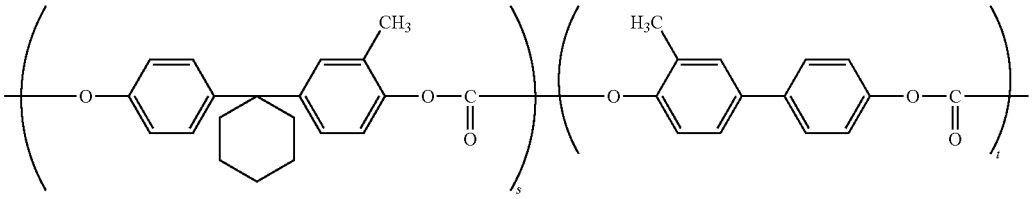

(2-3)

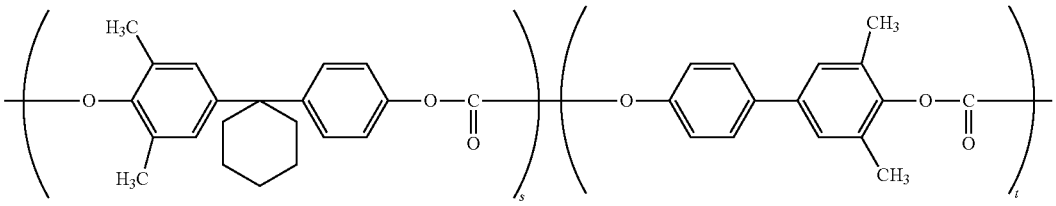

-continued
(2-4)
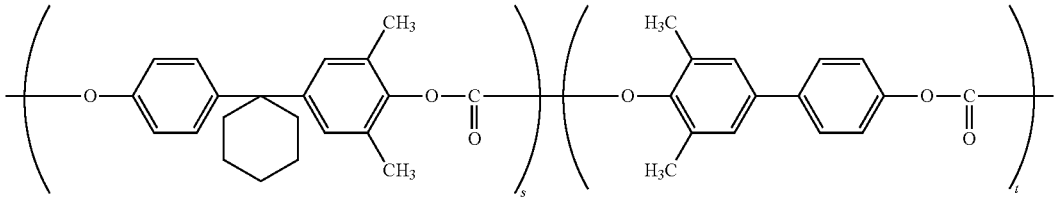
(2-5)
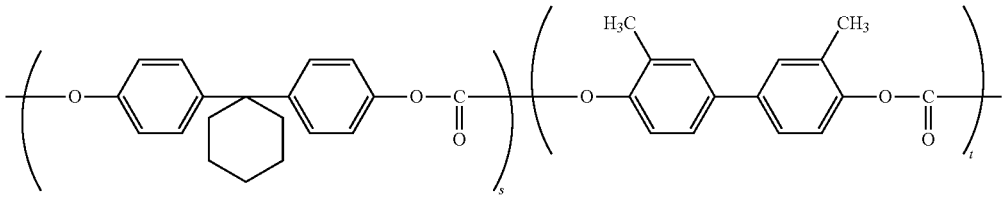
(2-6)
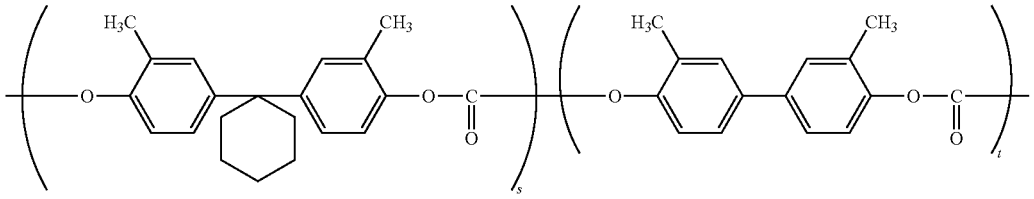
(2-7)
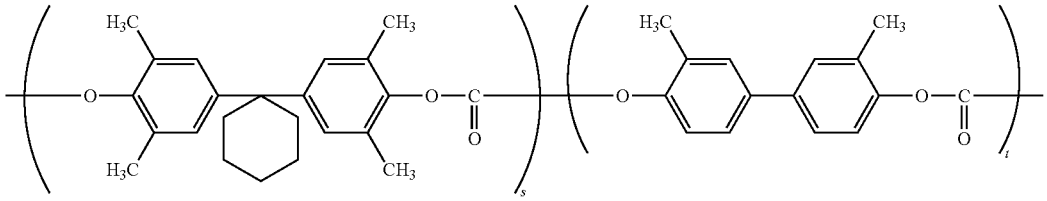
(2-8)
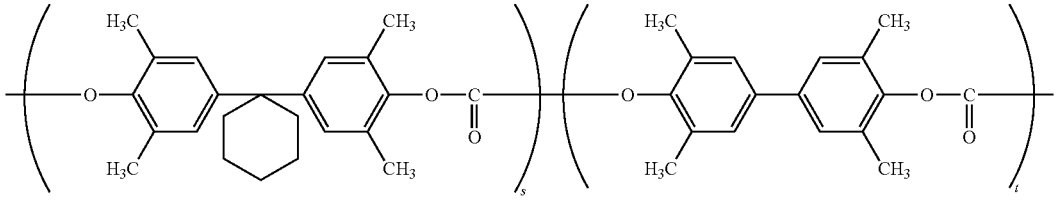
; and
(2-9)
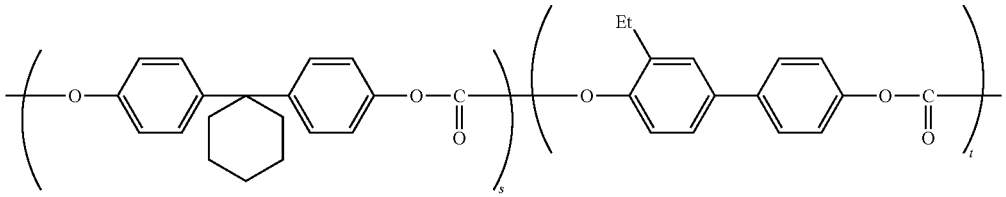
(2-10)
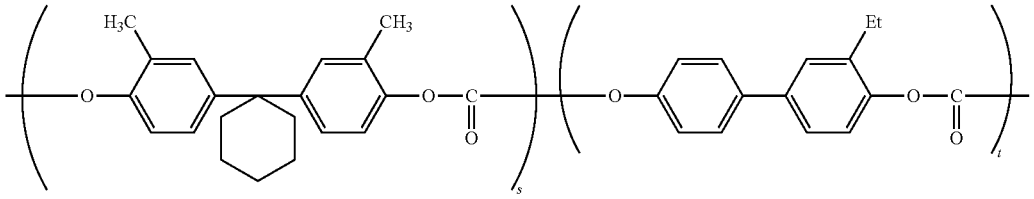

-continued (2-11)

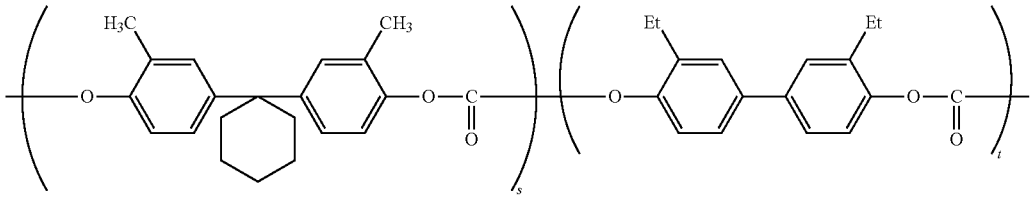

(2-12)

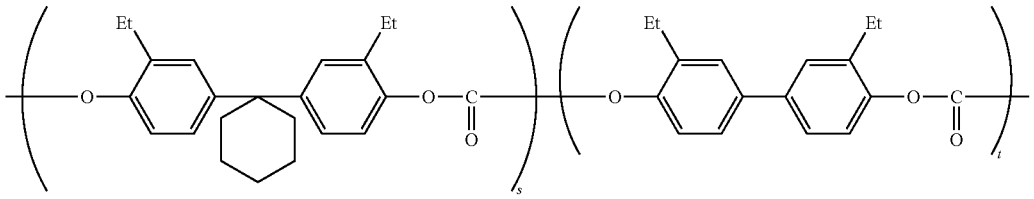

(2-13)

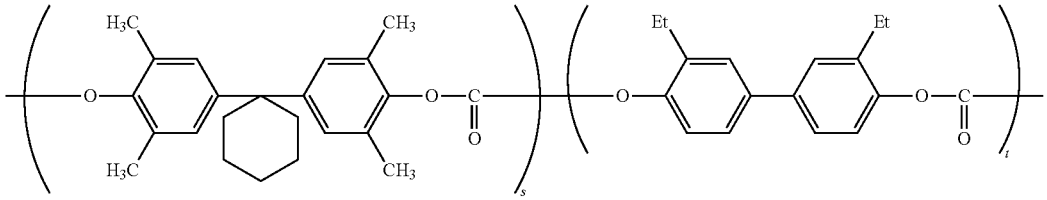

(2-14)

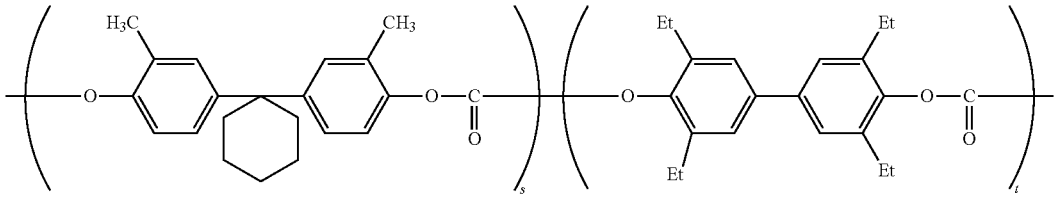

(2-15)

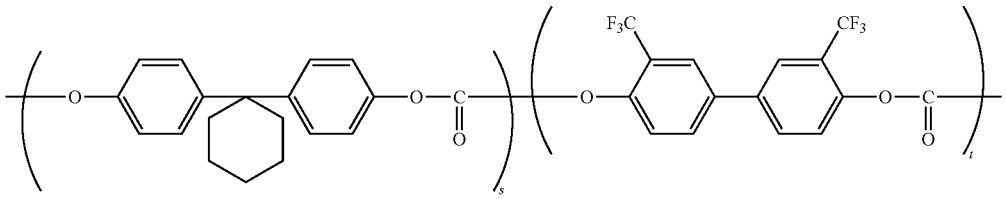

(2-16)

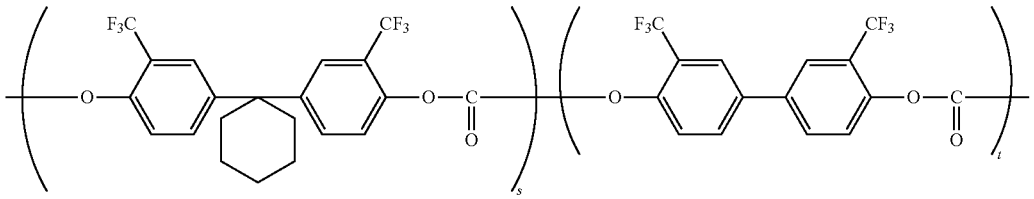

(2-17)

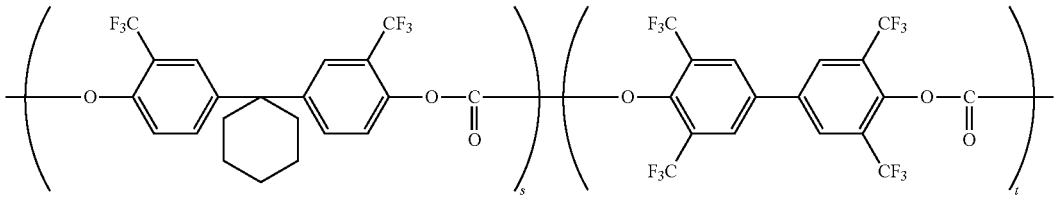

The ratio of s and t preferably satisfies $0.3 \leq t/(s+t) \leq 0.7$, and the chain end group preferably is a monovalent aromatic group or a monovalent fluorine-containing aliphatic group. In the case of $t/(s+t) \geq 0.3$, good wear resistance and good contamination resistance can be both achieved, whereas in the case of $t/(s+t) \leq 0.7$, the resin can be easily synthesized.

Specific examples of the compound having the structure represented by the above general formula (ET1) as an electron transport material include, but are not limited to, the following:
(ET1-1)
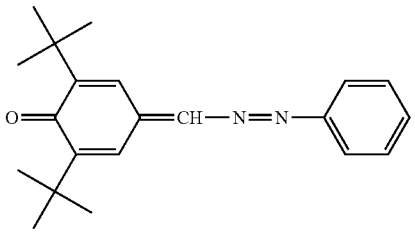
(ET1-2)
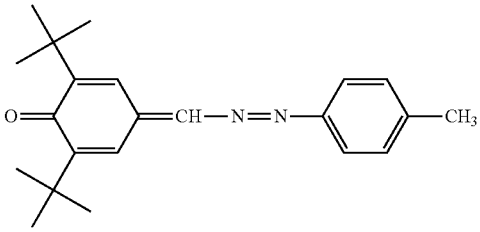
(ET1-3)
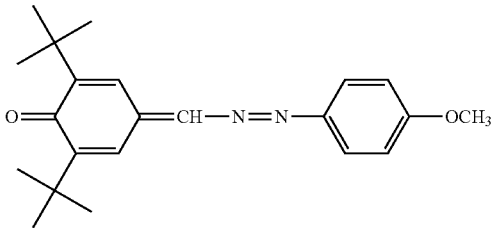
(ET1-4)
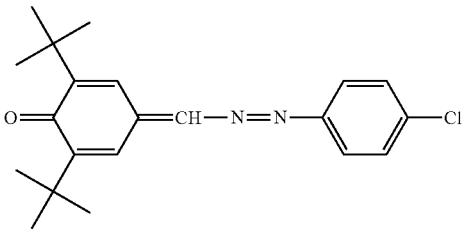
(ET1-5)
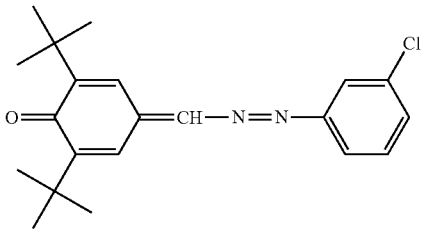
(ET1-6)
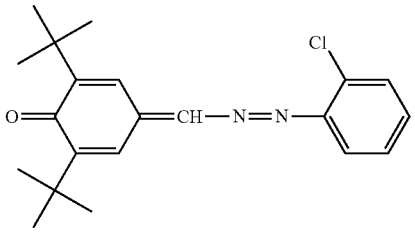
-continued
(ET1-7)
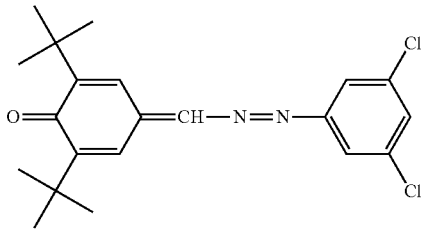
(ET1-8)
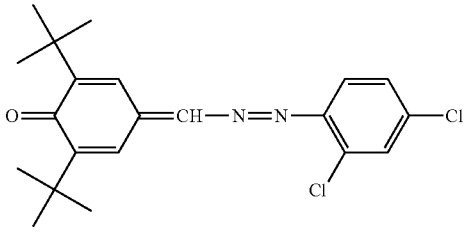
(ET1-9)
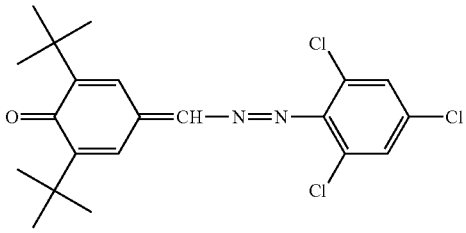
(ET1-10)
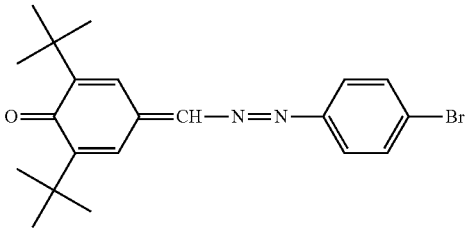
(ET1-11)
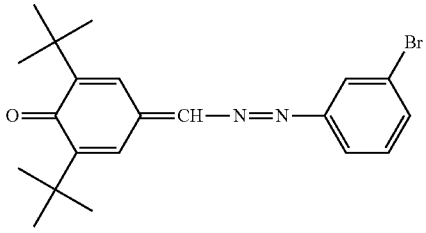
(ET1-12)
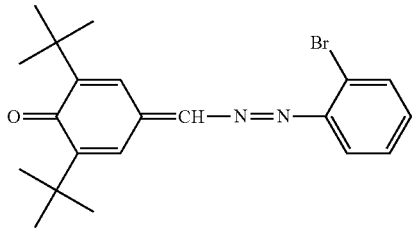

-continued
(ET1-13)
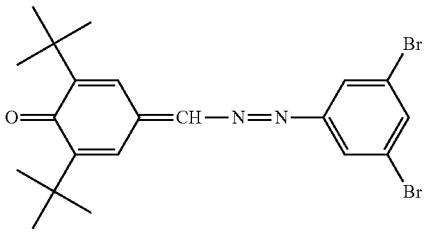
(ET1-14)
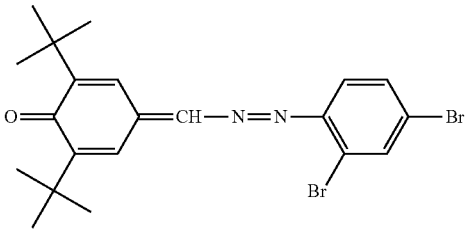
(ET1-15)
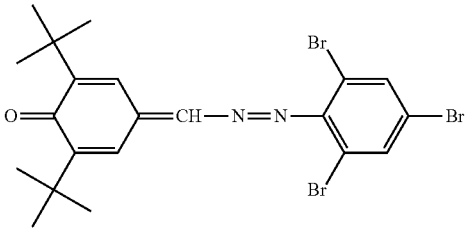
(ET1-16)
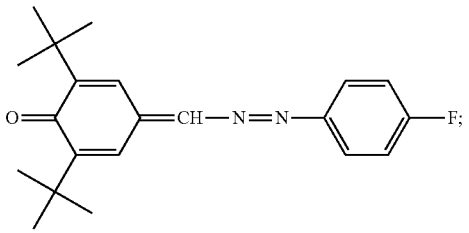
(ET1-17)
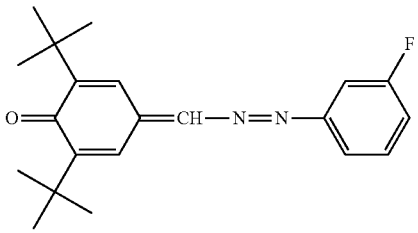
(ET1-18)
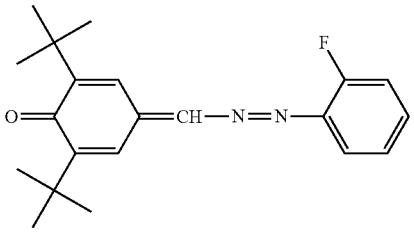
-continued
(ET1-19)
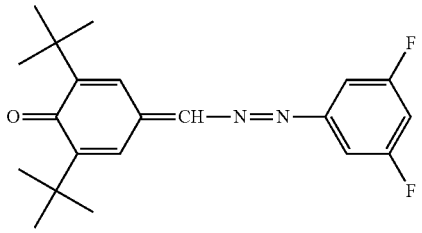
(ET1-20)
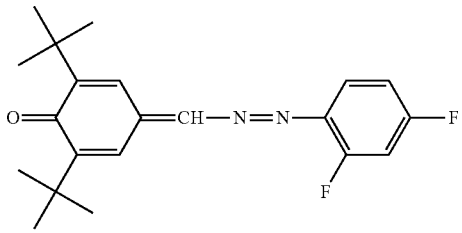
(ET1-21)
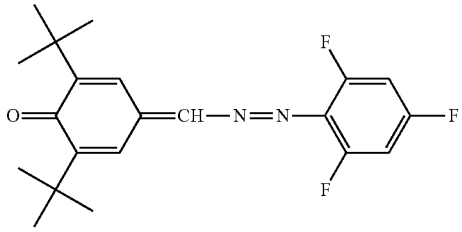
(ET1-22)
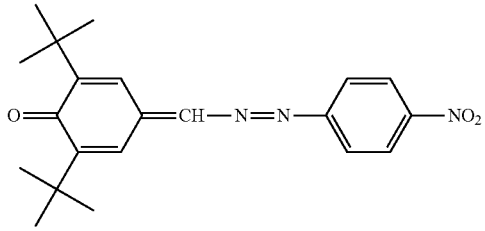
(ET1-23)
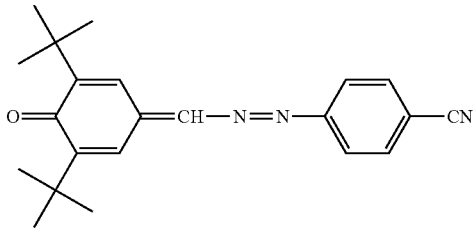
(ET1-24)
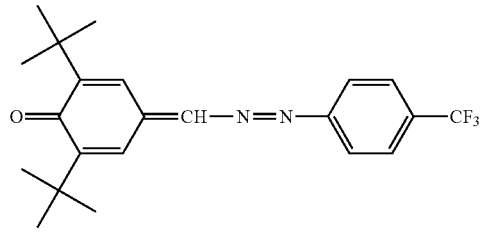

-continued
(ET1-25)
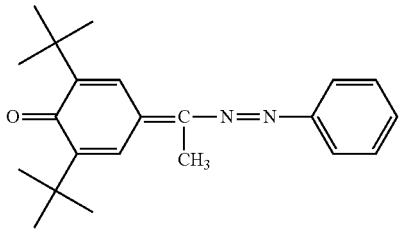
(ET1-26)
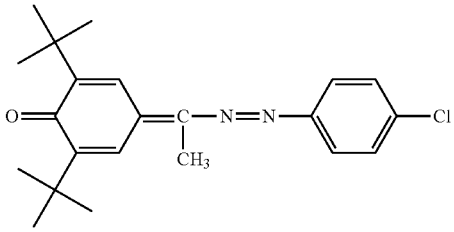
(ET1-27)
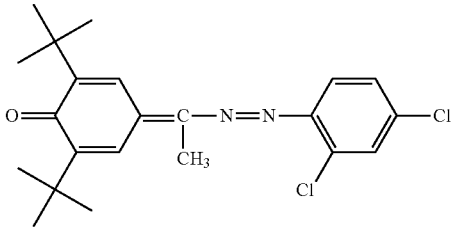
(ET1-28)
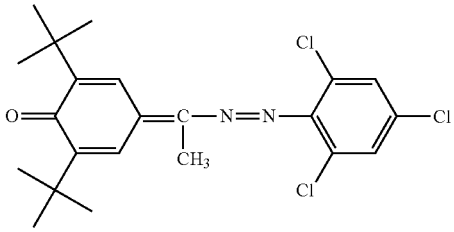
(ET1-29)
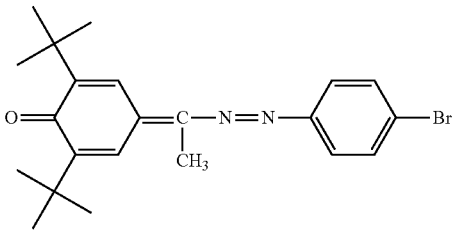
(ET1-30)
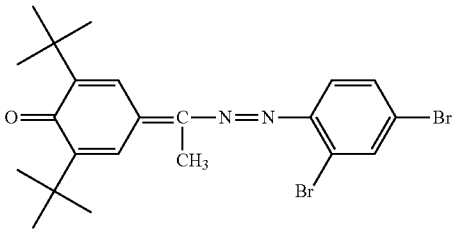
-continued
(ET1-31)
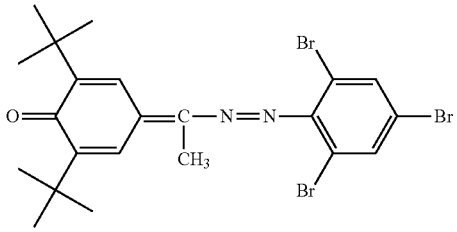
(ET1-32)
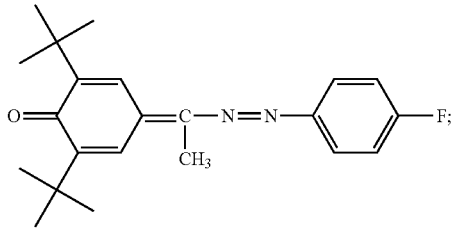
(ET1-33)
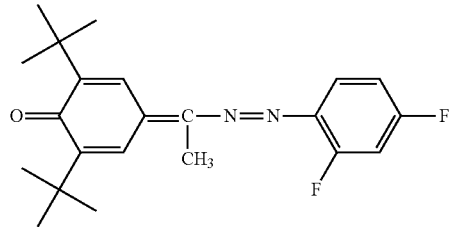
(ET1-34)
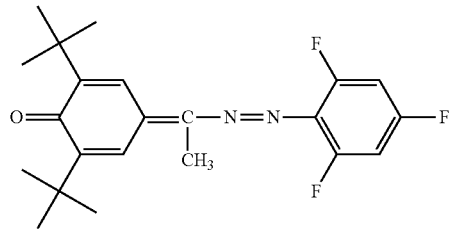
(ET1-35)
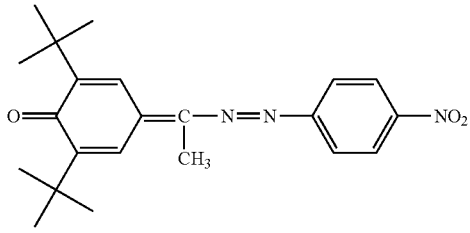
(ET1-36)
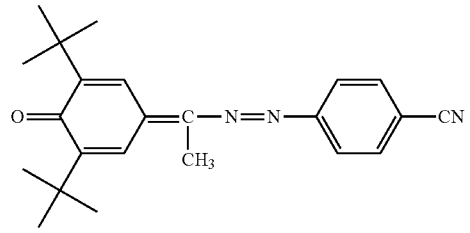

-continued
(ET1-37)
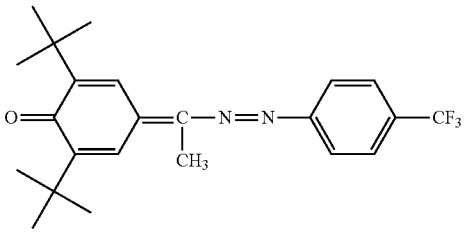
(ET1-38)
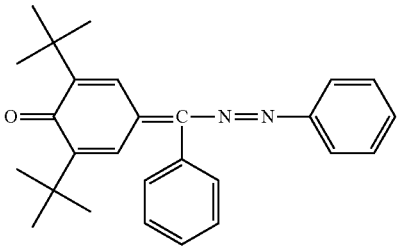
(ET1-39)
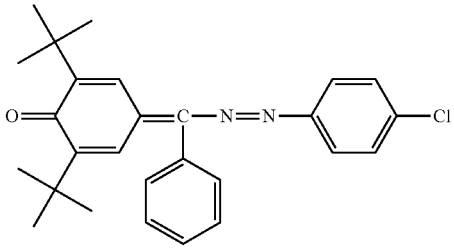
(ET1-40)
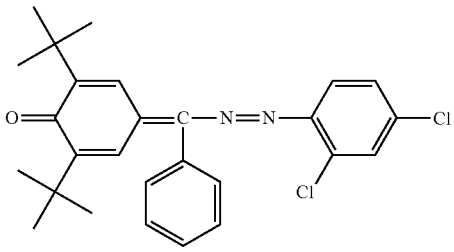
(ET1-41)
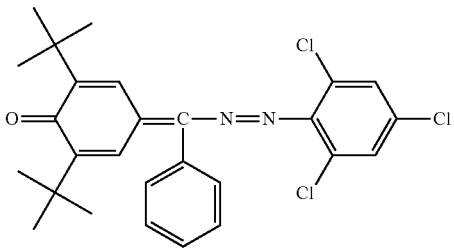
(ET1-42)
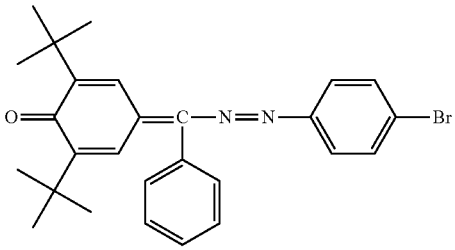
-continued
(ET1-43)
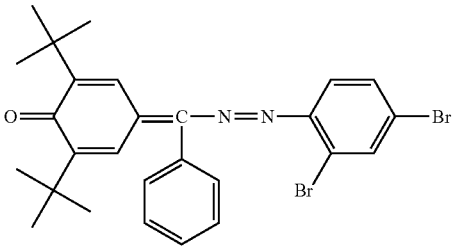
(ET1-44)
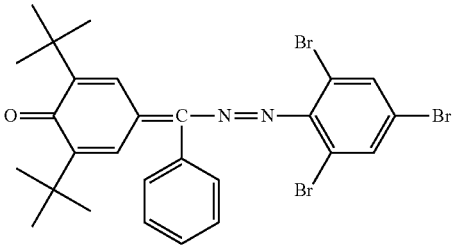
(ET1-45)
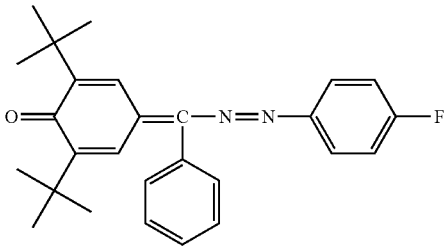
(ET1-46)
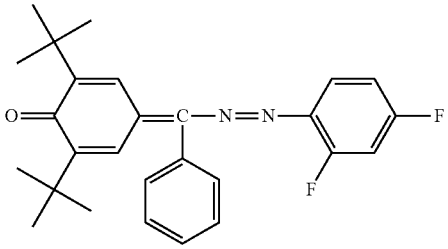
(ET1-47)
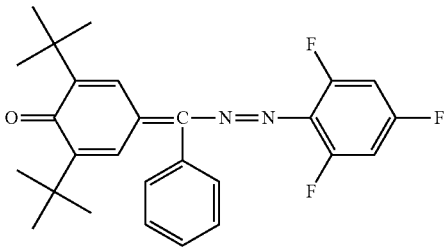
(ET1-48)
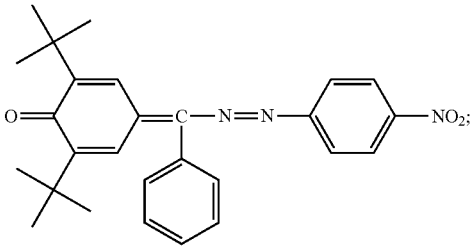

-continued
(ET1-49)
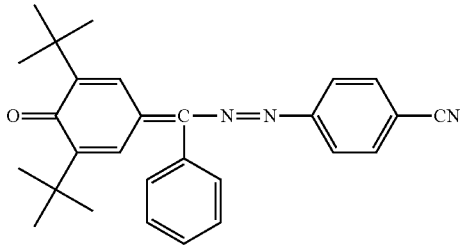
(ET1-50)
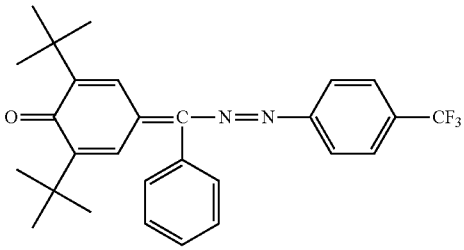
(ET1-51)
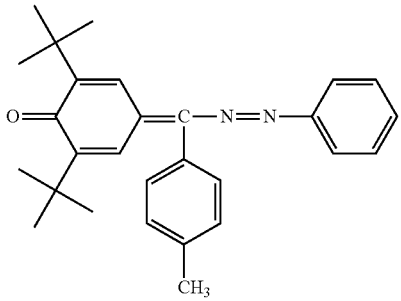
(ET1-52)
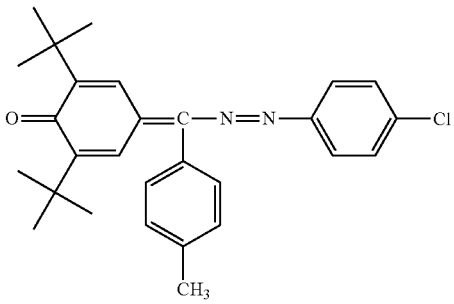
(ET1-53)
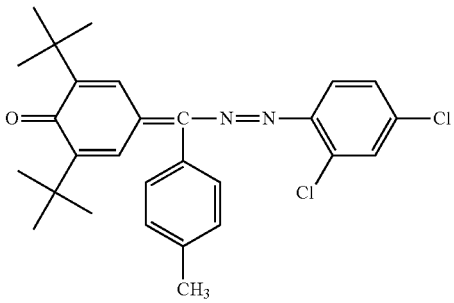
-continued
(ET1-54)
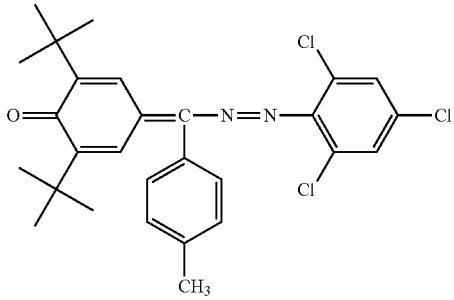
(ET1-55)
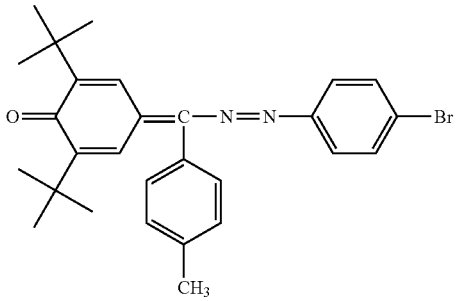
(ET1-56)
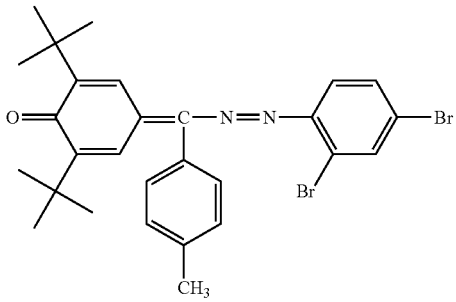
(ET1-57)
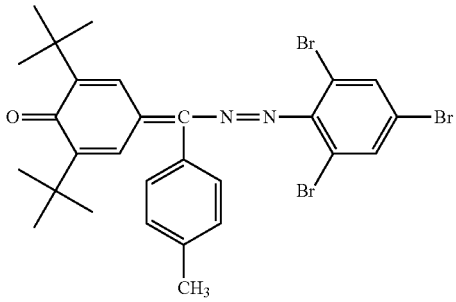
(ET1-58)
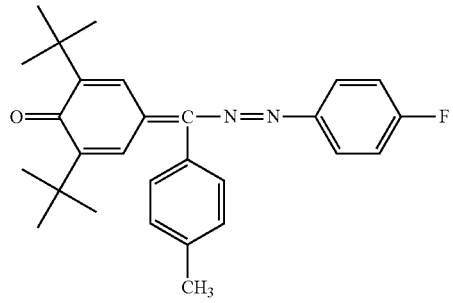

-continued
(ET1-59)
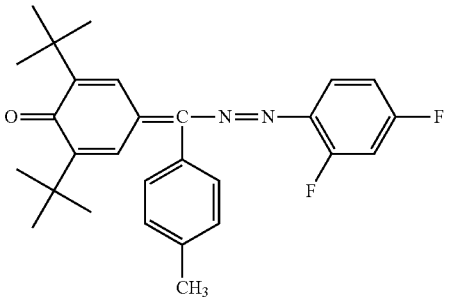
(ET1-60)
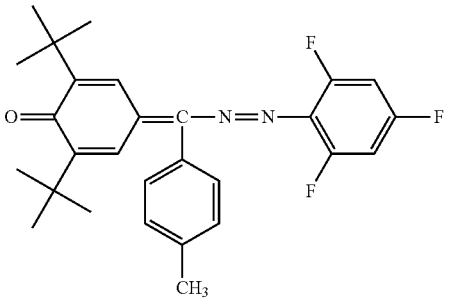
(ET1-61)
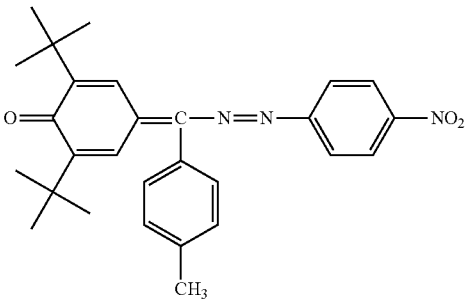
(ET1-62)
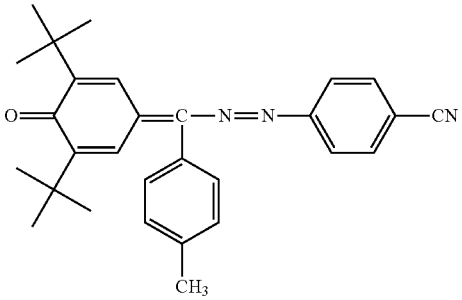
(ET1-63)
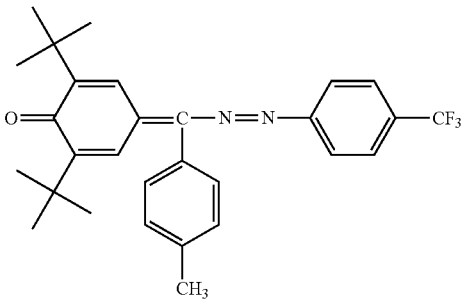
-continued
(ET1-64)
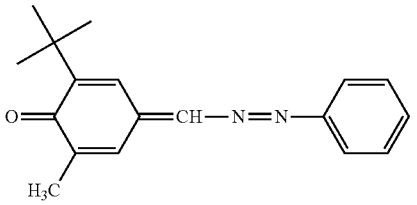
; and
(ET1-65)
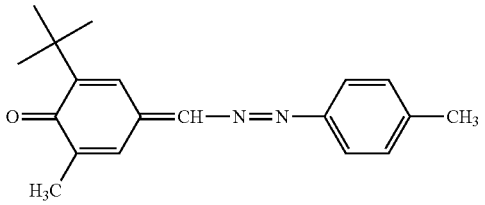
(ET1-66)
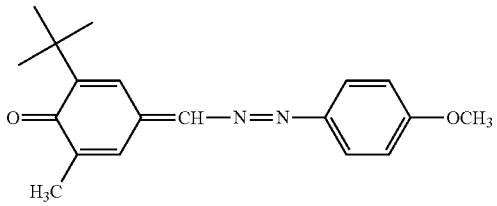
(ET1-67)
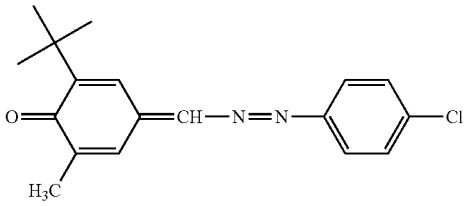
(ET1-68)
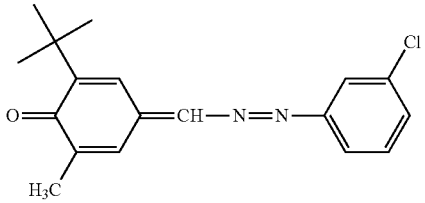
(ET1-69)
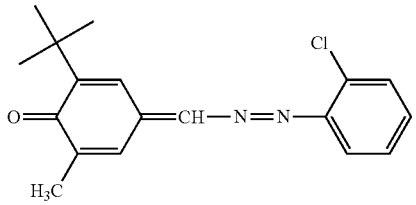
(ET1-70)
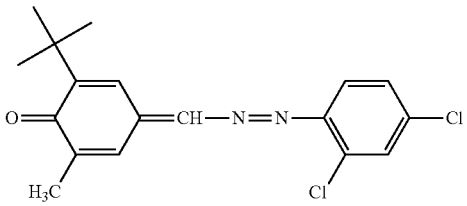

-continued
(ET1-71)
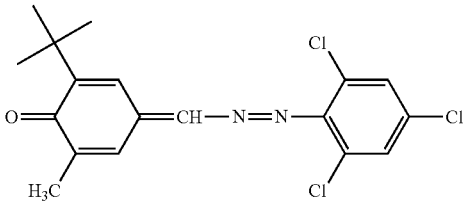
(ET1-72)
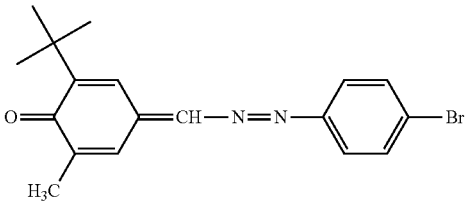
(ET1-73)
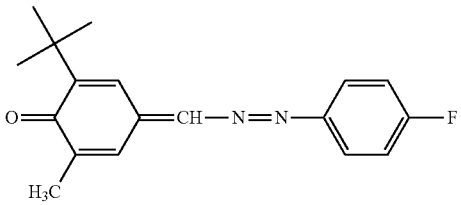
(ET1-74)
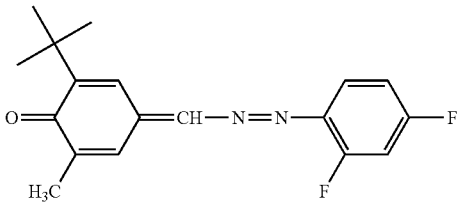
(ET1-75)
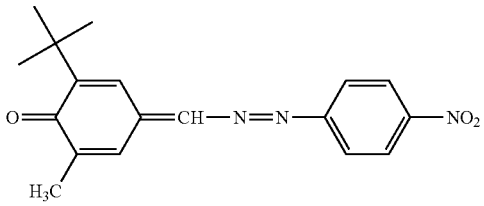
(ET1-76)
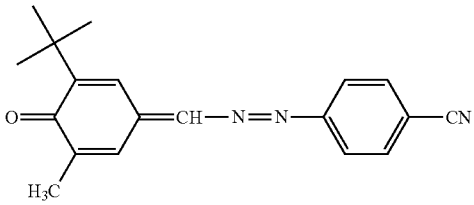
(ET1-77)
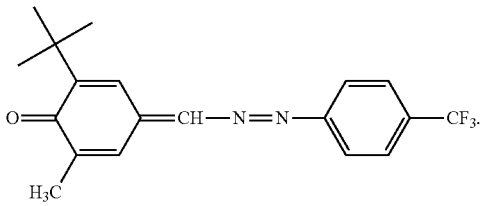
Specific examples of the compound having the structure represented by the above general formula (ET2) as an electron transport material include, but are not limited to, the following:
(ET2-1)
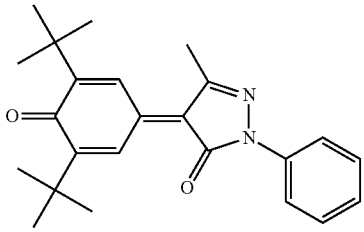
(ET2-2)
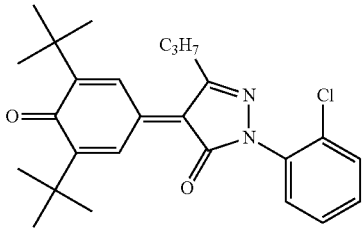
(ET2-3)
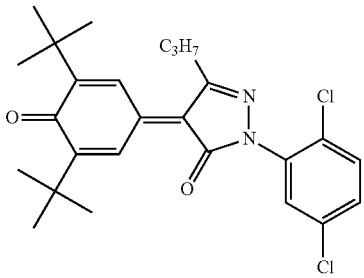
(ET2-4)
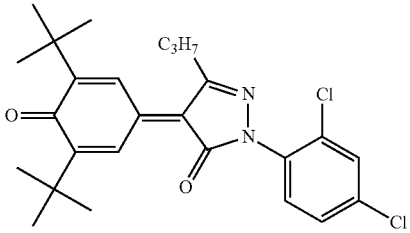
(ET2-5)
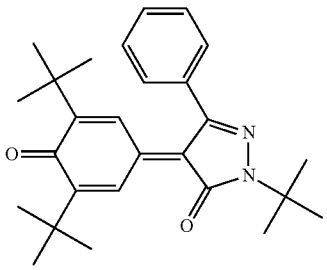

-continued
(ET2-6)
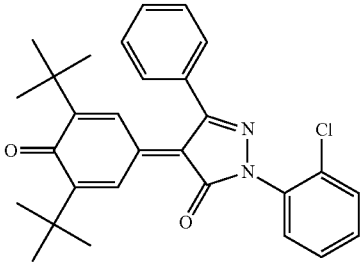
(ET2-7)
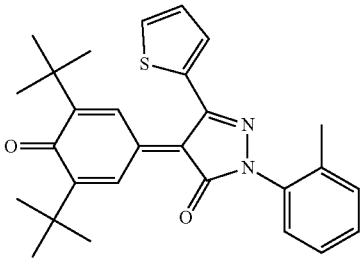
(ET2-8)
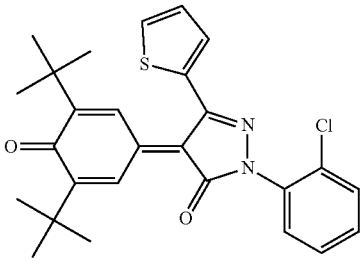
(ET2-9)
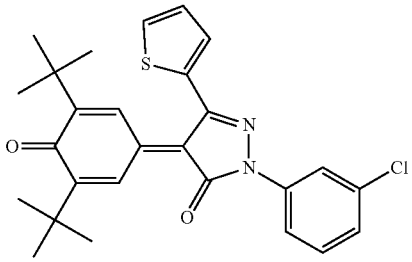
(ET2-10)
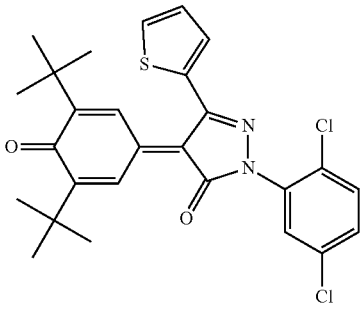
-continued
(ET2-11)
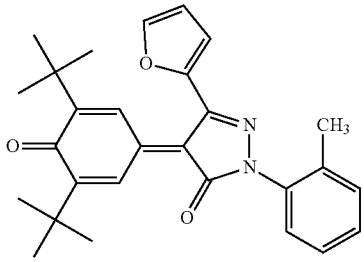
(ET2-12)
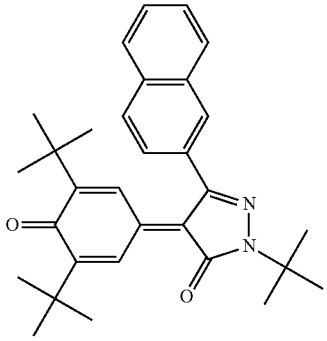
(ET2-13)
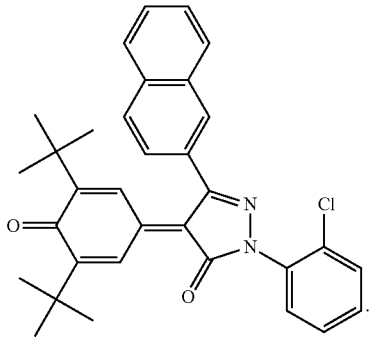
Specific examples of the compound having the structure represented by the above general formula (ET3) as an electron transport material include, but are not limited to, the following:
(ET3-1)
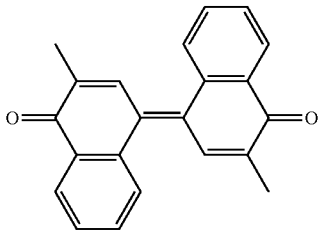
(ET3-2)
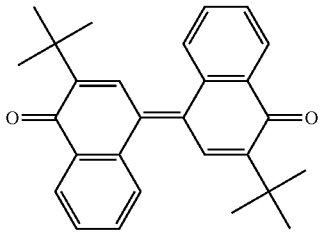

-continued (ET3-3)

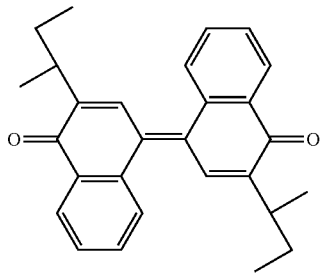

(ET3-4)

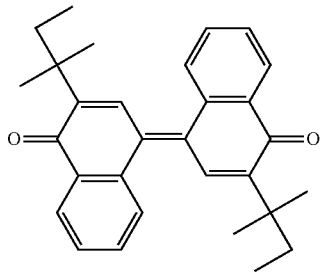

(ET3-5)

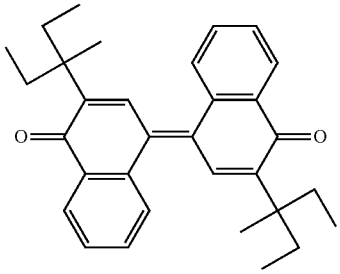

(ET3-6)

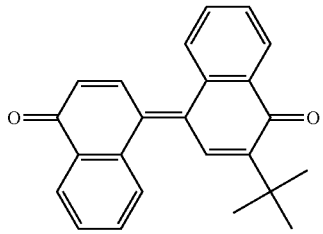

(ET3-7)

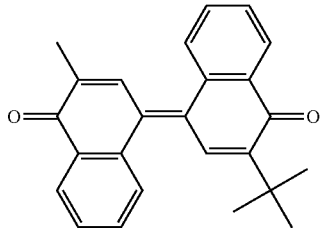

(ET3-8)

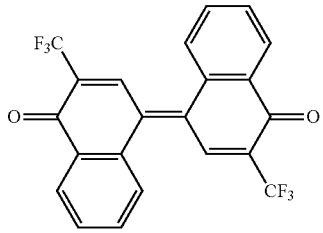

-continued (ET3-9)

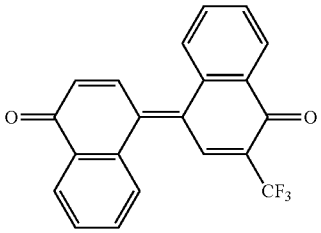

(ET3-10)

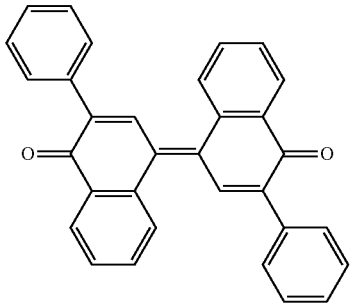

(ET3-11)

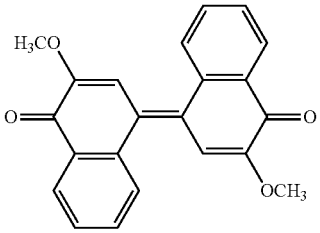

(ET3-12)

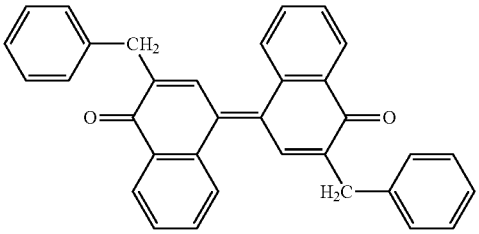

(ET3-13)

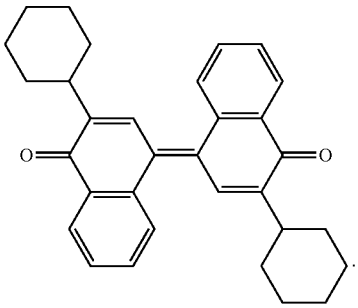

The conductive substrate 1 serves as an electrode of the photoconductor and simultaneously as a support of layers constituting the photoconductor. The conductive substrate 1 may be in the form of a cylinder, a plate or a film. Materials that can be used for the conductive substrate 1 include metals such as aluminum, stainless steel and nickel or those such as glass, resins and the like having a surface subjected to a conductive treatment.

The undercoat layer 2 includes a layer composed mainly of a resin or a metal oxide film such as alumite. The undercoat layer 2 is formed, as necessary, for the purpose of controlling the injectability of charges from the conductive substrate 1 to the photosensitive layer, covering defects on the surface of the conductive substrate 1 or improving the adhesion between the photosensitive layer and the conductive substrate 1. Resin materials that can be used for the undercoat layer 2 include insulating polymers such as casein, polyvinyl alcohol, polyamide, melamine and cellulose; and conductive polymers such as polythiophene, polypyrrole and polyaniline They may be used alone or in combination as appropriate. The resins may also contain metallic oxides such as titanium dioxide and zinc oxide.

As described above, the photosensitive layer may be any of the negatively-charged multi-layer photosensitive layer 6, the positively-charged single-layer photosensitive layer 3 and the positively-charged multi-layer photosensitive layer 7. In the case of the negatively-charged multi-layer photosensitive layer 6, the charge transport layer 5 contains the above-mentioned specific hole transport material, binder resin and at least one electron transport material. In the case of the positively-charged multi-layer photosensitive layer 7, the charge generation layer 4 contains the above-mentioned specific hole transport material, binder resin and at least one electron transport material.

Negatively-Charged Multi-Layer Photoconductor

In the negatively-charged multi-layer photoconductor, the charge generation layer 4 is formed by, for example, a method including applying a coating liquid containing charge generation material particles dispersed in a binder resin, and receives light to generate electric charges. It is important for the charge generation layer 4 to have high efficiency of charge generation and simultaneously have injectability of generated charges into the charge transport layer 5, and it is desirable to be less dependent on the electric field and have a good injectability even at low electric fields.

Examples of the charge generation material include phthalocyanine compounds such as X-form metal-free phthalocyanine, τ-form metal-free phthalocyanine, α-titanyl phthalocyanine, β-titanyl phthalocyanine, Y-titanyl phthalocyanine, γ-titanyl phthalocyanine, amorphous titanyl phthalocyanine, and ε-copper phthalocyanine; various azo pigments, anthanthrone pigments, thiapyrylium pigments, perylene pigments, perinone pigments, squarylium pigments, and quinacridone pigments. These materials can be used alone or in combination as appropriate. Suitable materials can be selected according to the light wavelength range of the exposure light source used in image formation.

Examples of the binder resin used in the charge generation layer 4 include polymers and copolymers of a polycarbonate resin, a polyester resin, a polyamide resin, a polyurethane resin, a polyvinyl chloride resin, a polyvinyl acetate resin, a phenoxy resin, a polyvinyl acetal resin, a polyvinyl butyral resin, a polystyrene resin, a polysulfone resin, a diallyl phthalate resin, and a methacrylic acid ester resin. These binder resins can be used in combination as appropriate.

Since the charge generation layer 4 is only required to have a charge generation function, its film thickness is determined by the light absorption coefficient of the charge generation material, and is generally 1 μm or less, preferably 0.5 μm or less. The charge generation layer 4 is mainly composed of a charge generation material, to which a charge transport material or the like can be added.

The content of the binder resin in the charge generation layer 4 is preferably 20 to 80% by mass, more preferably 30 to 70% by mass, relative to the solid content of the charge generation layer 4. The content of the charge generation material in the charge generation layer 4 is preferably 20 to 80% by mass, more preferably 30 to 70% by mass, relative to the solid content of the charge generation layer 4.

In the negatively-charged multi-layer photoconductor, the charge transport layer 5 includes: a hole transport material having the structure represented by the above general formula (1); a binder resin having the repeating unit represented by the above general formula (2); and at least one electron transport material having a structure represented by the above general formulae (ET1) to (ET3). The expected effect of the present invention can be thus obtained.

The charge transport layer 5 can contain, as needed, other well-known hole transport materials in a range that the effects of the present invention are not significantly impaired. Examples of the other well-known hole transport materials include hydrazone compounds, pyrazoline compounds, pyrazolone compounds, oxadiazole compounds, oxazole compounds, arylamine compounds, benzidine compounds, stilbene compounds, styryl compounds, enamine compounds, butadiene compounds, polyvinyl carbazole, and polysilane. These hole transport materials can be used alone or in combination of two or more as appropriate.

The charge transport layer 5 can also contain, as needed, other well-known binder resins in a range that the effects of the present invention are not significantly impaired. Examples of the other well-known binder resins include thermoplastic resins such as polycarbonate resins other than copolymerized polycarbonate resins represented by the above general formula (1), polyarylate resins, polyester resins, polyvinyl acetal resins, polyvinyl butyral resins, polyvinyl alcohol resins, polyvinyl chloride resins, polyvinyl acetate resins, polyethylene resins, polypropylene resins, polystyrene resins, acrylic resins, polyamide resins, ketone resins, polyacetal resins, polysulfone resins, methacrylate polymers; thermosetting resins such as alkyd resins, epoxy resins, silicone resins, urea resins, phenol resins, unsaturated polyester resins, polyurethane resins, and melamine resins; and copolymers thereof. These binder resins can be used alone or in combination of two or more as appropriate.

The charge transport layer 5 can further contain, as needed, other well-known electron transport materials in a range that the effects of the present invention are not significantly impaired. Examples of the other well-known electron transport materials include electron transport materials (acceptor compounds), such as succinic anhydride, maleic anhydride, dibromosuccinic anhydride, phthalic anhydride, 3-nitrophthalic anhydride, 4-nitrophthalic anhydride, pyromellitic dianhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, azoquinone compounds, anthraquinone compounds, diiminoquinone compounds, and stilbenequinone compounds. These electron transport materials can be used alone or in combination of two or more as appropriate.

The content of the binder resin in the charge transport layer 5 is preferably 55 to 85% by mass, more preferably 60 to 75% by mass, relative to the solid content of the charge transport layer 5. The binder resin is preferably contained within the above range because the wear resistance and printing durability of the photoconductor can be further improved. The content of the hole transport material in the charge transport layer 5 is preferably 20 to 80 parts by mass, more preferably 30 to 70 parts by mass, relative to 100 parts by mass of the binder resin. The content of the electron transport material in the charge transport layer 5 is preferably 1 to 10 parts by mass, more preferably 3 to 5 parts by mass, relative to 100 parts by mass of the binder resin.

The thickness of the charge transport layer 5 is preferably 5 to 60 μm, more preferably 10 to 40 μm, in order to maintain a practically effective surface potential.

Positively-Charged Single-Layer Photoconductor

In the positively-charged single-layer photoconductor, the positively-charged single-layer photosensitive layer 3 can include: a compound having the structure represented by the above general formula (1) as a hole transport material; a resin having the repeating unit represented by the above general formula (2) as a binder resin; and at least one compound having the structures represented by the above general formulae (ET1) to (ET3) as an electron transport material; as well as a charge generation material. The expected effect of the present invention can be thus obtained.

Examples of the charge generation material which can be used in the photosensitive layer 3 include phthalocyanine pigments, azo pigments, anthanthrone pigments, perylene pigments, perinone pigments, polycyclic quinone pigments, squarylium pigments, thiapyrylium pigments, and quinacridone pigments. These charge generation materials can be used alone or in combination of two or more as appropriate. Specifically, preferred examples of the azo pigments include disazo pigment and trisazo pigment. Preferred examples of the perylene pigments include N,N'-bis(3,5-dimethylphenyl)-3,4:9,10-perylene-bis(carboximide). Preferred examples of the phthalocyanine pigments include metal-free phthalocyanine, copper phthalocyanine, and titanyl phthalocyanine. Furthermore, use of X-form metal-free phthalocyanines, τ-form metal-free phthalocyanines, ε-copper phthalocyanines, α-titanyl phthalocyanines, β-titanyl phthalocyanines, Y-titanyl phthalocyanines, amorphous titanyl phthalocyanines, or titanyl phthalocyanines having a maximum peak at a Bragg angle 2θ of 9.6° in an X-ray diffraction spectrum using CuKα described in JPH08-209023A, and U.S. Pat. Nos. 5,736,282A and 5,874,570A, provides remarkably improved effects in terms of sensitivity, durability and picture quality.

The positively-charged single-layer photosensitive layer 3 can contain, as needed, other well-known hole transport materials in a range that the effects of the present invention are not significantly impaired. Examples of the other well-known hole transport materials include hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazole, and polysilane. These hole transport materials can be used alone or in combination of two or more as appropriate. As the hole transport material, those which are excellent in the ability to transport holes generated upon irradiation with light and are suitable for combination with the charge generation material are preferably used.

The positively-charged single-layer photosensitive layer 3 can also contain, as needed, other well-known binder resins in a range that the effects of the present invention are not significantly impaired. Examples of the other well-known binder resins include various polycarbonate resins other than copolymerized polycarbonate resin having the repeating unit represented by the above general formula (2), such as bisphenol A, bisphenol Z, bisphenol A biphenyl copolymer; polyphenylene resins, polyester resins, polyvinyl acetal resins, polyvinyl butyral resins, polyvinyl alcohol resins, polyvinyl chloride resins, polyvinyl acetate resins, polyethylene resins, polypropylene resins, acrylic resins, polyurethane resins, epoxy resins, melamine resins, silicone resins, polyamide resins, polystyrene resins, polyacetal resins, polyarylate resins, polysulfone resins, methacrylate polymers and copolymers thereof. These binder resins can be used alone or in combination of two or more as appropriate. Furthermore, the same kind of resins having different molecular weights may be mixed and used.

The positively-charged single-layer photosensitive layer 3 can further contain, as needed, other well-known electron transport materials in a range that the effects of the present invention are not significantly impaired. Examples of the other well-known electron transport materials include succinic anhydride, maleic anhydride, dibromosuccinic anhydride, phthalic anhydride, 3-nitrophthalic anhydride, 4-nitrophthalic anhydride, pyromellitic dianhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, and azoquinone compounds. These electron transport materials can be used alone or in combination of two or more as appropriate.

The content of the binder resin in the positively-charged single-layer photosensitive layer 3 is preferably 55 to 85% by mass, more preferably 60 to 80% by mass, relative to the solid content of the photosensitive layer 3. The binder resin is preferably contained within the above range because the wear resistance and printing durability of the photoconductor can be further improved. The content of the hole transport material in the photosensitive layer 3 is preferably 3 to 80 parts by mass, more preferably 5 to 60 parts by mass, relative to 100 parts by mass of the binder resin. The content of the electron transport material in the photosensitive layer 3 is preferably 1 to 50 parts by mass, more preferably 5 to 40 parts by mass, relative to 100 parts by mass of the binder resin. The content of the charge generation material in the photosensitive layer 3 is preferably 0.1 to 20 parts by mass, more preferably 0.5 to 10 parts by mass, relative to 100 parts by mass of the binder resin.

The thickness of the single-layer photosensitive layer 3 is preferably in the range of 3 to 100 μm, more preferably in the range of 5 to 40 μm, in order to maintain a practically effective surface potential.

Positively-Charged Multi-Layer Photoconductor

In the positively-charged multi-layer photoconductor, the charge transport layer 5 mainly includes a charge transport material and a binder resin. As the charge transport material and the binder resin used in the charge transport layer 5, the same materials as those listed for the charge transport layer 5 in the negatively-charged multi-layer photoconductor can be used. The content of each material and the thickness of the charge transport layer 5 can be the same as those of the negatively-charged multi-layer photoconductor.

In the positively-charged multi-layer photoconductor, the charge generation layer 4 can include: a compound having the structure represented by the above general formula (1) as a hole transport material; a resin having the repeating unit represented by the above general formula (2) as a binder resin; and at least one compound having a structure represented by the above general formulae (ET1) to (ET3) as an electron transport material; as well as a charge generation material. The expected effect of the present invention can be thus obtained.

As the charge generation material used in the charge generation layer 4, the same materials as those listed for the positively-charged single-layer photosensitive layer 3 in the positively-charged single-layer photoconductor can be used. The hole transport material, the at least one electron transport material, and the binder resin can also contain, as needed, other well-known materials in a range that the effects of the present invention are not significantly impaired, as in the photosensitive layer 3. The content of each material and the thickness of the charge generation layer 4 can be the same as those of the photosensitive layer 3.

For the purpose of improving the environmental resistance and stability against harmful light, both the multi-layer and single-layer photosensitive layers can contain antidegradants such as antioxidants, radical scavengers, singlet quenchers, ultraviolet absorbers, and light stabilizers in a range that the effects of the present invention are not significantly impaired. Examples of such compounds include chromanol derivatives such as tocopherol, and esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenol compounds, hindered phenol compounds, linear amine compounds, cyclic amine compounds, hindered amine compounds, and biphenyl derivatives.

In addition, the photosensitive layer can also contain leveling agents such as silicone oils and fluorine-based oils for the purpose of improving the leveling properties of or imparting lubricity to the formed film. For the purpose of, for example, adjusting film hardness, reducing friction coefficient, and imparting lubricity, the photosensitive layer may further contain microparticles of metallic oxides such as silicon oxide (silica), titanium oxide, zinc oxide, calcium oxide, aluminum oxide (alumina), and zirconium oxide; metal sulfates such as barium sulfate, and calcium sulfate; metal nitrides such as silicon nitride, and aluminum nitride; or fluorine-based resin particles such as polytetrafluoroethylene; and fluorine-based comb-like graft polymerized resin particles. The photosensitive layer can further contain, as needed, other well-known additives in a range that the electrophotographic characteristics are not significantly impaired.

Process of Producing the Photoconductor

In some embodiments of the present invention, the process of producing the photoconductor for electrophotography includes steps of preparing a coating liquid containing a hole transport material having the structure represented by the above general formula (1), a binder resin having the repeating structure represented by the above general formula (2), and at least one electron transport material having a structure represented by the above general formulae (ET1) to (ET3); and applying the coating liquid on a conductive substrate to form a photosensitive layer.

Specifically, in the case of the negatively-charged multi-layer photoconductor, a charge generation layer is formed by a process including steps of: first dissolving and dispersing a desired charge generation material and binder resin in a solvent to prepare a coating liquid for forming the charge generation layer; and applying the coating liquid for forming the charge generation layer onto the outer periphery of a conductive substrate, via an undercoat layer, if desired, and drying it to form the charge generation layer. Then, a charge transport layer is formed by a process including steps of: dissolving the specific hole transport material, binder resin and at least one electron transport material in a solvent to prepare a coating liquid for forming the charge transport layer; and applying the coating liquid for forming the charge transport layer onto the charge generation layer, and drying it to from the charge transport layer. According to such a production method, the negatively-charged multi-layer photoconductor in the embodiments can be produced.

On the other hand, the positively-charged single-layer photoconductor can be produced by a process including steps of: dissolving and dispersing the specific hole transport material, binder resin and at least one electron transport material, as well as a desired charge generation material, to a solvent to prepare a coating liquid for forming a single-layer photosensitive layer; and applying the coating liquid for forming a single-layer photosensitive layer onto the outer periphery of a conductive substrate, via an undercoat layer, if desired, and drying it to form a photosensitive layer.

In addition, in the case of the positively-charged multi-layer photoconductor, a charge transport layer is formed by a process including steps of: first dissolving an optional hole transport material and binder resin in a solvent to prepare a coating liquid for forming the charge transport layer; and applying the coating liquid for forming the charge transport layer onto the outer periphery of a conductive substrate, via an undercoat layer, if desired, and drying it to form the charge transport layer. Then, a charge generation layer is formed by a process including steps of: dissolving and dispersing the specific hole transport material, binder resin and at least one electron transport material, as well as a desired charge generation material, in a solvent to prepare a coating liquid for forming the charge generation layer; and applying the coating liquid for forming the charge generation layer onto the charge transport layer, and drying it to from the charge generation layer. According to such a production method, the positively-charged multi-layer photoconductor in the embodiments can be produced.

The type of the solvent used for the preparation of the coating liquid, the application conditions, the drying conditions, and the like can be appropriately selected according to a conventional method, and are not particularly limited. Preferably, a dip coating method is used as the coating method. By using the dip coating method, a photoconductor having a good appearance quality and suitable electric characteristics can be produced while achieving low cost and high productivity.

Electrophotographic Apparatus

In some embodiments of the present invention, the photoconductor for electrophotography can be applied to various machine processes to provide desired effects. Specifically, sufficient effects can be obtained in charging processes such as contact charging systems using charging members such as roller and brush and non-contact charging systems using charging members such as corotron or scorotron, as well as in developing processes such as contact developing and non-contact developing systems using developers such as nonmagnetic one-component, magnetic one-component, or two-component developers.

Figure 4:
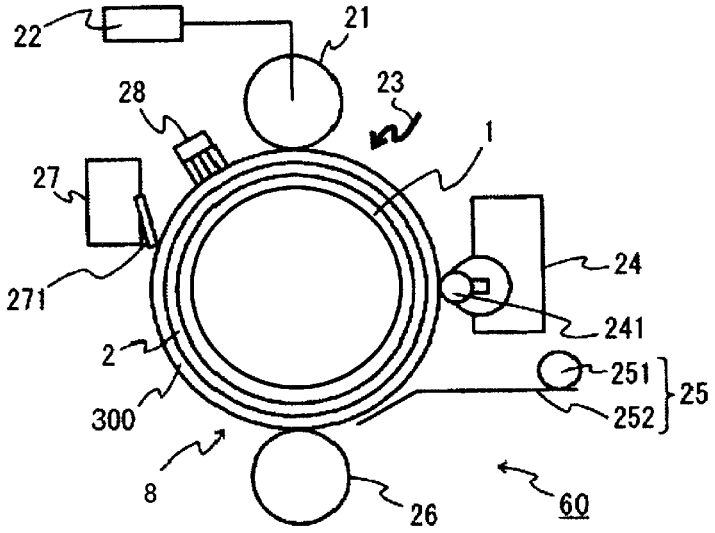
FIG. 4 is a schematic configuration showing an example of the electrophotographic apparatus of the present invention.

FIG. 4 is a schematic view showing a configuration of the electrophotographic apparatus of the present invention. As shown, the electrophotographic apparatus 60 is equipped with the photoconductor 8 according to one embodiment of the present invention, wherein the photoconductor 8 includes the conductive substrate 1, and the undercoat layer 2 and the photosensitive layer 300 coated on the outer peripheral surface of the conductive substrate 1. The electrophotographic apparatus 60 includes the charging member 21 (which is roller-shaped in the example shown in the figure) arranged on the outer peripheral edge of the photoconductor 8; the high-voltage power supply 22 for supplying an applied voltage to the charging member 21; the image exposure member 23; the development device 24 including the development roller 241; the paper feed 25 including the paper feed roller 251 and the paper feed guide 252; and the transfer charging device (direct charging) 26. The electrophotographic apparatus 60 may further include the cleaner 27 including the cleaning blade 271, and the charge eraser 28. In one embodiment of the present invention, the electrophotographic apparatus 60 can be a color printer.

EXAMPLES

Specific aspects of the present invention will be described in further detail with reference to the Examples. However, the present invention is not limited to the Examples below provided the gist thereof is not exceeded.

Production of Negatively-Charged Multi-Layer Photoconductor

Example 1

In 90 parts by mass of methanol, 5 parts by mass of alcohol-soluble nylon (Toray, product name "CM8000") and 5 parts by mass of aminosilane-treated titanium oxide microparticles were dissolved and dispersed to prepare a coating liquid for undercoat layer. The coating liquid for undercoat layer was dip coated on the outer periphery of an aluminum cylinder with an outer diameter of 30 mm as a conductive substrate 1 and then dried at 100° C. for 30 minutes to form an undercoat layer 2 with a thickness of 3 μm.

In 60 parts by mass of dichloromethane, 1 part by mass of Y-titanyl phthalocyanine as a charge generation material and 1.5 parts by mass of polyvinyl butyral resin (Sekisui Chemical, product name "ESLEC KS-1") as a binder resin were dissolved and dispersed to prepare a coating liquid for charge generation layer. The coating liquid for charge generation layer was dip coated on the undercoat layer 2 and then dried at 80° C. for 30 minutes to form a charge generation layer 4 with a thickness of 0.3 μm.

In 1000 parts by mass of dichloromethane, 130 parts by mass of a copolymerized polycarbonate resin with a mass average molecular weight of 50,000 represented by the above structural formula (2-5), wherein t/(s+t)=0.5 and the end group was a group represented by structural formula (3) below, as a binder resin, 70 parts by mass (about 54 parts by mass with respect to 100 parts by mass of the binder resin) of a compound represented by the above structural formula (1-5) as a hole transport material, and 5 parts by mass (about 3.8 parts by mass with respect to 100 parts by mass of the binder resin) of an electron transport material represented by the above structural formula (ET2-3) were dissolved to prepare a coating liquid for charge transport layer. The hole mobility of the compound represented by the structural formula (1-5) was $75.2\times10^{-6}$ $cm^2/V\cdot s$ when the electric field strength was 20 V/μm. The content of the binder resin was about 63% by mass relative to the solid content of the charge transport layer 5.

The coating liquid for charge transport layer was dip coated on the charge generation layer 4 and then dried at 90° C. for 60 minutes to form a charge transport layer 5 with a thickness of 25 μm, thereby producing the negatively-charged multi-layer photoconductor.

(3)

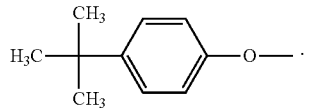

Examples 2 to 22 and Comparative Examples 1 to 15

A photoconductor for electrophotography was produced in the same manner as in Example 1 except that the binder resin, the hole transport material and the electron transport material in the charge transport layer 5 were changed as shown in tables below.

The hole mobility ($\times10^{-6}$ $cm^2/V\cdot s$) at an electric field strength of 20 V/μm of the hole transport material used in each examples and comparative examples is as follows:

the compound represented by the structural formula (1-2): 73.9;

the compound represented by the structural formula (A-100): 13.2;

the compound represented by the structural formula (A-101): 9.57; and the compound represented by the structural formula (A-102): 34.5.

The hole mobilities of hole transport materials represented by the general formula (1) other than the above used in the examples are estimated to be in the range of $60\times10^{-6}$ to $120\times10^{-6}$ $cm^2/V\cdot s$ when the electric field strength is 20 V/μm, from the molecular structure.

The structural formulae of the materials used in tables below are as flows:

A-100

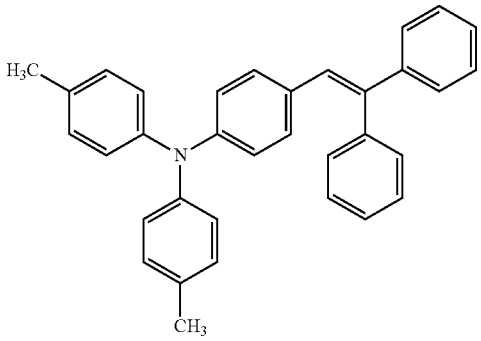

A-101

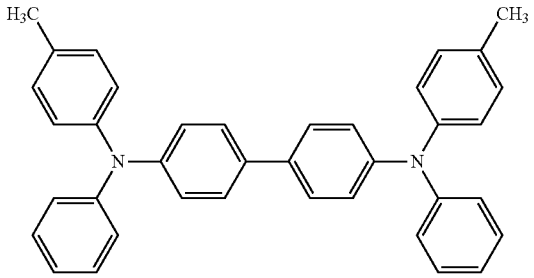

-continued

B-100

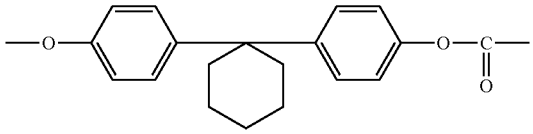

B-101

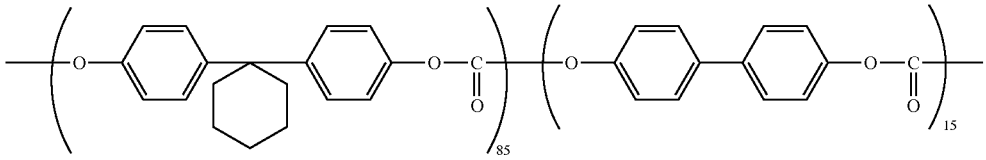

B-102

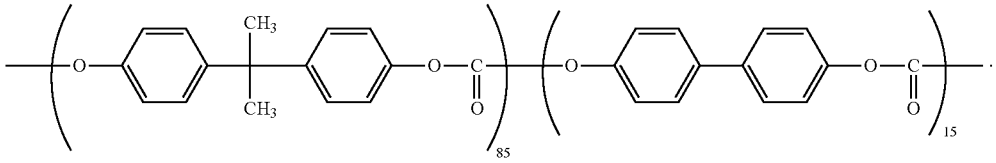

TABLE 1

| | Hole Transport Material | | Binder Resin | | Electron Transport Material | |
|---|---|---|---|---|---|---|
| | Structural Formula | Content (part by mass) | Structural Formula | Content (part by mass) | Structural Formula | Content (part by mass) |
| Example 1 | 1-5 | 70 | 2-5 | 130 | ET2-3 | 5 |
| Example 2 | 1-5 | 50 | 2-5 | 150 | ET2-3 | 5 |
| Example 3 | 1-2 | 70 | 2-1 | 130 | ET2-3 | 5 |
| Example 4 | 1-2 | 50 | 2-1 | 150 | ET1-4 | 5 |
| Example 5 | 1-7 | 70 | 2-15 | 130 | ET1-4 | 5 |
| Example 6 | 1-7 | 50 | 2-15 | 150 | ET1-4 | 5 |
| Example 7 | 1-10 | 70 | 2-5 | 130 | ET3-2 | 5 |
| Example 8 | 1-10 | 50 | 2-5 | 150 | ET3-2 | 5 |
| Example 9 | 1-13 | 70 | 2-1 | 130 | ET3-2 | 5 |
| Example 10 | 1-13 | 50 | 2-1 | 150 | ET2-3 | 5 |
| Example 11 | 1-16 | 70 | 2-15 | 130 | ET2-3 | 5 |
| Example 12 | 1-16 | 50 | 2-15 | 150 | ET2-3 | 5 |
| Example 13 | 1-22 | 70 | 2-5 | 130 | ET1-4 | 5 |
| Example 14 | 1-22 | 50 | 2-5 | 150 | ET1-4 | 5 |
| Example 15 | 1-31 | 70 | 2-1 | 130 | ET1-4 | 5 |
| Example 16 | 1-31 | 50 | 2-1 | 150 | ET1-4 | 5 |
| Example 17 | 1-40 | 70 | 2-15 | 130 | ET1-4 | 5 |
| Example 18 | 1-40 | 50 | 2-15 | 150 | ET1-4 | 5 |
| Example 19 | 1-49 | 70 | 2-5 | 130 | ET2-3 | 5 |
| Example 20 | 1-49 | 50 | 2-5 | 150 | ET2-3 | 5 |
| Example 21 | 1-61 | 70 | 2-15 | 130 | ET2-3 | 5 |
| Example 22 | 1-61 | 50 | 2-15 | 150 | ET2-3 | 5 |

TABLE 2

| | Hole Transport Material | | Binder Resin | | Electron Transport Material | |
|---|---|---|---|---|---|---|
| | Structural Formula | Content (part by mass) | Structural Formula | Content (part by mass) | Structural Formula | Content (part by mass) |
| Comparative Example 1 | A-100 | 70 | B-100 | 130 | — | — |
| Comparative Example 2 | A-100 | 50 | B-100 | 150 | — | — |
| Comparative Example 3 | A-100 | 70 | B-101 | 130 | ET1-4 | 5 |
| Comparative Example 4 | A-100 | 50 | B-101 | 150 | — | — |
| Comparative Example 5 | A-101 | 70 | B-102 | 130 | — | — |
| Comparative Example 6 | A-101 | 50 | B-102 | 150 | ET1-4 | 5 |
| Comparative Example 7 | A-101 | 70 | B-100 | 130 | — | — |
| Comparative Example 8 | A-101 | 50 | B-100 | 150 | — | — |
| Comparative Example 9 | 1-5 | 70 | B-100 | 130 | ET3-2 | 5 |
| Comparative Example 10 | 1-5 | 50 | B-102 | 150 | — | — |
| Comparative Example 11 | 1-5 | 70 | B-101 | 130 | ET2-3 | 5 |
| Comparative Example 12 | 1-5 | 50 | B-101 | 150 | — | — |
| Comparative Example 13 | A-100 | 70 | 2-5 | 130 | — | — |
| Comparative Example 14 | A-100 | 50 | 2-15 | 150 | — | — |
| Comparative Example 15 | 1-5 | 95 | 2-5 | 105 | ET3-2 | 5 |

Using the photoconductors for electrophotography produced in Examples 1 to 22 and Comparative Examples 1 to 15, the electric characteristics, potential stability, wear resistance, light resistance, filming, and contamination resistance were evaluated by the evaluation methods described below. The results are shown in tables below.

Evaluation of Electric Characteristics

Electric characteristics of the photoconductors obtained in the Examples and the Comparative Examples were evaluated by the following method using a process simulator produced by Gentec (CYNTHIA91). The surfaces of the photoconductors obtained in Examples 1 to 22 and Comparative Examples 1 to 15 were charged to −650 V by corona discharge in the dark under an environment of a temperature of 22° C. and a humidity of 50%, and then left to stand in the dark for 5 seconds.

Next, using a halogen lamp as a light source, 1.0 $\mu W/cm^2$ of an exposure light having a spectrum of 780 nm separated with a filter was applied to the photoconductor for 5 seconds after the surface potential reached −600V. The exposure amount required for light attenuation until the surface potential reached −300 V was $E_{1/2}$ ($\mu J/cm^2$), and the residual potential of the surface of the photoconductor 5 seconds after the exposure was $Vr_5$ (−V).

Evaluations for Potential Stability and Wear Resistance

The photoconductors produced in the Examples and the Comparative Examples were mounted on a two-component developing digital copier (Canon Image Runner Color 2880) which had been modified to measure the surface potentials of the photoconductors. Then, the photoconductors were evaluated for the change in potential in the light area throughout printing of 10,000 copies and for the amount of wear of the photosensitive layer due to friction with paper and the blade.

Evaluations for Light-Induced Fatigue Properties and Filming

The photoconductors produced in the Examples and the Comparative Examples were covered with black paper provided with an opening at the light irradiation portion, and then irradiated with a light from a cool white fluorescent lamp adjusted to an illuminance of 500 lx for 10 minutes. The photoconductor immediately after the completion of the light irradiation was mounted on a Canon Image Runner Color 2880. Then, 45%-black halftone images were output to determine the difference in print density between the light irradiated area and the non-irradiated area. The print density difference was evaluated as follows:

"○" where the difference was 0.03 or less;

"Δ" where the difference was more than 0.03 and 0.06 or less; or

"x" where the difference was more than 0.06.

The filming was evaluated based on the presence or absence of toner adhesion to the surface of the photoconductor after repeated printing. The evaluation was indicated as follows:

"○" where no toner adhesion was observed;

"Δ" where slight toner adhesion was observed; or

"x" where significant toner adhesion was observed.

Evaluation for Contamination Resistance

The photoconductors produced in the Examples and the Comparative Examples were brought into contact with a charging roller and a transfer roller and left under an environment of a temperature of 60° C. and a humidity of 90% for 30 days. The charging roller and the transfer roller were of the same type as those mounted on an HP printer LJ4250. The photoconductor after being left was mounted on an HP printer LJ4250, and halftone images were printed and evaluated. The evaluation was indicated as follows:

"○" where no black streaks occurred in the halftone image;

"Δ" where black streaks occurred in the halftone image to an extent causing no problem in practical use; or "x" where black streaks occurred in the halftone image.

TABLE 3

| | E1/2 ($\mu Jcm^{-2}$) | Vr5 (−V) | Change in light area potential throughout printing (−V) | Wear amount of photosensitive layer throughout printing (μm) | Light resistance | Evaluation of filming after printing | Contamination resistance (image after standing test) |
|---|---|---|---|---|---|---|---|
| Example 1 | 0.11 | 13 | 11 | 1.51 | ○ | ○ | ○ |
| Example 2 | 0.13 | 16 | 10 | 1.3 | ○ | ○ | ○ |
| Example 3 | 0.12 | 10 | 9 | 1.55 | ○ | ○ | ○ |
| Example 4 | 0.15 | 14 | 11 | 1.36 | ○ | ○ | ○ |
| Example 5 | 0.12 | 11 | 10 | 1.58 | ○ | ○ | ○ |
| Example 6 | 0.14 | 13 | 12 | 1.32 | ○ | ○ | ○ |
| Example 7 | 0.13 | 9 | 8 | 1.49 | ○ | ○ | ○ |
| Example 8 | 0.14 | 12 | 9 | 1.31 | ○ | ○ | ○ |
| Example 9 | 0.12 | 10 | 12 | 1.5 | ○ | ○ | ○ |
| Example 10 | 0.15 | 12 | 10 | 1.29 | ○ | ○ | ○ |
| Example 11 | 0.14 | 14 | 11 | 1.51 | ○ | ○ | ○ |
| Example 12 | 0.17 | 17 | 13 | 1.33 | ○ | ○ | ○ |
| Example 13 | 0.11 | 10 | 9 | 1.6 | ○ | ○ | ○ |
| Example 14 | 0.13 | 13 | 11 | 1.38 | ○ | ○ | ○ |
| Example 15 | 0.15 | 8 | 8 | 1.57 | ○ | ○ | ○ |
| Example 16 | 0.18 | 11 | 10 | 1.41 | ○ | ○ | ○ |
| Example 17 | 0.12 | 12 | 11 | 1.54 | ○ | ○ | ○ |
| Example 18 | 0.14 | 14 | 13 | 1.42 | ○ | ○ | ○ |

TABLE 3-continued

| | E1/2 ($\mu Jcm^{-2}$) | Vr5 (−V) | Change in light area potential throughout printing (−V) | Wear amount of photosensitive layer throughout printing (μm) | Light resistance | Evaluation of filming after printing | Contamination resistance (image after standing test) |
|---|---|---|---|---|---|---|---|
| Example 19 | 0.11 | 13 | 10 | 1.56 | ○ | ○ | ○ |
| Example 20 | 0.14 | 16 | 14 | 1.39 | ○ | ○ | ○ |
| Example 21 | 0.15 | 11 | 9 | 1.48 | ○ | ○ | ○ |
| Example 22 | 0.16 | 13 | 12 | 1.31 | ○ | ○ | ○ |

TABLE 4

| | E1/2 ($\mu Jcm^{-2}$) | Vr5 (−V) | Change in light area potential throughout printing (−V) | Wear amount of photosensitive layer throughout printing (μm) | Light resistance | Evaluation of filming after printing | Contamination resistance (image after standing test) |
|---|---|---|---|---|---|---|---|
| Comparative Example 1 | 0.25 | 35 | 30 | 3.35 | Δ | ○ | X |
| Comparative Example 2 | 0.29 | 40 | 33 | 3.21 | Δ | Δ | X |
| Comparative Example 3 | 0.28 | 37 | 35 | 3.54 | ○ | Δ | X |
| Comparative Example 4 | 0.31 | 41 | 38 | 3.32 | Δ | ○ | X |
| Comparative Example 5 | 0.28 | 33 | 36 | 3.89 | X | X | Δ |
| Comparative Example 6 | 0.34 | 38 | 40 | 3.68 | Δ | Δ | X |
| Comparative Example 7 | 0.31 | 37 | 31 | 3.76 | ○ | X | X |
| Comparative Example 8 | 0.37 | 42 | 35 | 3.55 | Δ | X | X |
| Comparative Example 9 | 0.16 | 15 | 18 | 3.87 | ○ | Δ | X |
| Comparative Example 10 | 0.18 | 18 | 19 | 3.56 | Δ | Δ | X |
| Comparative Example 11 | 0.17 | 16 | 17 | 3.45 | ○ | ○ | X |
| Comparative Example 12 | 0.15 | 17 | 15 | 3.38 | Δ | ○ | X |
| Comparative Example 13 | 0.31 | 35 | 32 | 3.67 | Δ | X | Δ |
| Comparative Example 14 | 0.35 | 38 | 35 | 3.48 | Δ | X | X |
| Comparative Example 15 | 0.09 | 7 | 10 | 3.59 | ○ | Δ | Δ |

From the results in the above table, the electric characteristics and the contamination resistance were successfully improved when the charge transport layer of the negatively-charged multi-layer photoconductor contained a combination of a specific hole transport material with high mobility, polycarbonate resin and electron transport material. It was revealed that the content of polycarbonate resin in the charge transport layer being 55% by mass or more relative to the solid content of the charge transport layer can reduce the amount of film wearing after repeated printing of 10,000 copies by 50% or more as compared with the Comparative Examples. Furthermore, no problems were found in the potential and image evaluations after printing.

Production of Positively-Charged Single-Layer Photoconductor

Example 23

A coating liquid for forming an undercoat layer, which was prepared by dissolving 0.2 parts by mass of vinyl chloride-vinyl acetate-vinyl alcohol terpolymer (Nissin Chemical Industry, product name "Solbin TA5R") in 99 parts by mass of methyl ethyl ketone while stirring, was dip coated on the outer periphery of an aluminum cylinder with an outer diameter of 24 mm as a conductive substrate 1 and then dried at 100° C. for 30 minutes to form an undercoat layer 2 with a thickness of 0.1 μm.

Next, 1.5 parts by mass (about 1.2 parts by mass with respect to 100 parts by mass of a binder resin) of metal-free phthalocyanine as a charge generation material represented by the following formula:

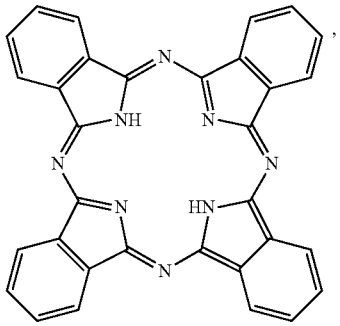

45 parts by mass (about 34.6 parts by mass with respect to 100 parts by mass of a binder resin) of a compound represented by the above structural formula (1-5) as a hole transport material, 35 parts by mass (about 26.9 parts by mass with respect to 100 parts by mass of a binder resin) of a compound represented by the above structural formula (ET2-3) as an electron transport material, and 130 parts by mass of a resin represented by the above structural formula (2-5) as a binder resin were dissolved and dispersed in 850 parts by mass of tetrahydrofuran to prepare a coating liquid for forming a single-layer photosensitive layer. The hole mobility of the compound represented by the structural formula (1-5) was $75.2\times10^{-6}$ $cm^2/V\cdot s$ when the electric field strength was 20 V/μm. The content of the binder resin was about 61% by mass relative to the solid content of the photosensitive layer 3.

The coating liquid for forming a single-layer photosensitive layer was dip coated on the undercoat layer 2 and then dried at 100° C. for 60 minutes to form a photosensitive layer 3 with a thickness of 25 μm, thereby producing the positively-charged single-layer photoconductor.

Examples 24 to 33 and Comparative Examples 16 to 24

A photoconductor for electrophotography was produced in the same manner as in Example 23 except that the binder resin, the hole transport material and the electron transport material were changed as shown in the table 5 below.

The hole mobilities of hole transport materials represented by the general formula (1) used in the Examples are estimated, from the molecular structure, to be in the range of $60\times10^{-6}$ to $120\times10^{-6}$ $cm^2/V\cdot s$ when the electric field strength is 20 V/μm.

The structural formula of the materials used in tables below is shown as follows:

A-102

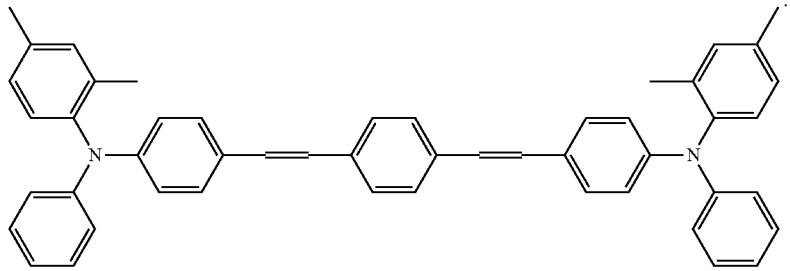

TABLE 5

| | Hole Transport Material | | Binder Resin | | Electron Transport Material | |
|---|---|---|---|---|---|---|
| | Structural Formula | Content (part by mass) | Structural Formula | Content (part by mass) | Structural Formula | Content (part by mass) |
| Example 23 | 1-5 | 45 | 2-5 | 130 | ET2-3 | 35 |
| Example 24 | 1-2 | 45 | 2-1 | 130 | ET2-3 | 35 |
| Example 25 | 1-7 | 45 | 2-15 | 130 | ET2-3 | 35 |
| Example 26 | 1-10 | 45 | 2-5 | 130 | ET1-4 | 35 |
| Example 27 | 1-13 | 45 | 2-1 | 130 | ET1-4 | 35 |
| Example 28 | 1-16 | 45 | 2-15 | 130 | ET1-4 | 35 |
| Example 29 | 1-22 | 45 | 2-5 | 130 | ET3-2 | 35 |
| Example 30 | 1-31 | 45 | 2-1 | 130 | ET3-2 | 35 |
| Example 31 | 1-40 | 45 | 2-15 | 130 | ET3-2 | 35 |
| Example 32 | 1-49 | 45 | 2-5 | 130 | ET2-3 | 35 |
| Example 33 | 1-61 | 45 | 2-15 | 130 | ET2-3 | 35 |
| Comparative Example 16 | A-100 | 45 | B-101 | 130 | ET1-4 | 35 |
| Comparative Example 17 | A-102 | 45 | B-100 | 130 | ET2-3 | 35 |
| Comparative Example 18 | A-101 | 45 | B-102 | 130 | — | — |
| Comparative Example 19 | A-101 | 45 | B-100 | 130 | — | — |
| Comparative Example 20 | 1-2 | 45 | B-100 | 130 | ET3-2 | 35 |
| Comparative Example 21 | 1-2 | 45 | B-101 | 130 | ET1-4 | 35 |
| Comparative Example 22 | A-102 | 45 | 2-5 | 130 | — | — |
| Comparative Example 23 | A-102 | 45 | 2-15 | 130 | ET2-3 | 35 |
| Comparative Example 24 | A-102 | 70 | 2-5 | 105 | ET2-3 | 35 |

The electric characteristics of the photoconductors for electrophotography produced in Examples 23 to 33 and Comparative Examples 16 to 24 were evaluated by the evaluation methods described below. The potential stability, wear resistance, light resistance, filming, and contamination resistance of the photoconductors from the Examples and Comparative Examples were evaluated in the same manner as in the case of the negatively-charged multi-layer photoconductor except that the printer used was changed to a Brother printer HL-2040. The results are shown in the tables below.

Evaluation of Electric Characteristics

Electric characteristics of the photoconductors obtained in the Examples and the Comparative Examples were evaluated by the following method using a process simulator produced by Gentec (CYNTHIA91). The surfaces of the photoconductors obtained in Examples 23 to 33 and Comparative Examples 16 to 24 were charged to 650 V by corona discharge in the dark under an environment of a temperature of 22° C. and a humidity of 50%, and then left to stand in the dark for 5 seconds.

Next, using a halogen lamp as a light source, 1.0 $\mu W/cm^2$ of an exposure light dispersed to 780 nm with a filter was applied to the photoconductor for 5 seconds after the surface potential reached 600V. The exposure amount required for light attenuation until the surface potential reached 300 V was $E_{1/2}$ ($\mu J/cm^2$), and the residual potential of the surface of the photoconductor 5 seconds after the exposure was $Vr_5$ (V).

TABLE 6

| | E1/2 ($\mu Jcm^{-2}$) | Vr5 (−V) | Change in light area potential throughout printing (−V) | Wear amount of photosensitive layer throughout printing (μm) | Light resistance | Evaluation of filming after printing | Contamination resistance (image after standing test) |
|---|---|---|---|---|---|---|---|
| Example 23 | 0.14 | 16 | 14 | 1.72 | ○ | ○ | ○ |
| Example 24 | 0.12 | 17 | 15 | 1.85 | ○ | ○ | ○ |
| Example 25 | 0.15 | 12 | 12 | 1.65 | ○ | ○ | ○ |
| Example 26 | 0.11 | 14 | 10 | 1.61 | ○ | ○ | ○ |
| Example 27 | 0.18 | 18 | 16 | 1.81 | ○ | ○ | ○ |
| Example 28 | 0.13 | 16 | 13 | 1.74 | ○ | ○ | ○ |
| Example 29 | 0.14 | 14 | 12 | 1.72 | ○ | ○ | ○ |
| Example 30 | 0.16 | 18 | 14 | 1.76 | ○ | ○ | ○ |
| Example 31 | 0.12 | 12 | 10 | 1.88 | ○ | ○ | ○ |
| Example 32 | 0.16 | 17 | 14 | 1.81 | ○ | ○ | ○ |
| Example 33 | 0.15 | 11 | 16 | 1.75 | ○ | ○ | ○ |
| Comparative Example 16 | 0.32 | 33 | 35 | 3.98 | ○ | Δ | Δ |
| Comparative Example 17 | 0.35 | 32 | 38 | 3.87 | Δ | ○ | X |
| Comparative Example 18 | 0.28 | 35 | 31 | 4.1 | Δ | X | Δ |
| Comparative Example 19 | 0.34 | 30 | 36 | 3.86 | Δ | Δ | X |
| Comparative Example 20 | 0.36 | 29 | 33 | 3.79 | ○ | Δ | Δ |
| Comparative Example 21 | 0.34 | 26 | 30 | 3.56 | ○ | ○ | Δ |
| Comparative Example 22 | 0.2 | 19 | 20 | 3.92 | Δ | ○ | X |
| Comparative Example 23 | 0.36 | 31 | 32 | 3.88 | ○ | Δ | X |
| Comparative Example 24 | 0.10 | 10 | 12 | 3.95 | ○ | Δ | Δ |

The results in the above table revealed that when the photosensitive layer of the positively-charged single-layer photoconductor contained a combination of a specific hole transport material with high mobility, and electron transport material, the contamination resistance can be improved and the amount of film wearing after repeated printing of 10,000 copies can be reduced by 50% or more as compared with the Comparative Examples. Furthermore, no problems were found in the potential and image evaluations after the printing.

Production of Positively-Charged Multi-Layer Photoconductor

Example 34

Next, 50 parts by mass of a compound as a hole transport material represented by the following formula:

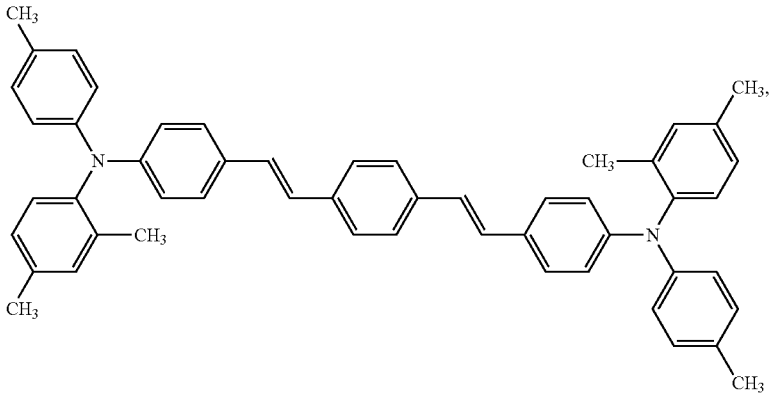

and 50 parts by mass of bisphenol Z polycarbonate as a binder resin were dissolved in 800 parts by mass of dichloromethane to prepare a coating liquid for charge transport layer. The coating liquid for charge transport layer was dip coated on the outer periphery of an aluminum cylinder with an outer diameter of 24 mm as a conductive substrate 1 and then dried at 120° C. for 60 minutes to form a charge transport layer with a thickness of 15 μm.

Next, 1.5 parts by mass (about 2.5 parts by mass with respect to 100 parts by mass of a binder resin) of metal-free phthalocyanine as a charge generation material represented by the following formula:

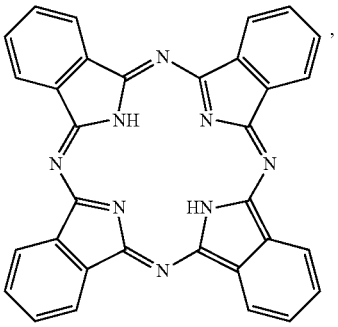

10 parts by mass (about 17 parts by mass with respect to 100 parts by mass of a binder resin) of a compound represented by the above structural formula (1-5) as a hole transport material, 27.5 parts by mass (about 45.8 parts by mass with respect to 100 parts by mass of a binder resin) of a compound represented by the above structural formula (ET2-3) as an electron transport material, and 60 parts by mass of a resin represented by the above structural formula (2-5) as a binder resin were dissolved and dispersed in 800 parts by mass of 1, 2-dichloroethane to prepare a coating liquid for charge generation layer. The hole mobility of the compound represented by the structural formula (1-5) was $75.2\times10^{-6}$ $cm^2/V\cdot s$ when the electric field strength was 20 V/μm. The content of the binder resin was about 61% by mass relative to the solid content of the charge generation layer 4.

The coating liquid for charge generation layer was dip coated on the charge transport layer and then dried at 100° C. for 60 minutes to form a charge generation layer with a thickness of 15 μm, thereby producing the positively-charged multi-layer photoconductor.

Examples 35 to 44 and Comparative Examples 25 to 33

A photoconductor for electrophotography was produced in the same manner as in Example 34 except that the binder resin, the hole transport material and the electron transport material were changed as shown in the table 7 below.

The hole mobilities of hole transport materials represented by the general formula (1) used in the Examples are estimated, from the molecular structure, to be in the range of $60\times10^{-6}$ to $120\times10^{-6}$ $cm^2/V\cdot s$ when the electric field strength is 20 V/μm.

TABLE 7

| | Hole Transport Material | | Binder Resin | | Electron Transport Material | |
|---|---|---|---|---|---|---|
| | Structural Formula | Content (part by mass) | Structural Formula | Content (part by mass) | Structural Formula | Content (part by mass) |
| Example 34 | 1-5 | 10 | 2-5 | 60 | ET2-3 | 27.5 |
| Example 35 | 1-2 | 10 | 2-1 | 60 | ET2-3 | 27.5 |
| Example 36 | 1-7 | 10 | 2-15 | 60 | ET2-3 | 27.5 |
| Example 37 | 1-10 | 10 | 2-5 | 60 | ET1-4 | 27.5 |
| Example 38 | 1-13 | 10 | 2-1 | 60 | ET1-4 | 27.5 |
| Example 39 | 1-16 | 10 | 2-15 | 60 | ET1-4 | 27.5 |
| Example 40 | 1-22 | 10 | 2-5 | 60 | ET3-2 | 27.5 |

TABLE 7-continued

| | Hole Transport Material | | Binder Resin | | Electron Transport Material | |
|---|---|---|---|---|---|---|
| | Structural Formula | Content (part by mass) | Structural Formula | Content (part by mass) | Structural Formula | Content (part by mass) |
| Example 41 | 1-31 | 10 | 2-1 | 60 | ET3-2 | 27.5 |
| Example 42 | 1-40 | 10 | 2-15 | 60 | ET3-2 | 27.5 |
| Example 43 | 1-49 | 10 | 2-5 | 60 | ET2-3 | 27.5 |
| Example 44 | 1-61 | 10 | 2-15 | 60 | ET2-3 | 27.5 |
| Comparative Example 25 | A-100 | 10 | B-101 | 60 | ET1-4 | 27.5 |
| Comparative Example 26 | A-102 | 10 | B-101 | 60 | ET2-3 | 27.5 |
| Comparative Example 27 | A-101 | 10 | B-102 | 60 | — | — |
| Comparative Example 28 | A-101 | 10 | B-100 | 60 | — | — |
| Comparative Example 29 | 1-2 | 10 | B-100 | 60 | ET3-2 | 27.5 |
| Comparative Example 30 | 1-2 | 10 | B-101 | 60 | ET1-4 | 27.5 |
| Comparative Example 31 | A-102 | 10 | 2-5 | 60 | — | — |
| Comparative Example 32 | A-102 | 10 | 2-15 | 60 | — | — |
| Comparative Example 33 | 1-5 | 20 | B-101 | 50 | ET1-4 | 27.5 |

The electric characteristics, potential stability, wear resistance, light resistance, filming, and contamination resistance of the photoconductors produced in Examples 34 to 44 and Comparative Examples 25 to 33 were evaluated in the same manner as in the case of the positively-charged single-layer photoconductor. The results are shown in the following table.

TABLE 8

| | E1/2 ($\mu Jcm^{-2}$) | Vr5 (V) | Change in light area potential throughout printing (−V) | Wear amount of photosensitive layer throughout printing (μm) | Light resistance | Evaluation of filming after printing | Contamination resistance (image after standing test) |
|---|---|---|---|---|---|---|---|
| Example 34 | 0.17 | 15 | 12 | 1.65 | ○ | ○ | ○ |
| Example 35 | 0.14 | 13 | 14 | 1.56 | ○ | ○ | ○ |
| Example 36 | 0.18 | 12 | 15 | 1.52 | ○ | ○ | ○ |
| Example 37 | 0.15 | 13 | 11 | 1.6 | ○ | ○ | ○ |
| Example 38 | 0.14 | 15 | 13 | 1.57 | ○ | ○ | ○ |
| Example 39 | 0.15 | 11 | 12 | 1.64 | ○ | ○ | ○ |
| Example 40 | 0.18 | 14 | 14 | 1.53 | ○ | ○ | ○ |
| Example 41 | 0.13 | 16 | 16 | 1.47 | ○ | ○ | ○ |
| Example 42 | 0.14 | 11 | 11 | 1.56 | ○ | ○ | ○ |
| Example 43 | 0.11 | 12 | 12 | 1.55 | ○ | ○ | ○ |
| Example 44 | 0.16 | 14 | 10 | 1.6 | ○ | ○ | ○ |
| Comparative Example 25 | 0.29 | 31 | 32 | 3.56 | Δ | Δ | X |
| Comparative Example 26 | 0.3 | 33 | 31 | 3.74 | ○ | X | X |
| Comparative Example 27 | 0.27 | 28 | 33 | 3.64 | X | Δ | Δ |
| Comparative Example 28 | 0.31 | 27 | 29 | 3.58 | Δ | Δ | X |
| Comparative Example 29 | 0.32 | 30 | 30 | 3.61 | ○ | Δ | Δ |
| Comparative Example 30 | 0.3 | 27 | 28 | 3.54 | ○ | ○ | Δ |
| Comparative Example 31 | 0.21 | 22 | 19 | 3.66 | Δ | Δ | X |
| Comparative Example 32 | 0.31 | 34 | 31 | 3.72 | Δ | ○ | Δ |
| Comparative Example 33 | 0.11 | 9 | 8 | 3.81 | ○ | Δ | Δ |

The results in the above table revealed that when the charge generation layer of the positively-charged multi-layer photoconductor contained a combination of a specific hole transport material with high mobility, and electron transport material, the contamination resistance can be improved and the amount of film wearing after repeated printing of 10,000 copies can be reduced by 50% or more as compared with the Comparative Examples. Furthermore, no problems were found in the potential and image evaluations after the printing.

DESCRIPTION OF SYMBOLS

1 conductive substrate
2 undercoat layer
3 positively-charged single-layer photosensitive layer
4 charge generation layer
5 charge transport layer
6 negatively-charged multi-layer photosensitive layer
7 positively-charged multi-layer photosensitive layer
8 photoconductor
21 charging roller
22 high-voltage power supply
23 image exposure member
24 development device
241 development roller
25 paper feed
251 paper feed roller
252 paper feed guide
26 transfer charging device (direct charging)
27 cleaner

271 cleaning blade

28 charge eraser

60 electrophotographic apparatus

300 photosensitive layer

What is claimed is:

1. A photoconductor for electrophotography, comprising:

a conductive substrate; and a photosensitive layer that is formed on the conductive substrate, that is a single layer, and that comprises:

a hole transport material having a structure represented by General Formula (1) below;

a binder resin having a repeating structure represented by General Formula (2) below; and at least one electron transport material having a structure represented by General Formulae (ET1) to (ET2) below:

General Formula (1)

(1)

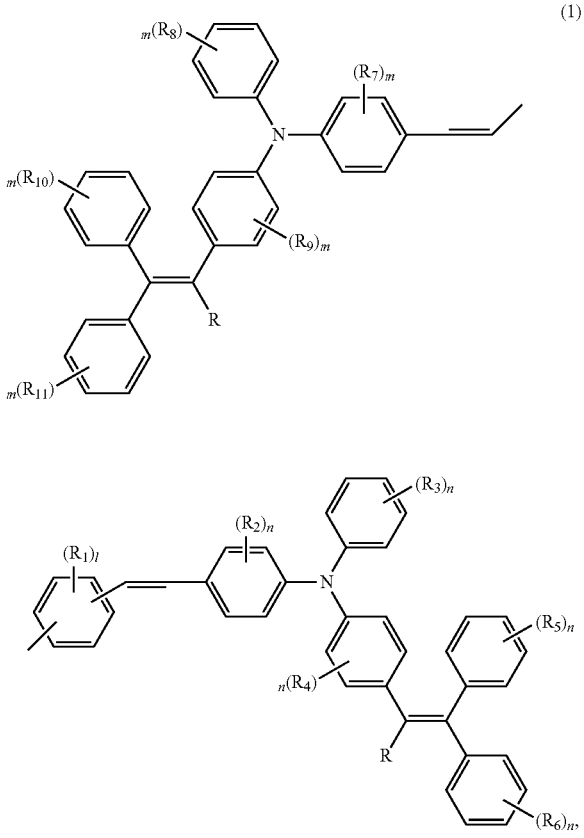

where $R_1$ represents a hydrogen atom or an optionally substituted $C_{1-3}$ alkyl group;

$R_2$ to $R_{11}$ each independently represent a hydrogen atom, a halogen atom, an optionally substituted $C_{1-6}$ alkyl group or an optionally substituted $C_{1-6}$ alkoxy group;

l, m, and n each represent an integer of 0 to 4; and

R represents a hydrogen atom or an optionally substituted $C_{1-3}$ alkyl group;

General Formula (2)

(2)

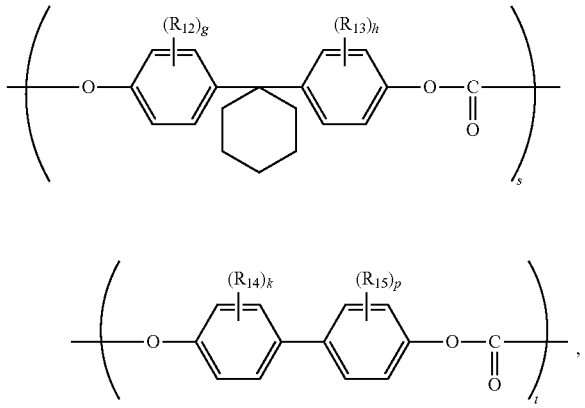

where $R_{12}$ to $R_{15}$ are the same or different and each represent a hydrogen atom, a $C_{1-10}$ alkyl group or a $C_{1-10}$ fluoroalkyl group;

g, h, k, and p each represent an integer of 0 to 4;

s and t satisfy $0.3 \leq t/(s+t) \leq 0.7$; and the chain end group is a monovalent aromatic group;

General Formula (ET1)

(ET1)

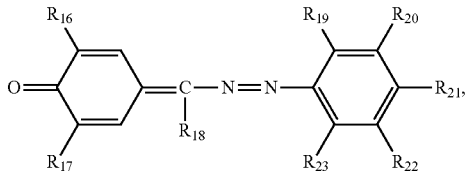

where $R_{16}$ and $R_{17}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group or a halogenated alkyl group;

$R_{18}$ represents a hydrogen atom, a $C_{1-6}$ alkyl group, a $C_{1-6}$ alkoxy group, an optionally substituted aryl group, a cycloalkyl group, an optionally substituted aralkyl group or a halogenated alkyl group; and $R_{19}$ to $R_{23}$ are the same or different and each represent a hydrogen atom, a halogen atom, a $C_{1-12}$ alkyl group, a $C_{1-12}$ alkoxy group, an optionally substituted aryl group, an optionally substituted aralkyl group, an optionally substituted phenoxy group, a halogenated alkyl group, a cyano group or a nitro group, or two or more of the groups optionally combine together to form a ring; and where the substituent represents a halogen atom, a $C_{1-6}$ alkyl group, a $C_{1-6}$ alkoxy group, a hydroxy group, a cyano group, an amino group, a nitro group or a halogenated alkyl group;

General Formula (ET2)

(ET2)

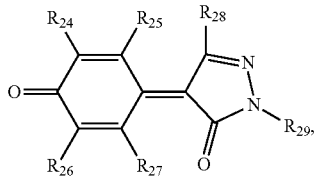

where $R_{24}$ to $R_{29}$ are the same or different and each represent a hydrogen atom, a halogen atom, a cyano group, a nitro group, a hydroxy group, a $C_{1-12}$ alkyl group, a $C_{1-12}$ alkoxy group, an optionally substituted aryl group, an optionally substituted heterocyclic group, an ester group, a cycloalkyl group, an optionally substituted aralkyl group, an allyl group, an amide group, an amino group, an acyl group, an alkenyl group, an alkynyl group, a carboxyl group, a carbonyl group, a carboxy group or a halogenated alkyl group; and wherein the photosensitive layer contains the binder resin in an amount of 55% by mass or more and 85% by mass or less relative to solid content of the photosensitive layer.

3. A process for producing the photoconductor for electrophotography according to claim 1, comprising steps of:

preparing a coating liquid containing a hole transport material having a structure represented by the General Formula (1), a binder resin having a repeating structure represented by the General Formula (2), and at least one electron transport material having a structure represented by the General Formulae (ET1) to (ET2); and applying the coating liquid on the conductive substrate to form the photosensitive layer.

4. An electrophotographic apparatus equipped with the photoconductor for electrophotography according to claim 1.

5. A photoconductor for electrophotography, comprising:

a conductive substrate; and a photosensitive layer that is formed on the conductive substrate and that comprises:

a hole transport material having a structure represented by General Formula (1) below;

a binder resin having a repeating structure represented by General Formula (2) below; and at least one electron transport material having a structure represented by General Formulae (ET1) to (ET3) below:

where $R_1$ represents a hydrogen atom or an optionally substituted $C_{1-3}$ alkyl group;

General Formula (1)

(1)

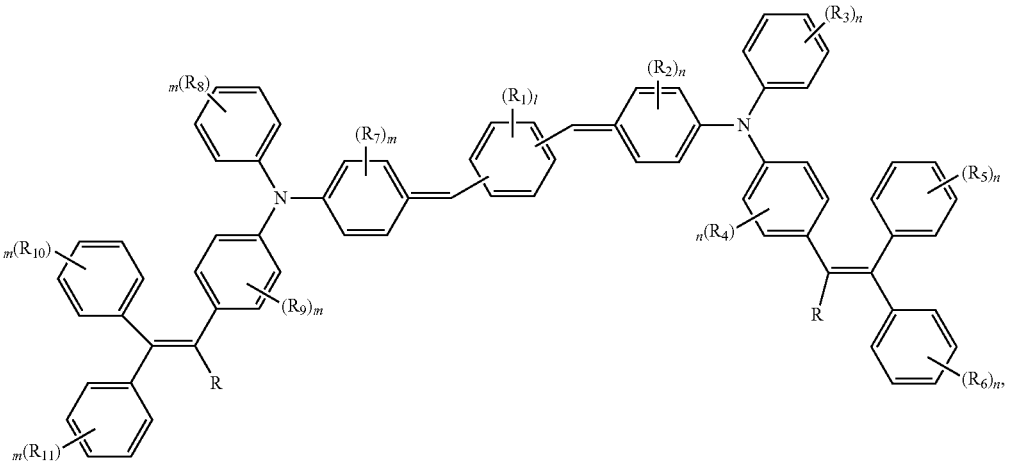

where the substituent represents a halogen atom, a $C_{1-6}$ alkyl group, a $C_{1-6}$ alkoxy group, a hydroxy group, a cyano group, an amino group, a nitro group or a halogenated alkyl group.

2. The photoconductor for electrophotography according to claim 1, wherein the hole transport material has a hole mobility of $60\times10^{-6}$ $cm^2/V\cdot s$ or more; and $R_2$ to $R_{11}$ each independently represent a hydrogen atom, a halogen atom, an optionally substituted $C_{1-6}$ alkyl group or an optionally substituted $C_{1-6}$ alkoxy group;

l, m, and n each represent an integer of 0 to 4; and

R represents a hydrogen atom or an optionally substituted $C_{1-3}$ alkyl group;

General Formula (2)

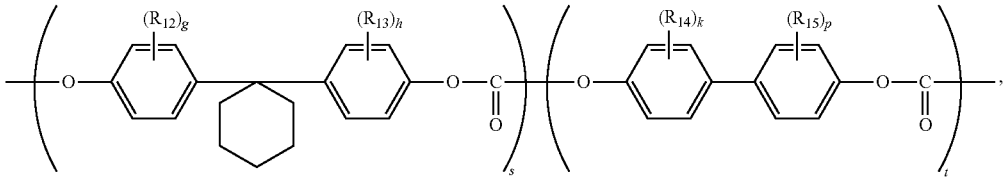

(2)

where $R_{12}$ to $R_{15}$ are the same or different and each represent a hydrogen atom, a $C_{1-10}$ alkyl group or a $C_{1-10}$ fluoroalkyl group;

g, h, k, and p each represent an integer of 0 to 4;

s and t satisfy $0.3 \leq t/(s+t) \leq 0.7$; and the chain end group is a monovalent aromatic group;

General Formula (ET1)

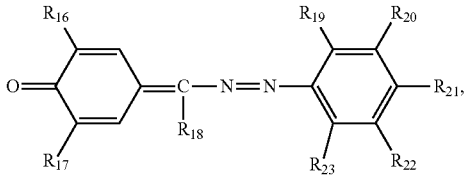

(ET1)

where $R_{16}$ and $R_{17}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group or a halogenated alkyl group;

$R_{18}$ represents a hydrogen atom, a $C_{1-6}$ alkyl group, a $C_{1-6}$ alkoxy group, an optionally substituted aryl group, a cycloalkyl group, an optionally substituted aralkyl group or a halogenated alkyl group; and $R_{19}$ to $R_{23}$ are the same or different and each represent a hydrogen atom, a halogen atom, a $C_{1-12}$ alkyl group, a $C_{1-12}$ alkoxy group, an optionally substituted aryl group, an optionally substituted aralkyl group, an optionally substituted phenoxy group, a halogenated alkyl group, a cyano group or a nitro group, or two or more of the groups optionally combine together to form a ring; and where the substituent represents a halogen atom, a $C_{1-6}$ alkyl group, a $C_{1-6}$ alkoxy group, a hydroxy group, a cyano group, an amino group, a nitro group or a halogenated alkyl group;

General Formula (ET2)

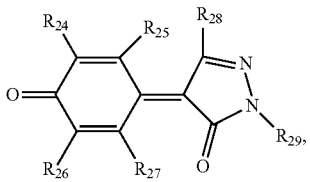

(ET2)

where $R_{24}$ to $R_{29}$ are the same or different and each represent a hydrogen atom, a halogen atom, a cyano group, a nitro group, a hydroxy group, a $C_{1-12}$ alkyl group, a $C_{1-12}$ alkoxy group, an optionally substituted aryl group, an optionally substituted heterocyclic group, an ester group, a cycloalkyl group, an optionally substituted aralkyl group, an allyl group, an amide group, an amino group, an acyl group, an alkenyl group, an alkynyl group, a carboxyl group, a carbonyl group, a carboxy group or a halogenated alkyl group; and where the substituent represents a halogen atom, a $C_{1-6}$ alkyl group, a $C_{1-6}$ alkoxy group, a hydroxy group, a cyano group, an amino group, a nitro group or a halogenated alkyl group; and General Formula (ET3)

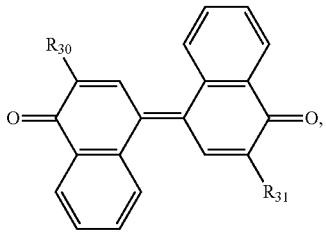

(ET3)

where $R_{30}$ and $R_{31}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group, or a halogenated alkyl group; and where the substituent represents a halogen atom, a $C_{1-6}$ alkyl group, a $C_{1-6}$ alkoxy group, a hydroxy group, a cyano group, an amino group, a nitro group or a halogenated alkyl group, wherein the photosensitive layer comprises a charge generation layer and a charge transport layer laminated in that order on the conductive substrate, and wherein the charge transport layer comprises the hole transport material, the binder resin and the at least one electron transport material.

6. The photoconductor for electrophotography according to claim 5, wherein the hole transport material has a hole mobility of $60 \times 10^{-6}$ $cm^2/V \cdot s$ or more; and wherein the charge transport layer contains the binder resin in an amount of 55% by mass or more and 85% by mass or less relative to solid content of the charge transport layer.

7. A process for producing the photoconductor for electrophotography according to claim 5, comprising steps of:

preparing a charge generation layer coating liquid;

applying the charge generation layer coating liquid on the conductive substrate to provide a charge generation layer coating;

drying the charge generation layer coating to provide a dried charge generation layer;

preparing a charge transport layer coating liquid containing the hole transport material having a structure represented by the General Formula (1), the binder resin having a repeating structure represented by the General Formula (2), and the at least one electron transport material having a structure represented by the General Formulae (ET1) to (ET3);

applying the charge transport layer coating liquid on the dried charge generation layer to provide a charge transport layer coating; and drying the charge transport layer coating to provide the photosensitive layer.

8. An electrophotographic apparatus equipped with the photoconductor for electrophotography according to claim 5.

9. A photoconductor for electrophotography, comprising:

a conductive substrate; and a photosensitive layer that is formed on the conductive substrate and that comprises:

a hole transport material having a structure represented by General Formula (1) below;

a binder resin having a repeating structure represented by General Formula (2) below; and at least one electron transport material having a structure represented by General Formulae (ET1) to (ET3) below:

General Formula (1)

(1)

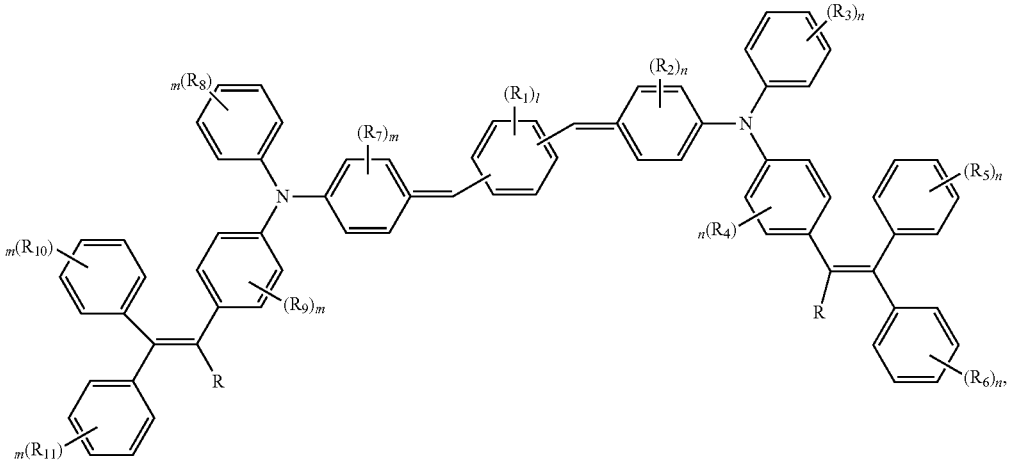

where $R_1$ represents a hydrogen atom or an optionally substituted $C_{1-3}$ alkyl group;

$R_2$ to $R_{11}$ each independently represent a hydrogen atom, a halogen atom, an optionally substituted $C_{1-6}$ alkyl group or an optionally substituted $C_{1-6}$ alkoxy group;

l, m, and n each represent an integer of 0 to 4; and

R represents a hydrogen atom or an optionally substituted $C_{1-3}$ alkyl group;

General Formula (2)

(2)

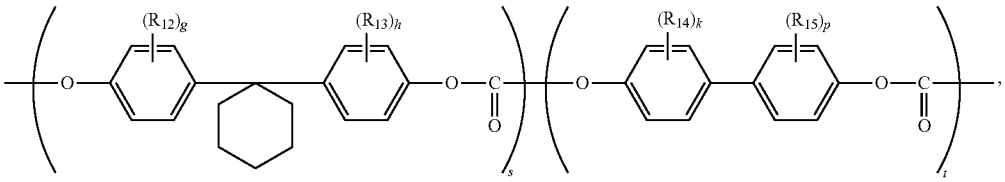

where $R_{12}$ to $R_{15}$ are the same or different and each represent a hydrogen atom, a $C_{1-10}$ alkyl group or a $C_{1-10}$ fluoroalkyl group;

g, h, k, and p each represent an integer of 0 to 4;

s and t satisfy $0.3 \leq t/(s+t) \leq 0.7$; and the chain end group is a monovalent aromatic group;

General Formula (ET1)

(ET1)

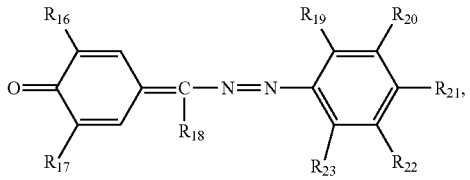

where $R_{16}$ and $R_{17}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group or a halogenated alkyl group;

$R_{18}$ represents a hydrogen atom, a $C_{1-6}$ alkyl group, a $C_{1-6}$ alkoxy group, an optionally substituted aryl group, a cycloalkyl group, an optionally substituted aralkyl group or a halogenated alkyl group; and $R_{19}$ to $R_{23}$ are the same or different and each represent a hydrogen atom, a halogen atom, a $C_{1-12}$ alkyl group, a $C_{1-12}$ alkoxy group, an optionally substituted aryl group, an optionally substituted aralkyl group, an optionally substituted phenoxy group, a halogenated alkyl group, a cyano group or a nitro group, or two or more of the groups optionally combine together to form a ring; and where the substituent represents a halogen atom, a $C_{1-6}$ alkyl group, a $C_{1-6}$ alkoxy group, a hydroxy group, a cyano group, an amino group, a nitro group or a halogenated alkyl group;

General Formula (ET2)

(ET2)

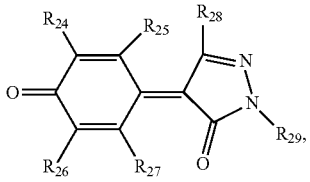

where $R_{24}$ to $R_{29}$ are the same or different and each represent a hydrogen atom, a halogen atom, a cyano group, a nitro group, a hydroxy group, a $C_{1-12}$ alkyl group, a $C_{1-12}$ alkoxy group, an optionally substituted aryl group, an optionally substituted heterocyclic group, an ester group, a cycloalkyl group, an optionally substituted aralkyl group, an allyl group, an amide group, an amino group, an acyl group, an alkenyl group, an alkynyl group, a carboxyl group, a carbonyl group, a carboxy group or a halogenated alkyl group; and where the substituent represents a halogen atom, a $C_{1-6}$ alkyl group, a $C_{1-6}$ alkoxy group, a hydroxy group, a cyano group, an amino group, a nitro group or a halogenated alkyl group; and General Formula (ET3)

(ET3)

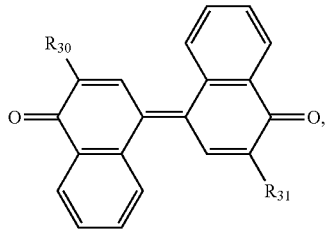

where $R_{30}$ and $R_{31}$ are the same or different and each represent a hydrogen atom, a $C_{1-12}$ alkyl group, a $C_{1-12}$ alkoxy group, an optionally substituted aryl group, a cycloalkyl group, an optionally substituted aralkyl group, or a halogenated alkyl group; and where the substituent represents a halogen atom, a $C_{1-6}$ alkyl group, a $C_{1-6}$ alkoxy group, a hydroxy group, a cyano group, an amino group, a nitro group or a halogenated alkyl group, wherein the photosensitive layer comprises a charge transport layer and a charge generation layer laminated in that order on the conductive substrate, and wherein the charge generation layer comprises the hole transport material, the binder resin and the at least one transport material.

10. The photoconductor for electrophotography according to claim 9, wherein the hole transport material has a hole mobility of $60 \times 10^{-6}$ $cm^2/V \cdot s$ or more; and wherein the charge generation layer contains the binder resin in an amount of 55% by mass or more and 85% by mass or less relative to solid content of the charge generation layer.

11. A process for producing the photoconductor for electrophotography according to claim 9, comprising steps of:

preparing a charge transport layer coating liquid;

applying the charge transport layer coating liquid on the conductive substrate to provide a charge transport layer coating;

drying the charge transport layer coating to provide a dried charge transport layer;

preparing a charge generation layer coating liquid containing the hole transport material having a structure represented by the General Formula (1), the binder resin having a repeating structure represented by the General Formula (2), and the at least one electron transport material having a structure represented by the General Formulae (ET1) to (ET3);

applying the charge generation layer coating liquid on the dried charge transport layer to provide a charge generation layer coating; and drying the charge generation layer coating to provide the photosensitive layer.

12. An electrophotographic apparatus equipped with the photoconductor for electrophotography according to claim 9.

* * * * *